US009979107B1

(12) United States Patent
Ootani

(10) Patent No.: US 9,979,107 B1
(45) Date of Patent: May 22, 2018

(54) CONNECTOR AND COMPOSITE CONNECTOR

(71) Applicant: JAPAN AVIATION ELECTRONICS INDUSTRY, LIMITED, Tokyo (JP)

(72) Inventor: Hideyuki Ootani, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days. days.

(21) Appl. No.: 15/683,963

(22) Filed: Aug. 23, 2017

(30) Foreign Application Priority Data

Nov. 18, 2016 (JP) ..... 2016-224992

(51) Int. Cl.

| | |
|---|---|
| ***H01R 13/64*** | (2006.01) |
| ***H01R 12/71*** | (2011.01) |
| ***H01R 13/703*** | (2006.01) |
| ***H01R 13/6476*** | (2011.01) |
| ***H01R 13/631*** | (2006.01) |
| ***H01R 12/72*** | (2011.01) |
| ***H01R 24/64*** | (2011.01) |
| ***H01R 27/02*** | (2006.01) |
| ***H01R 13/24*** | (2006.01) |
| *H01R 107/00* | (2006.01) |

(52) U.S. Cl.
CPC ..... *H01R 12/714* (2013.01); *H01R 12/72* (2013.01); *H01R 13/2492* (2013.01); *H01R 13/6315* (2013.01); *H01R 13/64* (2013.01); *H01R 13/6476* (2013.01); *H01R 13/7033* (2013.01); *H01R 24/64* (2013.01); *H01R 27/02* (2013.01); *H01R 2107/00* (2013.01)

(58) Field of Classification Search
None
See application file for complete search history.

(56) References Cited

U.S. PATENT DOCUMENTS 7,361,041 B2 * 4/2008 Hashiguchi ..... H01R 13/6315 439/247
2003/0232533 A1 * 12/2003 Burmeister ..... H01R 12/721 439/259
2010/0323237 A1 * 12/2010 Huang ..... H01R 13/6315 429/163

FOREIGN PATENT DOCUMENTS

JP H10-172669 A 6/1998

* cited by examiner

*Primary Examiner* — Tho D Ta
(74) *Attorney, Agent, or Firm* — Collard & Roe, P.C.

(57) ABSTRACT

A connector is arranged in a hole portion of a retaining member and is fitted as a floating connector to a mating connector. For example, the connector includes a plurality of abutment portions, which are brought into abutment against the hole portion when the connector is arranged in the hole portion, and a plurality of biasing portions, which are configured to bias the plurality of abutment portions in respective abutment directions relative to a main outer surface portion of a shell. The plurality of abutment portions include a first abutment portion and a second abutment portion which are formed in an opposite side over a main plane being a plane which includes a main center line and is perpendicular to the main outer surface portion, and a third abutment portion which is formed at a position forming a triangle with the first abutment portion and the second abutment portion.

13 Claims, 35 Drawing Sheets

CONNECTOR AND COMPOSITE CONNECTOR

This application is based upon and claims the benefit of priority from Japanese Patent Application No. 2016-224992 filed on Nov. 18, 2016, the disclosure of which is incorporated herein in its entirety by reference.

BACKGROUND OF THE INVENTION

1. Field of the Invention

This invention relates to a connector and a composite connector.

2. Description of the Related Art

In general, a connector is an electrical component, which is to be fitted to a mating connector, to thereby electrically connect mounted objects, which are mounted to the connector and the mating connector, to each other. As such a connector, there has been given a so-called floating connector which is capable of displacing positions of contacts in accordance with a position of the mating connector at the time of fitting to the mating connector. Various configurations of such a floating connector have been proposed.

For example, in Japanese Unexamined Patent Application Publication No. 10-172669 (JP 10-172669 A), there is disclosed that a box-shaped retaining member, which is referred to as "case" in JP 10-172669 A, includes a male hood portion having a loose-fit hole into which a male terminal unit is loosely fitted. On an outer peripheral surface of the male terminal unit disclosed in JP 10-172669 A, there are integrally formed a large number of elastic pieces which obliquely and outwardly stand from a front end portion side to a rear end portion side of the male terminal unit. According to the disclosure of JP 10-172669 A, with the above-mentioned configuration, when the male terminal unit is loosely fitted in a horizontal posture into the loose-fit hole of the male hood portion, a rear end portion of each elastic piece is brought into abutment against an inner peripheral surface of the loose-fit hole so that the elastic pieces are elastically deformed inward, thereby retaining the male terminal unit with an elastic force so that the male terminal unit is positioned at a substantially center portion of the loose-fit hole.

SUMMARY OF THE INVENTION

However, with the male connector disclosed in JP 10-172669 A, when the mating connector is fitted while being inclined, the male terminal unit may be inclined, and there is a case where the inclination of the male terminal unit is not restored even after removal of the mating connector.

For example, when a female connector being the mating connector is fitted in a state of being inclined in an up-and-down direction with respect to a fitting direction, the male terminal unit follows the inclination of the female connector to be inclined with respect to the retaining member. Under the state in which the male terminal unit is inclined, there is a case where an abutment position of the rear end portion of each elastic piece with respect to the inner peripheral surface of the loose-fit hole is displaced. Further, under the state in which the male terminal unit is inclined, a force which is larger than a tolerable load may be applied to the elastic pieces. As a result, there is a case where the elastic pieces are plastically deformed. Further, when the female connector is fitted in a state of being inclined in the up-and-down direction with respect to the fitting direction and also being displaced in positions in the up-and-down direction, the abutment position of the rear end portion of each elastic piece becomes more liable to be displaced, and each elastic piece becomes more liable to be plastically deformed.

In such cases, even when the female connector is removed after being fitted, the inclination of the male terminal unit cannot be restored with the elastic pieces, with the result that the inclination of the male terminal unit with respect to the retaining member may remain. When the inclination of the male terminal unit with respect to the retaining member remains, and the next female connector is fitted in such a state, there is a case where the male terminal unit cannot follow the direction of the female connector, with the result that the female connector cannot be smoothly fitted. Further, such a state may result in breakage of the male terminal unit.

This invention has been made in view of the above-mentioned circumstances, and has an object to provide a connector which is capable of constructing a floating connector in which the inclination at the time of fitting is less liable to remain after removal of the mating connector which is fitted while being inclined.

In order to accomplish the above-mentioned object, a connector according to a first aspect of this invention, which is to be arranged in a hole portion formed in a retaining member, includes an outer surface portion which extends in a fitting direction of the connector; a plurality of abutment portions which are to be brought into abutment against any one of the outer surface portion and the hole portion when the connector is arranged in the hole portion; and a plurality of biasing portions, which are interposed between the outer surface portion and the hole portion and are configured to bias the plurality of abutment portions in respective abutment directions, the plurality of abutment portions comprising a first abutment portion and a second abutment portion which are formed in an opposite side over a main plane, the main plane including a main center line of center lines of the outer surface portion, which is parallel to the fitting direction, and being perpendicular to the outer surface portion; and a third abutment portion which is formed at a position forming a triangle with the first abutment portion and the second abutment portion.

The plurality of abutment portions and the plurality of biasing portions may be integrally formed and fixed in the hole portion. The plurality of abutment portions may be brought into abutment against the outer surface portion when the connector is arranged in the hole portion. The plurality of biasing portions may be interposed between the outer surface portion and the hole portion to bias the plurality of abutment portions in the respective abutment directions.

The plurality of abutment portions may be brought into abutment against the hole portion when the connector is arranged in the hole portion. Each of the plurality of biasing portions may have one end fixed to the outer surface portion and extend from the one end along the fitting direction so as to be interposed between the outer surface portion and the hole portion, to thereby bias the plurality of abutment portions in the respective abutment directions.

The third abutment portion may be formed so as to be deviated from the main center line parallel to the fitting direction. The plurality of abutment portions may further comprise a fourth abutment portion formed in an opposite side over the main plane with respect to the third abutment portion. The fourth abutment portion may be formed at a position forming a triangle with the first abutment portion and the second abutment portion.

Both the first abutment portion and the second abutment portion may be formed at positions at which the first abutment portion and the second abutment portion are brought into abutment against a vicinity of an end portion of the hole potion, which is close to a base portion of the connector when the connector is arranged in the hole portion.

The connector may further include a housing to which a plurality of contacts are fixed; and a shell, which is a cylindrical member extending in the fitting direction and is provided around the housing. The shell may include the outer surface portion. The plurality of abutment portions and the plurality of biasing portions may be formed integrally with the shell.

The connector may further include a plurality of locking portions which extend in the fitting direction to be locked to the hole portion. Each of the plurality of locking portions may comprise another abutment portion which is to be brought into abutment against the hole portion when the connector is arranged in the hole portion; another biasing portion which extends in the fitting direction so as to bias the another abutment portion; and a locking lance, which protrudes in a biasing direction of the another biasing portion and is to be locked to the hole portion when the connector is arranged in the hole portion.

The connector may further include another outer surface portion which is parallel to the outer surface portion; and side surface portions which connect side ends of the outer surface portion and the another outer surface portion along the fitting direction. The plurality of locking portions may include a first locking portion and a second locking portion which are provided in opposite sides about a center plane, the center plane passing through a sub-center line of the side surface portions, which is parallel to the fitting direction and being parallel to the outer surface portion.

The plurality of locking portions may be formed integrally with the housing.

At least one of the plurality of locking portions may include a connection portion having one end connected to a vicinity of a base portion of the housing and another end connected to a base portion of the another biasing portion; a sub-abutment portion, which is formed in a vicinity of a base portion of the connection portion and is brought into abutment against the hole portion when the connector is inserted to the hole portion; and a sub-biasing portion, which extends in the fitting direction in the connection portion and is configured to bias the sub-abutment portion.

In order to accomplish the above-mentioned object, a composite connector according to a second aspect of this invention includes a fixed connector; a retaining member having a hole portion; and the connector of the first aspect, the retaining member having the fixed connector fixed to the retaining member and the connector being arranged in the hole portion.

The connector may be removably arranged in the hole portion.

In order to accomplish the above-mentioned object, a composite connector according to a second aspect of this invention includes a fixed connector, a retaining member having a hole portion; and the connector of the first aspect, the retaining member having the fixed connector fixed to the retaining member and the connector being arranged in the hole portion, the connector extending in a fitting direction of the connector and further comprising a plurality of locking portions to be locked to the hole portion, each of the plurality of locking portions comprising another abutment portion which is to be brought into abutment against the hole portion when the connector is arranged in the hole portion; another biasing portion which extends in the fitting direction and configured to bias the another abutment portion; and a locking lance, which protrudes in a biasing direction of the another biasing portion and is to be locked to the hole portion when the connector is arranged in the hole portion, the hole portion of the retaining member comprising a locked portion to which the locking lance is locked; and a releasing hole portion which communicates with the locked portion from an outside.

According to this invention, there can be constructed a floating connector in which the inclination at the time of fitting is less liable to remain after removal of the mating connector which is fitted while being inclined.

DESCRIPTION OF THE EMBODIMENTS

Figure 1:
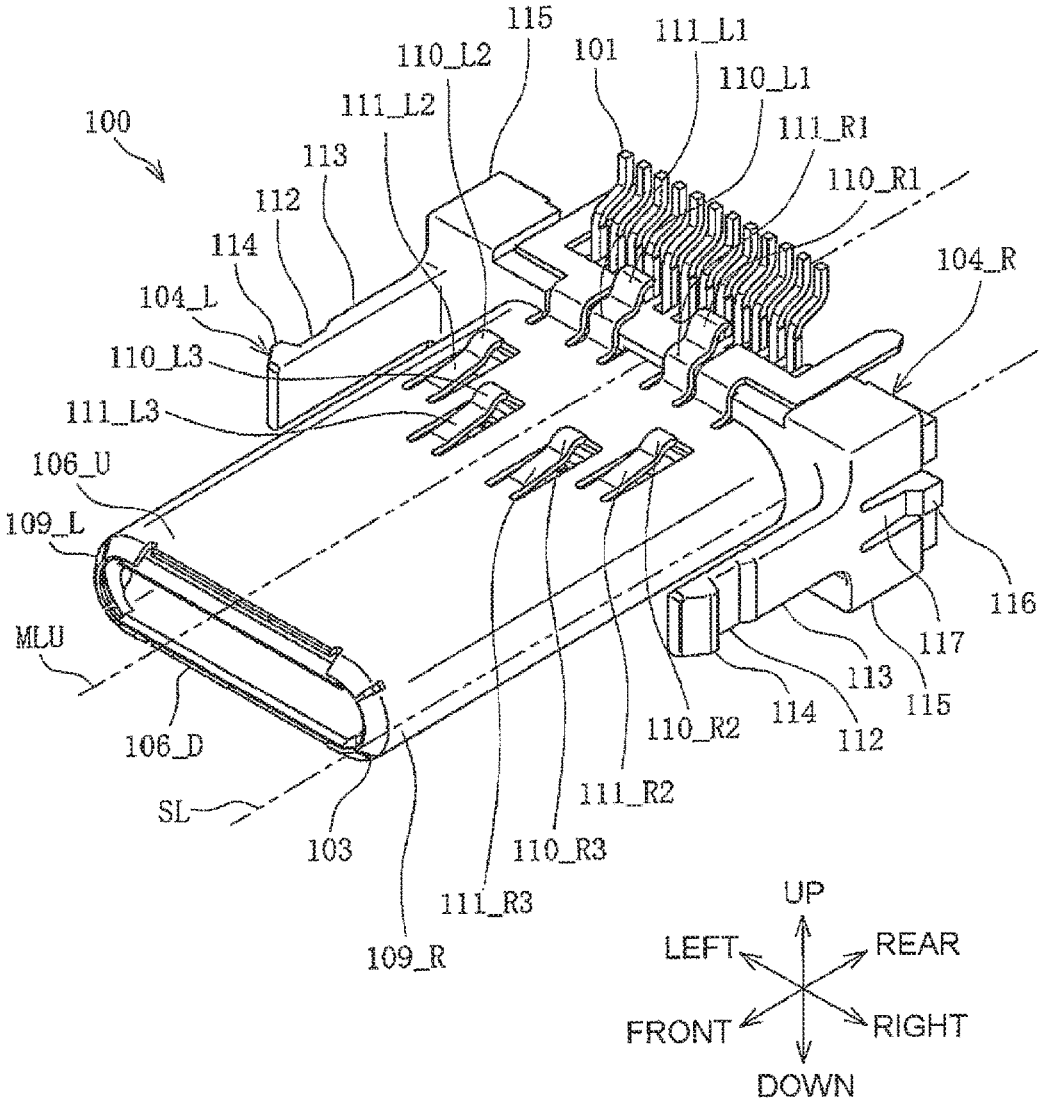
FIG. 1 is a perspective view of a connector according to a first embodiment of this invention.

Now, with reference to the drawings, an electrical connector according to embodiments of this invention is described. The same components are denoted by the same reference symbols in all of the drawings. Further, in the description of the embodiments of this invention and in the drawings, terms "up", "down", "front", "rear", "right", and "left" are used. Those terms are used for description of directions and are not intended to limit this invention.

First Embodiment

<<Configuration>>

A connector 100 according to a first embodiment of this invention is assembled to a retaining member (118), and is fitted as a floating connector (119) to a mating connector. As illustrated in FIG. 1 to FIG. 7, the connector 100 includes a plurality of contacts 101, a housing 102, a shell 103, and a plurality of locking portions 104_L and 104_R. FIG. 1 to FIG. 7 are a perspective view, an exploded perspective view, a plan view, a side view, a front view, a rear view, and a bottom view of the connector 100, respectively. The retaining member 118 and the floating connector 119 are illustrated in, for example, FIG. 8 and FIG. 9, and details thereof are described later.

Figure 2:
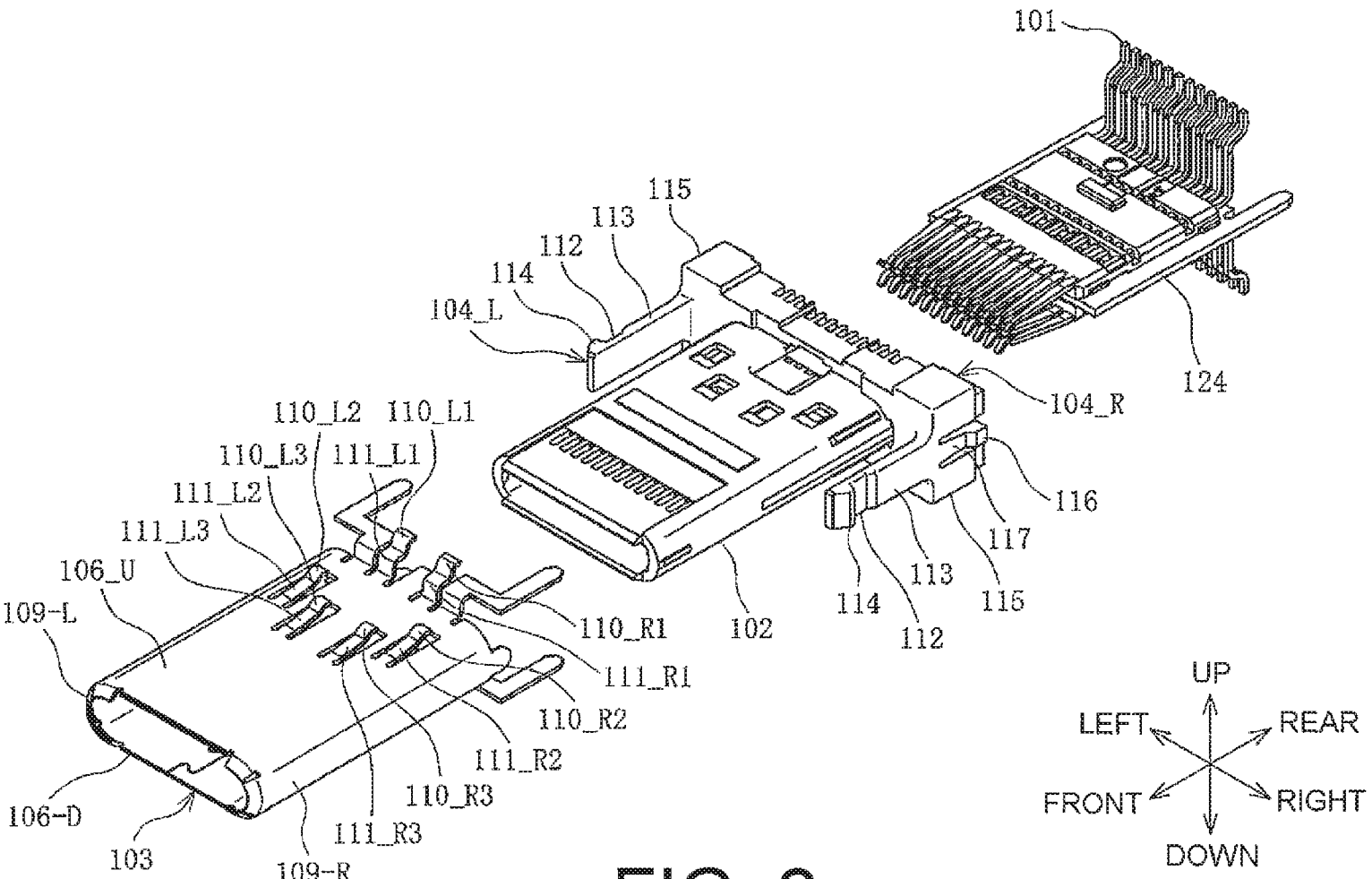
FIG. 2 is an exploded perspective view of the connector according to the first embodiment.
Figure 3:
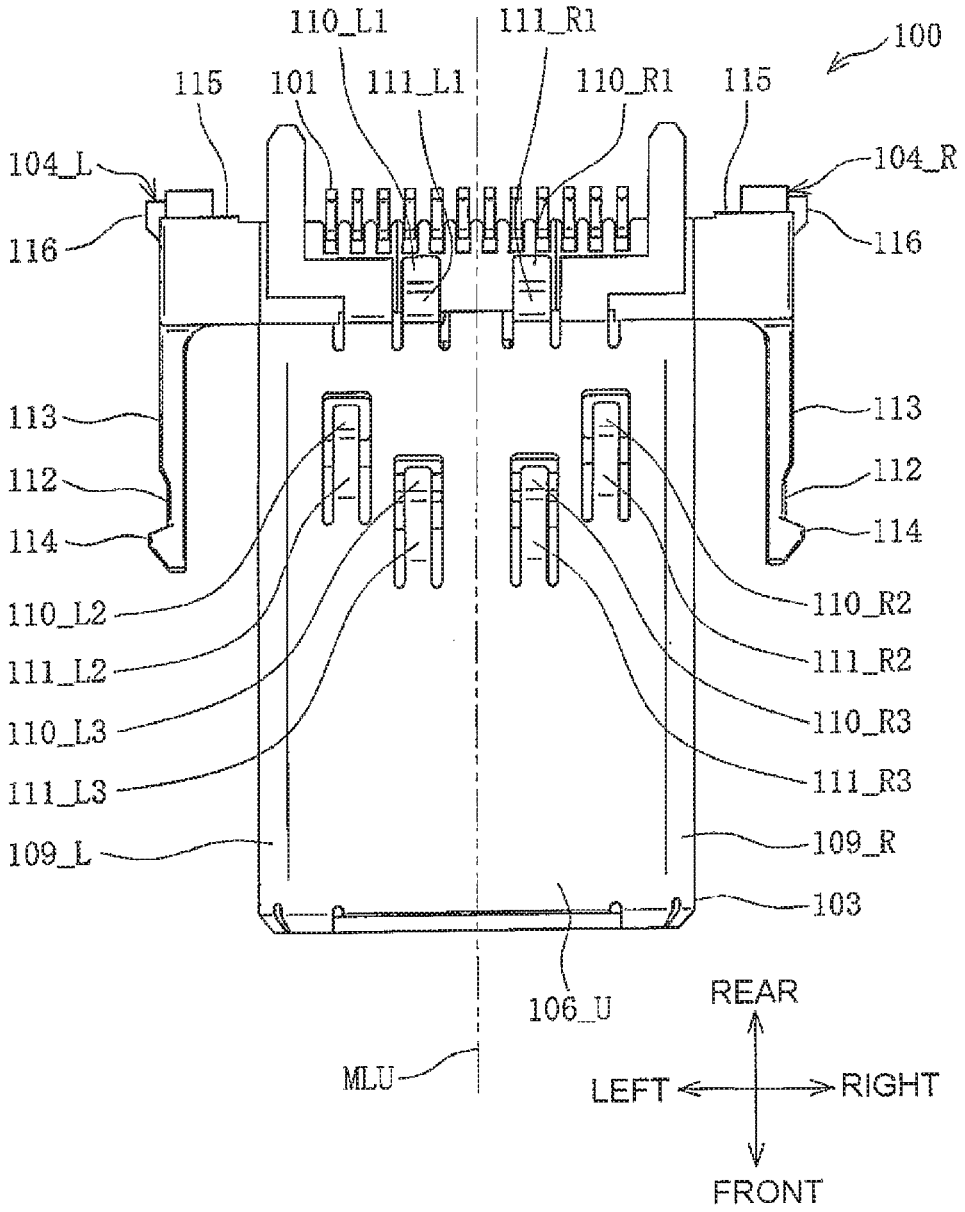
FIG. 3 is a plan view of the connector according to the first embodiment.
Figure 4:
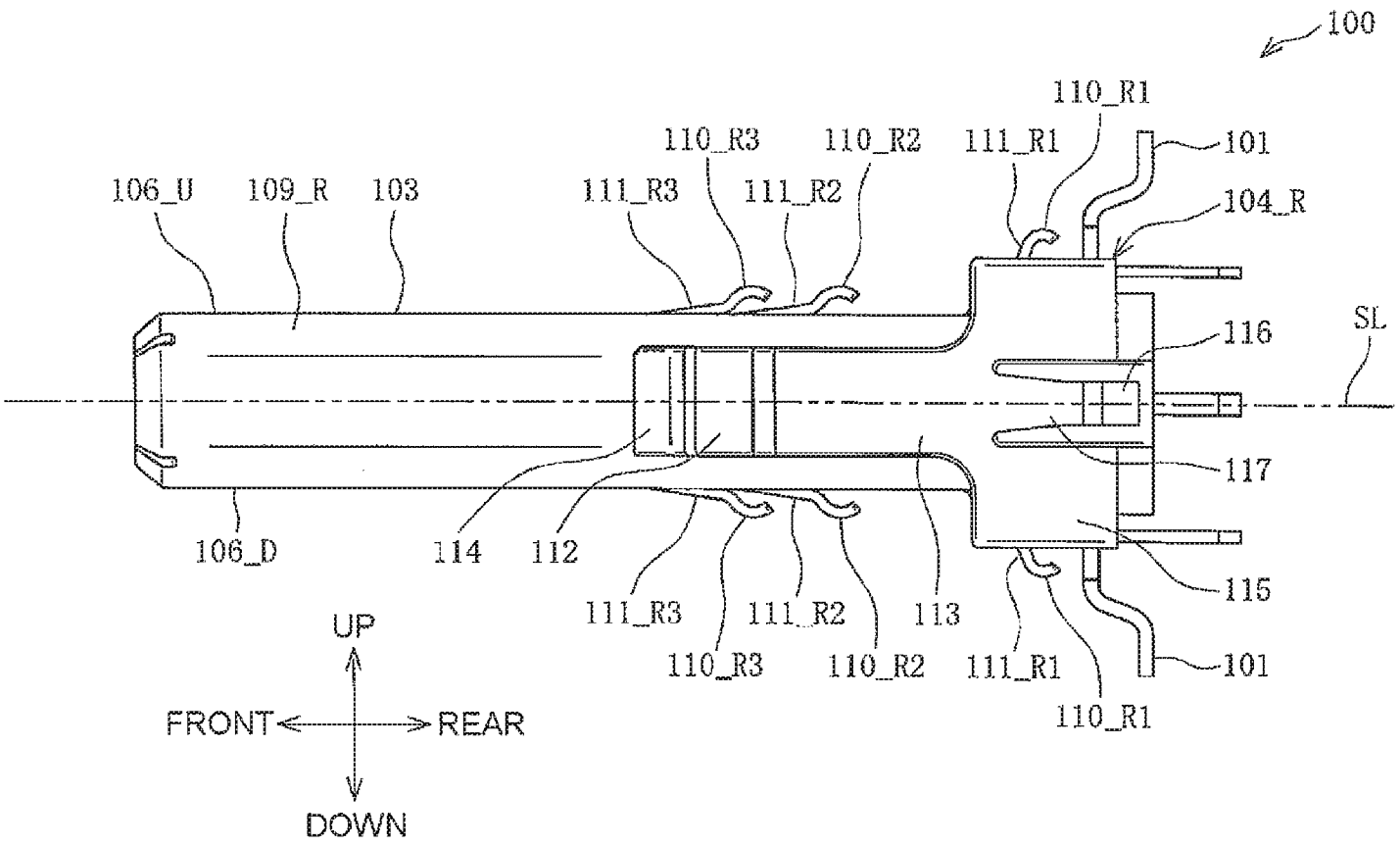
FIG. 4 is a side view of the connector according to the first embodiment.
Figure 5:
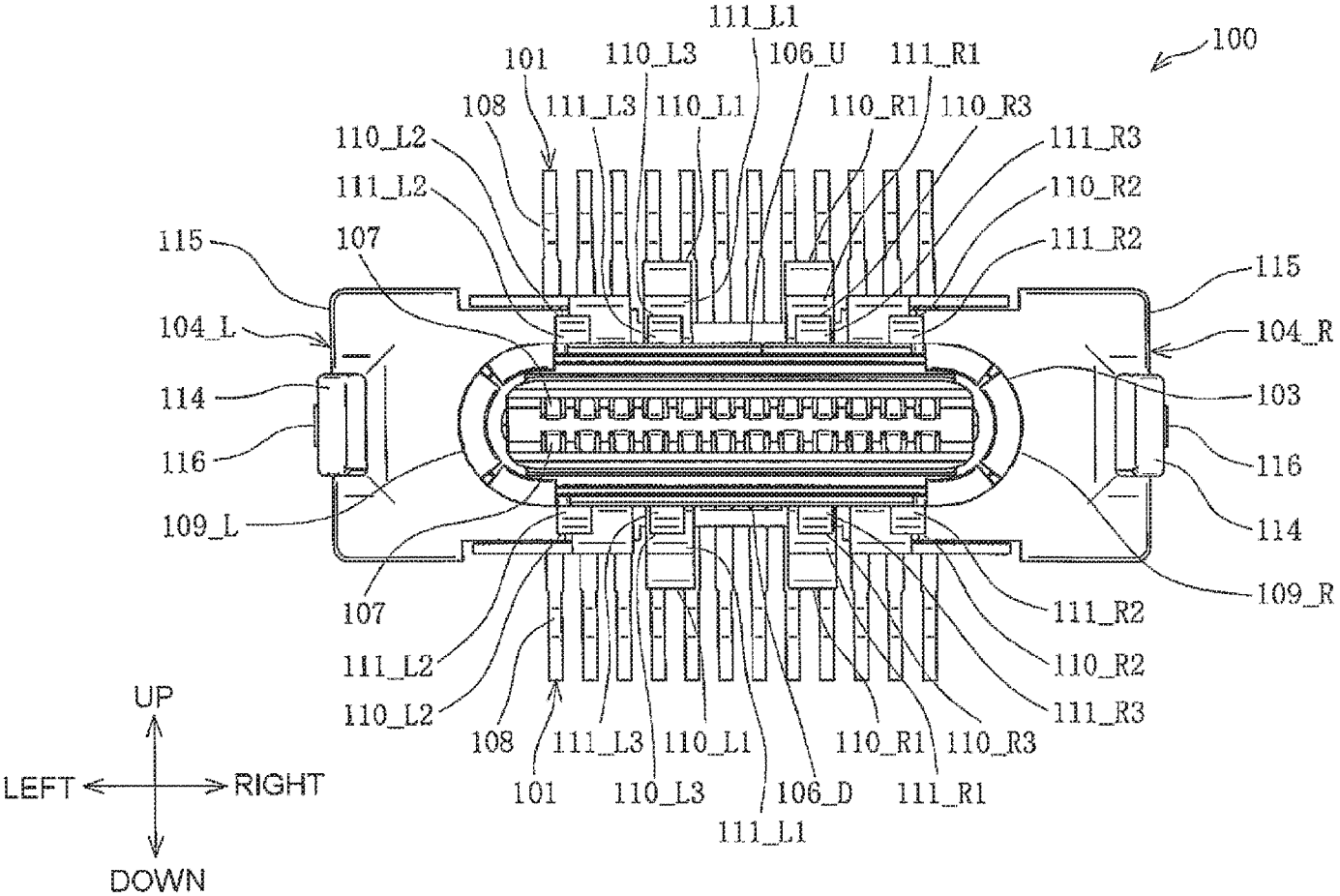
FIG. 5 is a front view of the connector according to the first embodiment.
Figure 6:
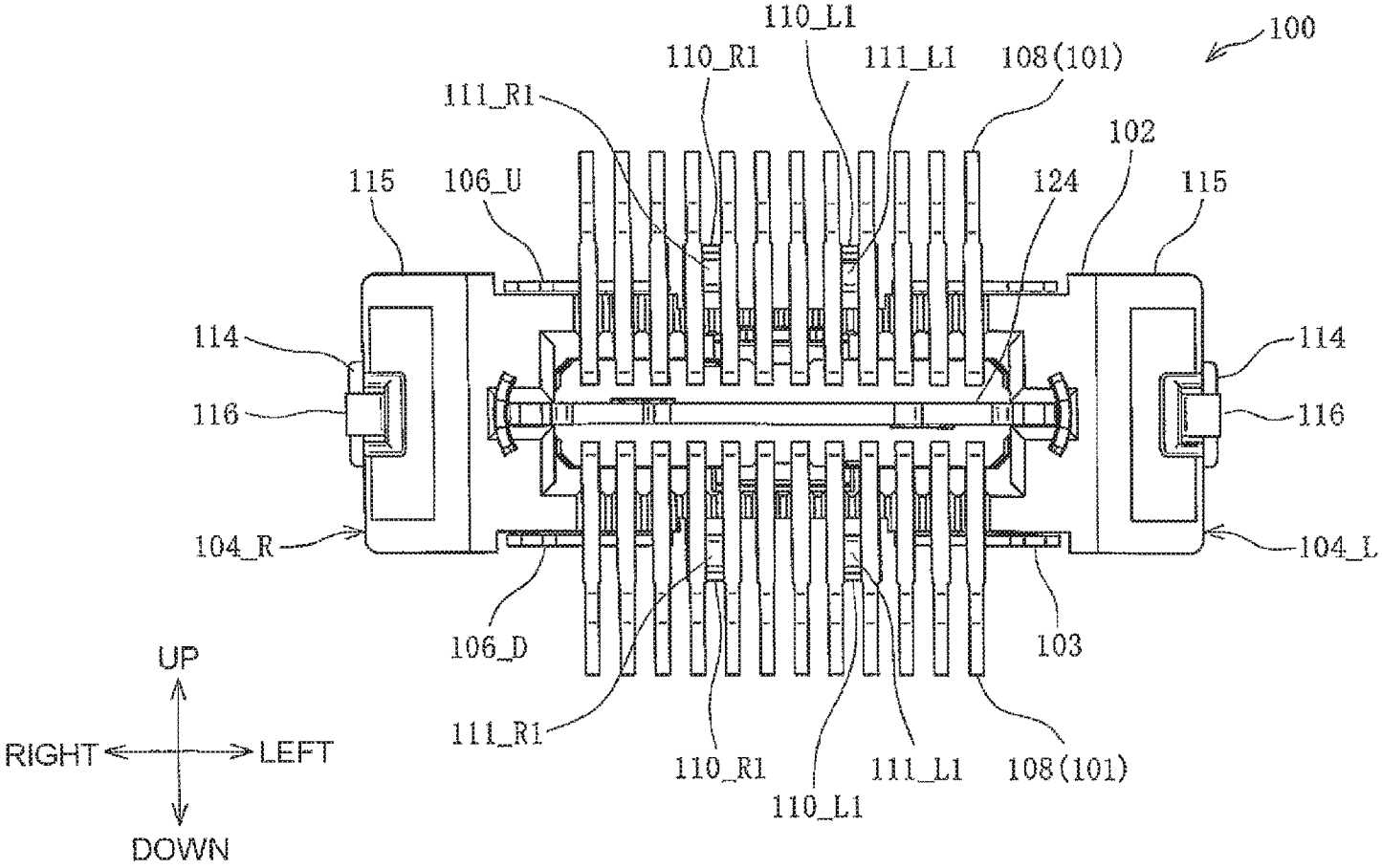
FIG. 6 is a rear view of the connector according to the first embodiment.
Figure 7:
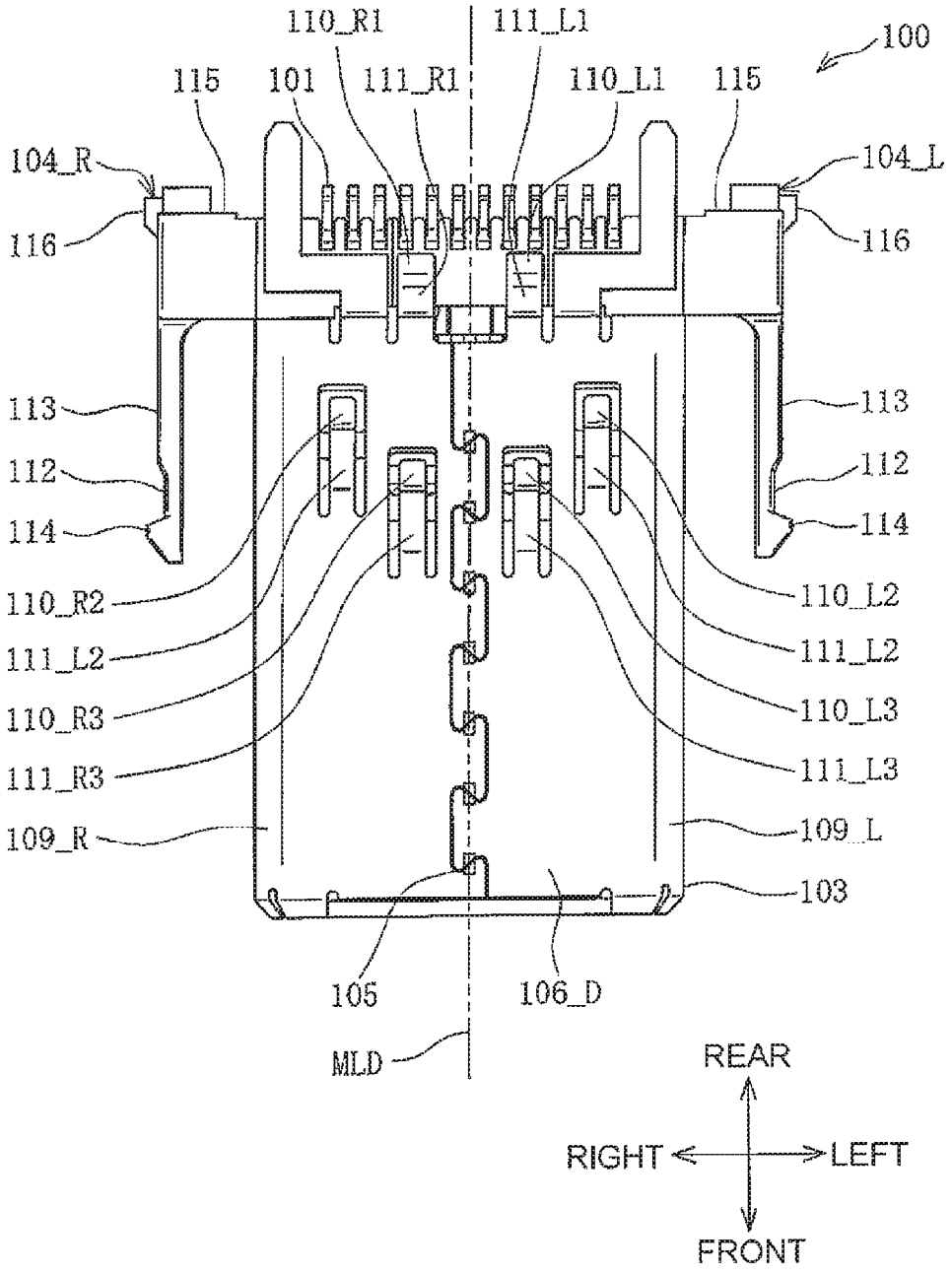
FIG. 7 is a bottom view of the connector according to the first embodiment.

The plurality of contacts 101 are members having conductivity. As illustrated in FIG. 2, the plurality of contacts 101 are arranged so as to form pairs, and are fixed to a contact fixing member 124 so that the pairs are aligned in one direction.

In the first embodiment, a front-and-rear direction corresponds to a fitting direction. A forward direction corresponds to a moving direction at the time of fitting to the mating connector, and a rearward direction corresponds to a moving direction at the time of removing from the mating connector. Further, an up-and-down direction corresponds to a direction in which the contacts 101 are opposed to each other to form pairs, and a right-and-left direction corresponds to a direction in which the pairs of contacts 101 are aligned. In the first embodiment, the shell 103 is formed by bending one metal plate and coupling both ends of the metal plate to each other at a coupling portion 105. A direction in which a main outer surface portion 106_D having the coupling portion 105 is oriented is defined as a downward direction, and a direction in which a main outer surface portion 106_U opposed to the main outer surface portion 106_D is oriented is defined as an upward direction. A rightward direction and a leftward direction may be determined as viewed from a front side. The connector 100 according to the first embodiment generally has an up-down symmetry and a right-left symmetry.

Each of the contacts 101 has an extending portion 107 and a mounting portion 108, and is formed by bending, for example, an extremely slender metal piece.

The extending portion 107 is a portion generally extending in the front-and-rear direction. When the connector 100 is fitted as the floating connector (119) to the mating connector, a vicinity of a distal end, which is a vicinity of a front end in the first embodiment, of the extending portion 107 is brought into contact with a mating contact of the mating connector. Specifically, the vicinity of the distal end of the extending portion 107 herein corresponds to a portion which is located between the distal end of the extending portion 107 and a position separated rearward from the distal end by a predetermined distance.

The mounting portion 108 is a portion which is bent from a base end, which is a rear end in the first embodiment, of the extending portion 107 to form a step and generally extends upward or downward. The mounting portion 108 is connected to a mounted object such as a board or a cable. Specifically, the contacts 101 of the first embodiment are arranged to form upper and lower pairs as described above, and the mounting portions 108 of the contacts 101 arranged on an upper side generally extend upward. Further, the mounting portions 108 of the contacts 101 arranged on a lower side generally extend downward.

The housing 102 is a member to which the plurality of contacts 101 are fixed. In the first embodiment, the plurality of contacts 101 are fixed to an inner side of the housing 102 in a state of being fixed to the contact fixing member 124.

The housing 102 of the first embodiment is made of resin and is formed by injection molding or the like. The material of the housing 102 is not limited to resin as long as the material has an insulating property.

The shell 103 is a cylindrical member extending in the front-and-rear direction and is provided around the housing 102. With this configuration, the plurality of contacts 101 are arranged inside the shell 103.

For example, as described above, the shell 103 is manufactured by bending a metal plate and coupling both ends of the metal plate at the coupling portion 105. A material of the shell 103 is not limited to metal, and a method for manufacturing the shell 103 is not limited to the method described herein.

The shell 103 includes the pair of main outer surface portions 106_U and 106_D, which are parallel to each other, and a pair of side surface portions 109_L and 109_R, which intersect with the pair of main outer surface portions 106. The pair of main outer surface portions 106_U and 106_D and the pair of side surface portions 109_L and 109_R form a substantially entire outer surface of the shell 103.

In the following, the main outer surface portions 106_U and 106_D are also described as "main outer surface portion 106" unless otherwise distinguished. Further, the side surface portions 109_L and 109_R are also described as "side surface portion 109" unless otherwise distinguished. Each of the main outer surface portions 106_U and 106_D corresponds to an outer surface portion.

The main outer surface portions 106 extend along the front-and-rear direction in parallel to each other. In the first embodiment, the two main outer surface portions 106_U and 106_D are aligned in the up-and-down direction and each have a rectangular flat outer surface which is elongated in the front-and-rear direction.

Each of the main outer surface portions 106 includes a plurality of abutment portions 110_L1, 110_L2, 110_L3, 110_R1, 110_R2, and 110_R3 and a plurality of biasing portions 111_L1, 111_L2, 111_L3, 111_R1, 111_R2, and 111_R3.

In the following, the abutment portions 110_L1, 110_L2, 110_L3, 110_R1, 110_R2, and 110_R3 are also described as "abutment portion 110" unless otherwise distinguished. Further, the biasing portions 111_L1, 111_L2, 111_L3, 111_R1, 111_R2, and 111_R3 are also described as "biasing portion 111" unless otherwise distinguished.

When the shell 103 is assembled to the retaining member (118) described later, each of the plurality of abutment portions 110 is brought into abutment against the retaining member (118). In the first embodiment, six abutment portions 110 are formed on each of the main outer surface portions 106_U and 106_D. Positions of the six abutment portions 110 formed on the main outer surface portion 106_U in the front-and-rear direction are the same as positions of the six abutment portions 110 formed on the main outer surface portion 106_D in the right-and-left direction. The term "abutment" used herein corresponds to a state of contact in an abutted state.

Specifically, the abutment portions 110_L1 to 110_L3 and the abutment portions 110_R1 to 110_R3 are arranged in a right-left symmetry on a left half portion and a right half portion of the main outer surface portion 106, respectively. Herein, the left half portion and the right half portion of the main outer surface portion 106 correspond to a portion on the left and a portion on the right over a main center line ML, respectively.

The main center line ML includes a main center line MLU of the main outer surface portion 106_U and a main center line MLD of the main outer surface portion 106_D. The main center line MLU is a line parallel to the front-and-rear direction among center lines of the main outer surface portion 106U. The center lines of the main outer surface portion 106_U are lines which pass through a gravity center of the main outer surface portion 106_U. The main center line MLD is defined in the same manner as the main center line MLU, and is a line parallel to the front-and-rear direction among center lines of the main outer surface portion 106_D which pass through a gravity center of the main outer surface portion 106_D. In the following, the main center lines MLU and MLD are also described as "main center line ML" unless otherwise distinguished.

For example, the abutment portion 110_L1 and the abutment portion 110_R1 formed on the main outer surface portion 106 are formed in an opposite side over a main plane which is a plane including the main center line ML and being perpendicular to the main outer surface portion 106. Therefore, it may be considered that the abutment portion 110_L1 and the abutment portion 110_R1 correspond to a first abutment portion and a second abutment portion, respectively. The main plane is an imaginary plane.

In this case, the abutment portions 110_L2, 110_L3, 110_R2, and 110_R3 which are other than the abutment portion 110_L1 and the abutment portion 110_R1 are not linearly aligned with the abutment portion 110_L1 and the abutment portion 110_R1. That is, the abutment portion 110_L1, the abutment portion 110_R1, and one of the abutment portions 110_L2, 110_L3, 110_R2, and 110_R3, which are other than the abutment portion 110_L1 and the abutment portion 110_R1, are located at positions forming a triangle. Therefore, it may be considered that one abutment portion suitably selected from the abutment portions 110_L2, 110_L3, 110_R2, and 110_R3, which are other than the abutment portion 110_L1 and the abutment portion 110_R1, corresponds to a third abutment portion.

For example, it is assumed that one of the abutment portions 110_L2 and 110_L3 corresponds to the third abutment portion. In this case, it may be considered that one abutment portion suitably selected from the abutment portions 110_R2 and 110_R3, which are other than the abutment portion 110_L1 and the abutment portion 110_R1 and are in a opposite side over the main center line ML with respect to one of the abutment portions 110_L2 and 110_L3 corresponding to the third abutment portion, corresponds to a fourth abutment portion. In this case, the fourth abutment portion is located in an opposite side over the main plane with respect to the third abutment portion.

Further, as for the third abutment portion, unlike the above-mentioned example, it is assumed that one of the abutment portions 110_R2 and 110_R3 corresponds to the third abutment portion. In this case, it may be considered that one abutment portion suitably selected from the abutment portions 110_L2 and 110_L3, which are other than the abutment portion 110_L1 and the abutment portion 110_R1 and are in a opposite side over the main center line ML with respect to one of the abutment portions 110_R2 and 110_R3 corresponding to the third abutment portion, corresponds to the fourth abutment portion. Also in this case, the fourth abutment portion is located in an opposite side over the main plane with respect to the third abutment portion.

As described above, it is only necessary that the first abutment portion and the second abutment portion be formed in a opposite side over the main plane, which is a plane including the main center line ML and being perpendicular to the main outer surface portion 106. Accordingly, for example, a combination of one abutment portion suitably selected from the abutment portions 110_L1 to 110_L3 and one abutment portion suitably selected from the abutment portions 110_R1 to 110_R3 may correspond to the combination of the first abutment portion and the second abutment portion.

Further, the abutment portions 110 which are other than the abutment portions corresponding to the first abutment portion and the second abutment portion are not linearly aligned with the abutment portions corresponding to the first abutment portion and the second abutment portion. That is, the abutment portions 110 which are other than the abutment portions corresponding to the first abutment portion and the second abutment portion are located at positions forming a triangle with the abutment portions corresponding to the first abutment portion and the second abutment portion. Accordingly, one abutment portion suitably selected from the abutment portions 110 which are other than the abutment portions corresponding to the first abutment portion and the second abutment portion may correspond to the third abutment portion. Further, one abutment portion suitably selected from the abutment portions 110, which are other than the abutment portions corresponding to the first abutment portion and the second abutment portion and are in a opposite side over the main center line ML with respect to the abutment portion 110 corresponding to the third abutment portion, may correspond to the fourth abutment portion. Such a fourth abutment portion is located in a opposite side over the main plane with respect to the third abutment portion.

The plurality of biasing portions 111_L1, 111_L2, 111_L3, 111_R1, 111_R2, and 111_R3 are associated with the plurality of abutment portions 110_L1, 110_L2, 110_L3, 110_R1, 110_R2, and 110_R3, respectively, and are configured to bias the associated abutment portions 110_L1, 110_L2, 110_L3, 110_R1, 110_R2, and 110_R3 outward. Herein, the term "outward" only needs to represent a direction toward an outer side from the connector 100, in other words, a direction of separating from the outer surface of the connector 100. In the first embodiment, the outer surface of the connector 100 is, for example, the main outer surface portion 106 of the shell 103. Further, the term "bias" corresponds to increase in force or application of force based on elasticity and the like, in a direction.

In the first embodiment, the plurality of biasing portions 111 formed on the main outer surface portion 106_U are configured to bias the plurality of abutment portions 110 formed on the main outer surface portion 106_U upward. Further, the plurality of biasing portions 111 formed on the main outer surface portion 106_D are configured to bias the plurality of abutment portions 110 formed on the main outer surface portion 106_D downward.

Each of the biasing portions 111 of the first embodiment is a small piece extending in the front-and-rear direction, and is in a cantilevered state with one end being a fixed end fixed to the main outer surface portion 106 and another end being a free end. The associated abutment portion 110 is formed between the one end and the another end of each of the biasing portions 111. In the first embodiment, the abutment portion 110 is formed in the vicinity of the another end of the associated biasing portion 111, that is, at a position separated from the another end by a predetermined distance. Each of the biasing portions 111 has flexibility. Therefore, when the abutment portion 110 is displaced, the biasing portion 111 associated with the abutment portion 110 is capable of biasing the abutment portion 110 in the abutment direction by its restoring force.

Specifically, each of the biasing portions 111 of the first embodiment is formed by forming a U-shaped cutout portion in the main outer surface portion 106 of the shell 103 so that the front end becomes the fixed end. Each of the biasing portions 111 is inclined so as to protrude outward as extending rearward from the fixed end. The abutment portion 110 is formed so as to protrude outward while being curved along the front-and-rear direction in the vicinity of the rear end of the biasing portion 111, which is a portion located between the rear end and a position separated forward from the rear end by a predetermined distance. As described above, in the first embodiment, the plurality of abutment portions 110 and the plurality of biasing portions 111 are formed integrally with the shell 103.

It is only necessary that each of the biasing portions 111 have one end being a helical spring, a rubber piece, or the like fixed to the outer surface of the shell 103 so as to enable biasing.

The pair of side surface portions 109 includes a left side surface portion 109_L and a right side surface portion 109_R. The left side surface portion 109_L connects left ends of the pair of main outer surface portions 106 to each other. The right side surface portion 109_R connects right ends of the pair of main outer surface portions 106 to each other. In the first embodiment, each of the side surface portions 109 generally has a semi-arc shape as viewed from the front side.

A cross-sectional shape of the shell 103, that is, a shape of the shell 103 as viewed from, for example, the front side is not limited to the shape described in the first embodiment, and various shapes such as a rectangular shape and a circular shape may be employed.

The plurality of locking portions 104_L and 104_R extend in the front-and-rear direction at sides of the shell 103. Specifically, the locking portion 104_L extends in the front-and-rear direction on the left side of the left side surface portion 109_L of the shell 103. The locking portion 104_R extends in the front-and-rear direction on the right side of the right side surface portion 109_R of the shell 103. In the following, the locking portions 104_L and 104_R are also described as "locking portion 104" unless otherwise distinguished.

Each of the locking portions 104 includes a main abutment portion 112, a main biasing portion 113, a locking lance 114, a connection portion 115, a sub-abutment portion 116, and a sub-biasing portion 117, and is, for example, integrally made of resin. In the first embodiment, each of the locking portions 104 is formed integrally with the housing 102.

When the connector 100 is assembled to the retaining member (118), the main abutment portions 112 are brought into abutment against the retaining member (118). Each of the main abutment portions 112 of the first embodiment has a small flat surface which is oriented outward. Specifically, the main abutment portion 112 of the locking portion 104_L has a substantially rectangular small flat surface which is oriented leftward. The main abutment portion 112 of the locking portion 104_R has a substantially rectangular small flat surface which is oriented rightward.

The main biasing portion 113 is a flexible member extending in the front-and-rear direction, and the main abutment portion 112 is connected to a front end being a distal end of the main biasing portion 113. When the connector 100 is assembled to the retaining member (118), the main biasing portions 113 bias the main abutment portions 112 by its elastic force.

Specifically, when the connector 100 is assembled to the retaining member (118), the main biasing portions 113 of the first embodiment bias the main abutment portions 112 outward. That is, when the connector 100 is assembled to the retaining member (118), the main biasing portion 113 of the locking portion 104_L biases the main abutment portion 112 of the locking portion 104_L leftward, and the main biasing portion 113 of the locking portion 104_R biases the main abutment portion 112 of the locking portion 104_R rightward.

The locking lances 114 protrude in the biasing directions of the main biasing portions 113. When the connector 100 is assembled to the retaining member (118), the locking lances 114 are locked to the retaining member (118). In the first embodiment, the locking lance 114 is connected to a front side of the main biasing portion 113 through intermediation of the main abutment portion 112. The term "lock" corresponds to being engaged and stopped.

The connection portions 115 each have one end connected to the housing 102 and another end connected to a base portion of the main biasing portion 113. With this configuration, the connection portions 115 connect the housing 102 and the main biasing portions 113 to each other. Specifically, the connection portion 115 of the locking portion 104_L has a right end connected to the housing 102 and a left end connected to the base portion of the main biasing portion 113. The connection portion 115 of the locking portion 104_R has a left end connected to the housing 102 and a right end connected to the base portion of the main biasing portion 113.

The sub-abutment portion 116 is formed in the vicinity of the rear end of the connection portion 115, that is, at the rear end or at a position separated forward from the rear end by a predetermined distance. When the connector 100 is assembled to the retaining member (118), the sub-abutment portions 116 are brought into abutment against the retaining member (118). The rear end of the connection portion 115 corresponds to the base portion of the connection portion 115.

The sub-biasing portion 117 is a flexible portion of the connection portion 115, which extends in the front-and-rear direction. The sub-abutment portion 116 is formed at a rear end being a distal end of the sub-biasing portion 117. When the connector 100 is assembled to the retaining member (118), the sub-biasing portions 117 bias the sub-abutment portions 116 by its elastic force. In the first embodiment, the sub-biasing portion 117 biases the sub-abutment portion 116 sideward, that is, rightward or leftward.

Specifically, the sub-abutment portion 116 and the sub-biasing portion 117 of the first embodiment are integrally formed between a pair of slits, which are formed in the side wall of the connection portion 115 and are parallel to each other in the up-and-down direction. The pair of slits are opened on the rear side. With this configuration, there is formed the sub-biasing portion 117 which is in a cantilevered state with a fixed front end and a free rear end. The sub-abutment portion 116 protrudes sideward at the rear end of the sub-biasing portion 117 and has a substantially rectangular small flat surface at a protruding end thereof.

For example, the sub-abutment portion 116 and the sub-biasing portion 117 of the locking portion 104_L are integrally formed between a pair of slits which are formed in a left side wall of the connection portion 115 of the locking portion 104_L and are parallel to each other in the up-and-down direction. With the pair of slits, the sub-biasing portion 117 of the locking portion 104_L as described above is formed in the cantilevered state. The sub-abutment portion 116 of the locking portion 104_L protrudes leftward at the rear end of the sub-biasing portion 117 of the locking portion 104_L and has a substantially rectangular small flat surface at the left end thereof.

Further, for example, the sub-abutment portion 116 and the sub-biasing portion 117 of the locking portion 104_R are integrally formed between a pair of slits which are formed in a right side wall of the connection portion 115 of the locking portion 104_R and are parallel to each other in the up-and-down direction. With the pair of slits, the sub-biasing portion 117 of the locking portion 104_R as described above is formed in the cantilevered state. The sub-abutment portion 116 of the locking portion 104_R protrudes rightward at the rear end of the sub-biasing portion 117 of the locking portion 104_R and has a substantially rectangular small flat surface at the right end thereof.

The sub-biasing portion 117 is formed at least in the connection portion 115. However, this invention is not limited thereto, the sub-biasing portion 117 may be formed so as to extend to, for example, the main biasing portion 113.

<<Method of Use>>

Figure 8:
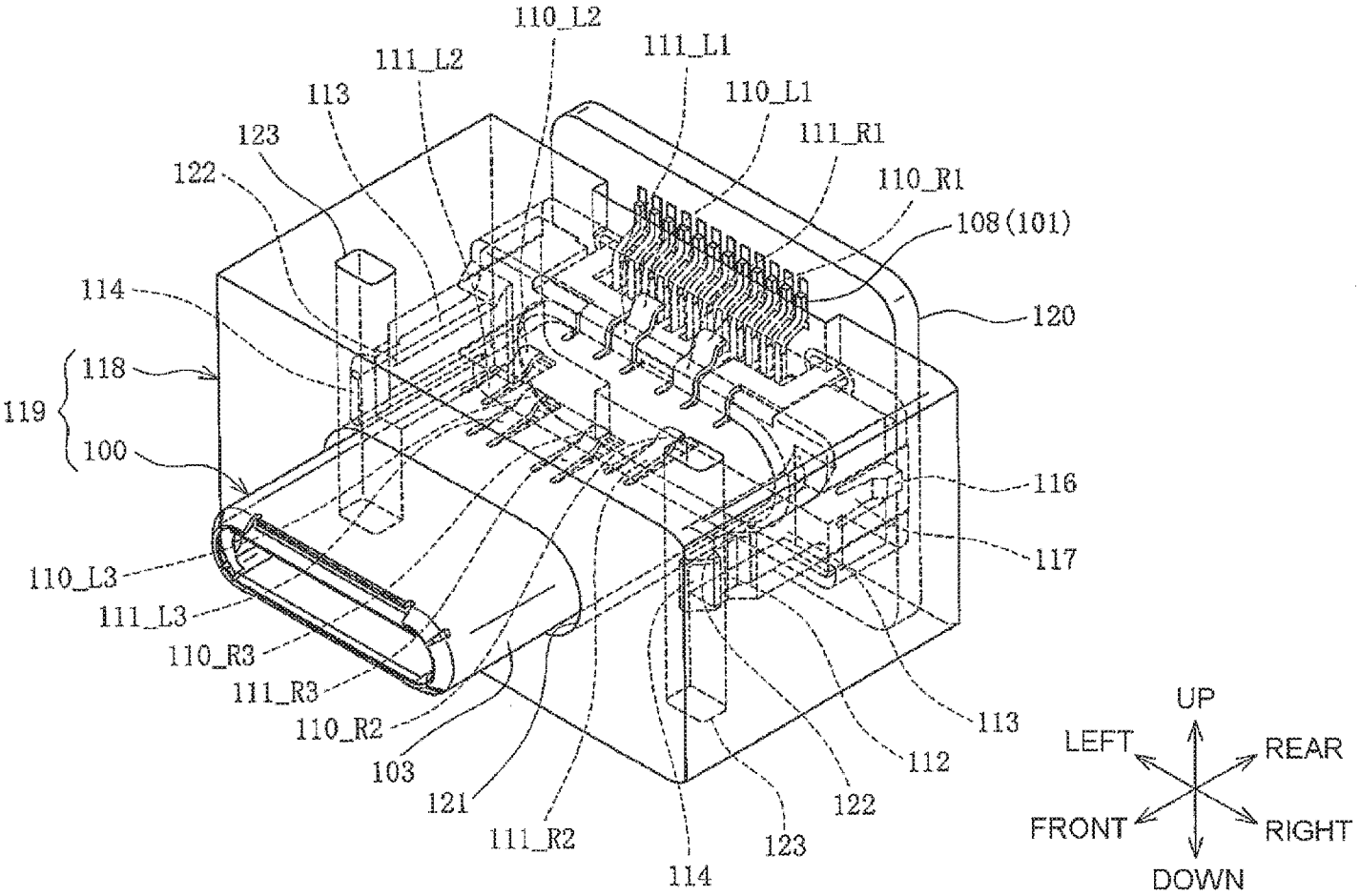
FIG. 8 is a view for illustrating an example of a state of use of the connector according to the first embodiment.

During use of the connector 100, as exemplified in FIG. 8, the connector 100 is arranged in the retaining member 118 to construct the floating connector 119. FIG. 8 is an illustration of an example in which a board 120 being a mounted object is mounted to the floating connector 119.

The floating connector 119 includes the retaining member 118 and the connector 100. The retaining member 118 has a hole portion 121, and the connector 100 is arranged in the hole portion 121.

Figure 9:
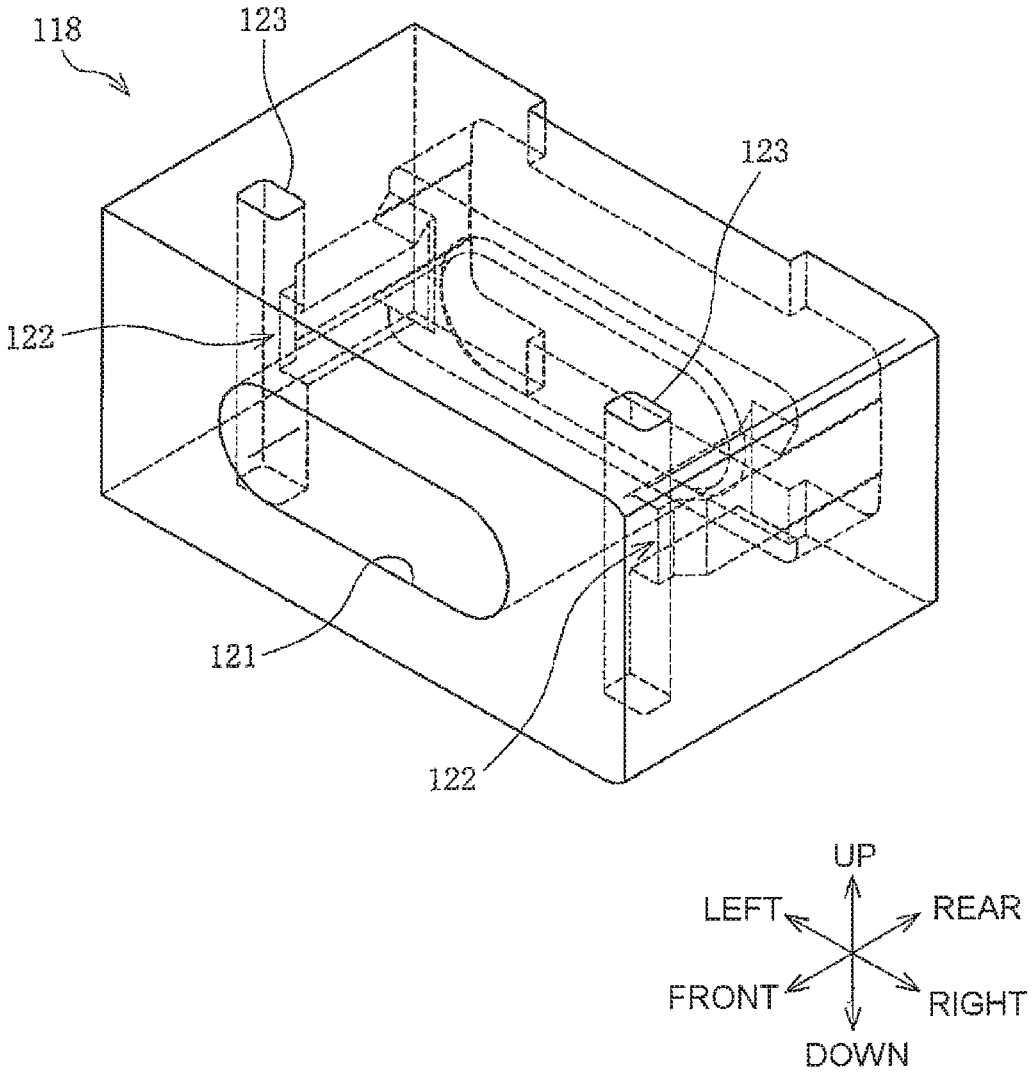
FIG. 9 is a perspective view of a retaining member of the first embodiment.

For example, as illustrated in FIG. 8 and FIG. 9, the hole portion 121 forms a cavity penetrating through the retaining member 118 in the front-and-rear direction. The hole portion 121 includes locked portions 122 and releasing hole portions 123. The locking lances 114 of the locking portions 104 are locked to the locked portions 122. The releasing hole portions 123 communicate with the locked portions 122 from an outside.

The hole portion 121 of the first embodiment is described with an example in which the cavity penetrating through the retaining member 118 in the front-and-rear direction is formed. However, it is only necessary that the cavity formed by the hole portion 121 allow the connector 100 to be arranged therein. For example, a rear end opening of the hole portion 121 may be closed with a cover which is integrally or separately provided, and the hole portion 121 does not need to penetrate through the retaining member 118. In this case, the cover may have small holes which enable the mounting portions 108 to pass therethrough.

As described above, the locking lances 114 protrude in the biasing directions of the main biasing portions 113. Therefore, when the connector 100 is arranged in the retaining member 118, the locking lances 114 are biased by a biasing force of the main biasing portions 113 and locked to the locked portions 122. With this action, the connector 100 becomes less liable to be removed from the retaining member 118.

Further, under the state in which the connector 100 is assembled to the retaining member 118, that is, under a state in which the shell 103 is arranged in the hole portion 121, each of the abutment portions 110, the main abutment portions 112, and the sub-abutment portions 116 is brought into abutment against the hole portion 121. In contrast, the connector 100 is not brought into abutment against the hole portion 121 at portions other than the abutment portions 110, the main abutment portions 112, and the sub-abutment portions 116.

The biasing portions 111 then bias the associated abutment portions 110 in the abutment directions. Further, the main biasing portion 113 biases the main abutment portion 112 formed on the same locking portion 104 in the abutment direction. Further, the sub-biasing portion 117 biases the sub-abutment portion 116 formed on the same locking portion 104 in the abutment direction.

The abutment directions of the abutment portions 110, the main abutment portions 112, and the sub-abutment portions 116 correspond to normal directions of tangential planes of the abutment portions 110, the main abutment portions 112, and the sub-abutment portions 116, respectively. When the abutment portions 110, the main abutment portions 112, and the sub-abutment portions 116 are biased in the abutment directions, the portions 110, 112, and 116 are pressed by respective biasing forces toward respective portions in contact therewith.

The tangential planes of the abutment portions 110 correspond to planes which are brought into contact with the abutment portions 110 at portions at which the abutment portions 110 are in contact with the retaining member 118.

The tangential planes of the abutment portions 110 are exemplified below. For example, when the abutment portions 110 are in point-contact with the retaining member 118, the tangential planes of the abutment portions 110 correspond to planes which are in contact with the abutment portions 110 at the contact points. For example, when the abutment portions 110 are in line-contact with the retaining member 118, the tangential planes of the abutment portions 110 correspond to planes including lines in contact with the retaining member 118 and being in contact with the abutment portions 110. For example, when the abutment portions 110 are in plane-contact with the retaining member 118, the tangential planes of the abutment portions 110 correspond to planes in contact with the retaining member 118.

The same holds true for the tangential planes of the main abutment portions 112 and the tangential planes of the sub-biasing portions 117.

That is, the tangential planes of the main abutment portions 112 correspond to planes which are in contact with the main abutment portions 112 at portions at which the main abutment portions 112 are in contact with the retaining member 118. The tangential planes of the sub-abutment portions 116 correspond to planes which are in contact with the sub-abutment portions 116 at portions at which the sub-abutment portions 116 are in contact with the retaining members 118.

As described above, when the shell 103 is arranged in the hole portion 121, there are interposed the abutment portions 110 with the biasing portions 111, the main abutment portions 112 with the main biasing portions 113, and the sub-abutment portions 116 with the sub-biasing portions 117 between the shell 103 and the hole portion 121. With this action, the abutment portions 110, the main abutment portions 112, and the sub-abutment portions 116 are biased in the abutment directions by the biasing portions 111, the main biasing portions 113, and the sub-biasing portions 117, respectively, to be brought into contact with the hole portion 121. As a result, the shell 103 is positioned with respect to the retaining member 118 at a predetermined reference position.

At the reference position, the shell 103 is not held in abutment against the hole portion 121 at portions excluding the abutment portions, and a gap is formed between the shell 103 and the hole portion 121. Therefore, when an external force is applied to the connector 100, the shell 103 can move in the hole portion 121 against the biasing forces of the biasing portions 111, the main biasing portions 113, and the sub-biasing portions 117.

With this action, the connector 100 assembled to the retaining member 118 constructs the floating connector. Accordingly, for example, when the connector 100 is fitted to a mating connector (not shown), the connector 100 can follow a position or inclination of the mating connector to move within a predetermined range determined by the hole portion 121.

When the mating connector is removed, the shell 103 is restored to the reference position by the biasing forces of the biasing portions 111, the main biasing portions 113, and the sub-biasing portions 117.

As described above, the connector 100 according to the first embodiment includes the plurality of abutment portions 110 and the plurality of biasing portions 111 configured to bias the plurality of abutment portions 110 outward. Further, as described above, the plurality of abutment portions 110 include the abutment portions 110 corresponding to the first abutment portion, the second abutment portion, and the third abutment portion.

The first abutment portions and the second abutment portions are formed in an opposite side over the main center line ML (or main plane), and hence are at different positions in the right-and-left direction across the main center line ML (or main plane). Therefore, when the connector 100 is fitted to the mating connector while being inclined in a direction of rotation about an axis extending in the front-and-rear direction (rolling), and thereafter the mating connector is removed, the first abutment portion and the second abutment portion are biased by the biasing portions. With this action, not only the shifting in the up-and-down direction but also the rolling at the time of fitting can be corrected.

Specifically, for example, it is assumed that the connector 100 is fitted to the mating connector while being inclined at the right end so as to be oriented downward about the axis extending in the front-and-rear direction, and thereafter the mating connector is removed. At this time, the abutment portion 110, which is one of the abutment portions 110 corresponding to the first abutment portion and the second abutment portion of the main outer surface portion 106_U and is located on the left side, and the abutment portion 110, which is one of the abutment portions 110 corresponding to the first abutment portion and the second abutment portion of the main outer surface portion 106_D and is located on the right side, are biased by the biasing portions. With this action, not only the shifting of the connector 100 in the up-and-down direction but also the rolling at the time of fitting can be corrected.

Further, for example, it is assumed that the connector 100 is fitted to the mating connector while being inclined at the left end so as to be oriented downward about the axis extending in the front-and-rear direction, and thereafter the mating connector is removed. At this time, the abutment portion 110, which is one of the abutment portions 110 corresponding to the first abutment portion and the second abutment portion of the main outer surface portion 106_U and is located on the right side, and the abutment portion 110, which is one of the abutment portions 110 corresponding to the first abutment portion and the second abutment portion of the main outer surface portion 106_D and is located on the left side, are biased by the biasing portions. With this action, not only the shifting of the connector 100 in the up-and-down direction but also the rolling at the time of fitting can be corrected.

Further, the third abutment portion is formed at the position forming a triangle with the first abutment portion and the second abutment portion. Thus, at least two of the first abutment portion, the second abutment portion, and the third abutment portion are at different positions in the front-and-rear direction. Therefore, when the connector 100 is fitted to the mating connector while being inclined in a direction of rotation about an axis extending in the right-and-left direction (pitching), and thereafter the mating connector is removed, the abutment portions of the first abutment portion, the second abutment portion, and the third abutment portion which are at different positions in the front-and-rear direction are biased by the biasing portions. With this action, not only the shifting of the connector 100 in the up-and-down direction but also the pitching at the time of fitting can be corrected.

Specifically, for example, it is assumed that the connector 100 is fitted to the mating connector while being inclined at the distal end, which is the front end in the first embodiment, so as to be oriented upward about the axis extending in the right-and-left direction, and thereafter the mating connector is removed. At this time, the abutment portion 110 located on the front side of the main outer surface portion 106_U and the abutment portion 110 located on the rear side of the main outer surface portion 106_D are biased by the biasing portions. With this action, not only the shifting of the connector 100 in the up-and-down direction but also the pitching at the time of fitting can be corrected.

Further, for example, it is assumed that the connector 100 is fitted to the mating connector while being inclined at the base end, which is the rear end in the first embodiment, so as to be oriented upward about the axis extending in the right-and-left direction, and thereafter the mating connector is removed. At this time, the abutment portion 110 located on the rear side of the main outer surface portion 106_U and the abutment portion 110 located on the front side of the main outer surface portion 106_D are biased by the biasing portions. With this action, not only the shifting of the connector 100 in the up-and-down direction but also the pitching at the time of fitting can be corrected.

As described above, the connector 100 includes the abutment portions 110 corresponding to the first abutment portion, the second abutment portion, and the third abutment portion. With this configuration, there can be constructed the floating connector in which the rolling and pitching being inclination at the time of fitting are less liable to remain after removal of the mating connector which is fitted while being inclined.

As described above, the plurality of abutment portions 110 of the connector 100 according to the first embodiment include the abutment portion 110 corresponding to the fourth abutment portion.

The fourth abutment portion is formed in an opposite side over the main center line ML with respect to the third abutment portion. Therefore, the third abutment portion and the fourth abutment portion are biased by the biasing portions similarly to the first abutment portion and the second abutment portion described above, thereby being capable of further correcting the rolling at the time of fitting.

Further, similarly to the third abutment portion, the fourth abutment portion is formed at the position forming a triangle with the first abutment portion and the second abutment portion. Thus, three or more abutment portions of the first abutment portion, the second abutment portion, the third abutment portion, and the fourth abutment portion are not at the same positions in the front-and-rear direction. Therefore, when the connector 100 is fitted to the mating connector while being inclined in the direction of rotation about an axis extending in the right-and-left direction (pitching), and thereafter the mating connector is removed, the abutment portions of the first abutment portion, the second abutment portion, the third abutment portion, and the fourth abutment portion which are at different positions in the front-and-rear direction are biased by the biasing portions. With this action, the pitching of the connector 100 at the time of fitting can be corrected.

As described above, the connector 100 includes the abutment portions 110 corresponding to the first abutment portion, the second abutment portion, the third abutment portion, and the fourth abutment portion. With this configuration, there can be constructed the floating connector in which the rolling and pitching being inclination at the time of fitting are even less liable to remain after removal of the mating connector which is fitted while being inclined.

In particular, when the third abutment portion and the fourth abutment portion are at the same positions in the front-and-rear direction, a set of the first and second abutment portions and a set of the third and fourth abutment portions are at different positions in the front-and-rear direction. In this case, when the connector 100 is fitted to the mating connector while being inclined in the direction of rotation about the axis extending in the right-and-left direction (pitching), and thereafter the mating connector is removed, the plurality of abutment portions which are at different positions in the front-and-rear direction are biased by the biasing portions. With this action, the pitching at the time of fitting can be corrected more reliably. Thus, there can be constructed the floating connector in which the rolling and pitching being inclination at the time of fitting are even less liable to remain after removal of the mating connector which is fitted while being inclined.

In the first embodiment, the plurality of abutment portions 110 and the plurality of biasing portions 111 are formed on both of the main outer surface portions 106. However, the plurality of abutment portions 110, which include the first to third abutment portions, and the plurality of biasing portions 111 may be formed on only one of the main outer surface portions 106. Also with this configuration, in the same manner as described above, there can be constructed the floating connector in which the rolling and pitching being inclination at the time of fitting are less liable to remain after removal of the mating connector which is fitted while being inclined.

Further, the plurality of abutment portions 110, which include the first to fourth abutment portions, and the plurality of biasing portions 111 may be formed on only one of the main outer surface portions 106. Also with this configuration, in the same manner as described above, there can be constructed the floating connector in which the rolling and pitching being inclination at the time of fitting are even less liable to remain after removal of the mating connector which is fitted while being inclined.

Further, when the plurality of abutment portions 110 and the plurality of biasing portions 111 are formed only on one of the main outer surface portions 106, the hole portion 121 may be provided with the structure for biasing the shell 103 so as to be restored to the reference position after removal of the mating connector which is fitted while being inclined. In this case, the structure for biasing the shell 103 so as to be restored to the reference position may be provided at a position opposed in the up-and-down direction to the plurality of abutment portions 110 and the plurality of biasing portions 111 formed on another main outer surface portion 106 in the first embodiment. Also with this configuration, similarly to the case where the plurality of abutment portions 110 and the plurality of biasing portions 111 are formed on both of the main outer surface portions 106, there can be constructed the floating connector in which the rolling and pitching being the inclination at the time of fitting are less liable to remain.

In the first embodiment, when the connector 100 is arranged in the hole portion 121, both the abutment portions 110_L1 and 110_R1 are brought into abutment against the vicinity of the rear end portion of the hole portion 121. In other words, both the abutment portions 110_L1 and 110_R1 are formed at positions at which, when the connector 100 is arranged in the hole portion 121, the abutment portions 110_L1 and 110_R1 are brought into abutment against the vicinity of the rear end portion which is the end portion of the hole portion 121 close to the base end of the connector 100. Herein, the vicinity of the rear end portion of the hole portion 121 corresponds to a position which is located between the rear end of the hole portion 121 and a portion separated forward from the rear end by a predetermined distance.

With such abutment portions 110_L1 and 110_R1, the distance between each of the abutment portion 110_L1 and the abutment portion 110_R1 and each of other abutment portions 110_L2, 110_L3, 110_R2, and 110_R3 can be set as long as possible. With this configuration, when the connector 100 is fitted to the mating connector while being inclined in the direction of rotation about the axis extending in the right-and-left direction (pitching), and thereafter the mating connector is removed, the abutment portion of the first to fourth abutment portions which is at a significantly different position in the front-and-rear direction is biased by the biasing portion. With this action, the pitching of the connector 100 at the time of fitting can be corrected more reliably. Therefore, there can be constructed the floating connector in which the inclination at the time of fitting is even less liable to remain after removal of the mating connector which is fitted while being inclined.

The connector 100 according to the first embodiment further includes the plurality of locking portions 104 which extend in the front-and-rear direction at sides of the shell 103. Each of the locking portions 104 includes the main abutment portion 112 corresponding to another abutment portion, the main biasing portion 113 corresponding to another biasing portion, and the locking lance 114.

Each of the main abutment portions 112 is biased in the abutment direction by the main biasing portion 113 formed on the same locking portion 104.

Accordingly, for example, when the connector 100 is fitted to the mating connector while being shifted leftward, the main abutment portion 112 of the locking portion 104_L is biased leftward. After removal of the mating connector, the connector 100 receives a reaction force from the hole portion 121, thereby being capable of correcting the leftward shifting at the time of fitting.

Further, for example, when the connector 100 is fitted to the mating connector while being shifted rightward, the main abutment portion 112 of the locking portion 104_R is biased rightward. After removal of the mating connector, the connector 100 receives a reaction force from the hole portion 121, thereby being capable of correcting the rightward shifting at the time of fitting.

As described above, the connector 100 includes the main abutment portion 112 and the main biasing portion 113 on each of sides of the shell 103. With this configuration, there can be constructed the floating connector in which the shifting in the right-and-left direction is less liable to remain after removal of the mating connector which is fitted while being shifted in the right-and-left direction. Further, the locking lances 114 are locked to the locked portions 122. With this action, the connector 100 can be less liable to be removed from the retaining member 118.

In the first embodiment, one locking portion 104 is formed on each of the sides of the shell 103. However, a plurality of locking portions 104 may be formed on one or both of the sides of the shell 103. In this case, it is preferred that the plurality of locking portions 104 be aligned in the up-and-down direction so as to be arranged in an opposite side over a center plane. The center plane passes through a sub-center line SL of center lines of one or both of the side surface portions 109, which is parallel to the front-and-rear direction, and is parallel to the main outer surface portion 106. The center plane is an imaginary plane.

According to this configuration, when the connector 100 is fitted to the mating connector while being inclined in the direction of rotation about the axis extending in the front-and-rear direction (rolling), and thereafter the mating connector is removed, one of the main abutment portions 112 aligned in the up-and-down direction is biased by each of the main biasing portions 113. With this action, not only the shifting in the right-and-left direction but also the rolling at the time of fitting can be corrected. Therefore, there can be constructed the floating connector in which the rolling being inclination at the time of fitting is even less liable to remain after removal of the mating connector which is fitted while being inclined.

In the first embodiment, each of the locking portions 104 further includes the connection portion 115, the sub-abutment portion 116, and the sub-biasing portion 117.

The sub-abutment portions 116 of the locking portions 104_L and 104_R are biased by the sub-biasing portions 117 formed on the same locking portions 104_L and 104_R. Therefore, similarly to the main abutment portions 112 and the main biasing portions 113 described above, the shifting in the right-and-left direction at the time of fitting can be corrected.

Further, the main abutment portion 112 and the sub-abutment portion 116 which are at different positions in the front-and-rear direction in each of the locking portions 104_L and 104_R are biased by the main biasing portion 113 and the sub-biasing portion 117, respectively, in the same direction. Specifically, in the locking portion 104_L of the first embodiment, the main abutment portion 112 and the sub-abutment portion 116 are biased leftward by the main biasing portion 113 and the sub-biasing portion 117. In the locking portion 104_R of the first embodiment, the main abutment portion 112 and the sub-abutment portion 116 are biased rightward by the main biasing portion 113 and the sub-biasing portion 117.

Therefore, when the connector 100 is fitted to the mating connector while being inclined in the direction of rotation about an axis extending in the up-and-down direction (yawing), and thereafter the mating connector is removed, the main abutment portion 112 and the sub-abutment portion 116 of each of the locking portions 104_L and 104_R are biased, thereby being capable of correcting the yawing at the time of fitting.

Specifically, for example, it is assumed that the connector 100 is fitted to the mating connector while being inclined so that the distal end is oriented rightward about an axis extending in the up-and-down direction, and thereafter the mating connector is removed. At this time, the sub-abutment portion 116 of the locking portion 104_L is biased leftward, and the main abutment portion 112 of the locking portion 104_R is biased rightward. The connector 100 receives a reaction force against the biasing force from the hole portion 121, thereby being capable of correcting the yawing of the connector 100 at the time of fitting.

Further, for example, it is assumed that the connector 100 is fitted to the mating connector while being inclined so that the distal end is oriented leftward about the axis extending in the up-and-down direction, and thereafter the mating connector is removed. At this time, the sub-abutment portion 116 of the locking portion 104_R is biased rightward, and the main abutment portion 112 of the locking portion 104_L is biased leftward. The connector 100 receives a reaction force against the biasing force from the hole portion 121, thereby being capable of correcting the yawing of the connector 100 at the time of fitting.

As described above, the connector 100 includes the sub-abutment portion 116 and the sub-biasing portion 117 in each of the sides of the shell 103 in addition to the main abutment portion 112 and the main biasing portion 113. With this configuration, there can be constructed the floating connector in which the shifting in the right-and-left direction is even less liable to remain after removal of the mating connector which is fitted while being shifted in the right-and-left direction. Further, there can be constructed the floating connector in which the yawing being inclination at the time of fitting are less liable to remain after removal of the mating connector which is fitted while being inclined.

In the first embodiment, each of the locking portions 104_L and 104_R further includes the connection portion 115, the sub-abutment portion 116, and the sub-biasing portion 117. However, this invention is not limited to this configuration, and only any one of the locking portions 104_L and 104_R may further include the connection portion 115, the sub-abutment portion 116, and the sub-biasing portion 117. Also with this configuration, the rightward or leftward shifting and the yawing of the connector 100 at the time of fitting can be corrected. Therefore, there can be constructed the floating connector in which the rightward or leftward shifting is even less liable to remain. Further, there can be constructed the floating connector in which the yawing being the inclination at the time of fitting is less liable to remain after removal of the mating connector which is fitted while being inclined.

<<Method of Assembly>>

As described above, the connector 100 according to the first embodiment is typically used as the floating connector in which the connector 100 is assembled to the retaining member 118. A board, a cable, or the like being the mounted object is mounted to the floating connector in many cases.

Now, an example of the case where the board 120 is employed as the mounted object is given to describe a method of assembly of the floating connector mounted to the board 120 (see FIG. 8).

The shell 103, the housing 102, and the contacts 101 fixed to the contact fixing member 124 are prepared (see FIG. 2).

The shell 103, the housing 102, and the contacts 101 fixed to the contact fixing member 124 are aligned in the front-and-rear direction as illustrated in FIG. 2. Then, for example, the contacts 101 fixed to the contact fixing member 124 are assembled to the housing 102, and the resultant assembly is assembled to the shell 103. In this manner, the connector 100 is manufactured.

The plurality of abutment portions 110 and the plurality of biasing portions 111 of the first embodiment are formed integrally with the shell 103. Therefore, there is no need to mount the abutment portions 110 and the biasing portions 111 separately, thereby being capable of suppressing increase in the number of components and facilitating the assembly of the connector 100.

Further, the plurality of locking portions 104 of the first embodiment are formed integrally with the housing 102. Therefore, there is no need to mount the locking portions 104 separately, thereby being capable of suppressing increase in the number of components and facilitating the assembly of the connector 100.

Figure 10:
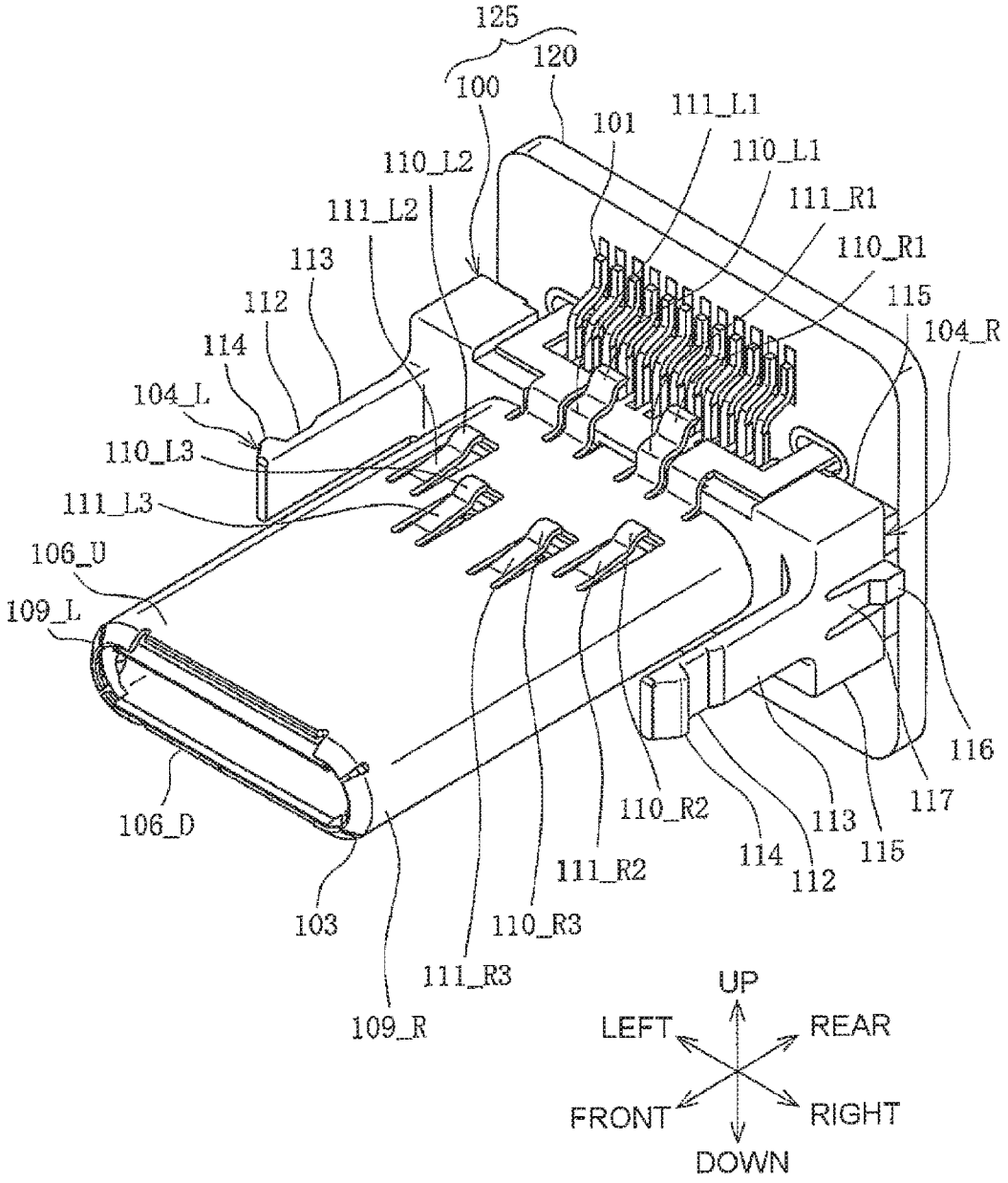
FIG. 10 is a perspective view of a mounted connector in which the connector according to the first embodiment is mounted to a board.

As illustrated in FIG. 10, the connector 100 is mounted to the board 120. Specifically, the mounting portions 108 are fixed by welding or the like to a circuit or the like (not shown) provided to the board 120. In this manner, a board connector 125 including the connector 100 mounted to the board 120 is manufactured.

Figure 11:
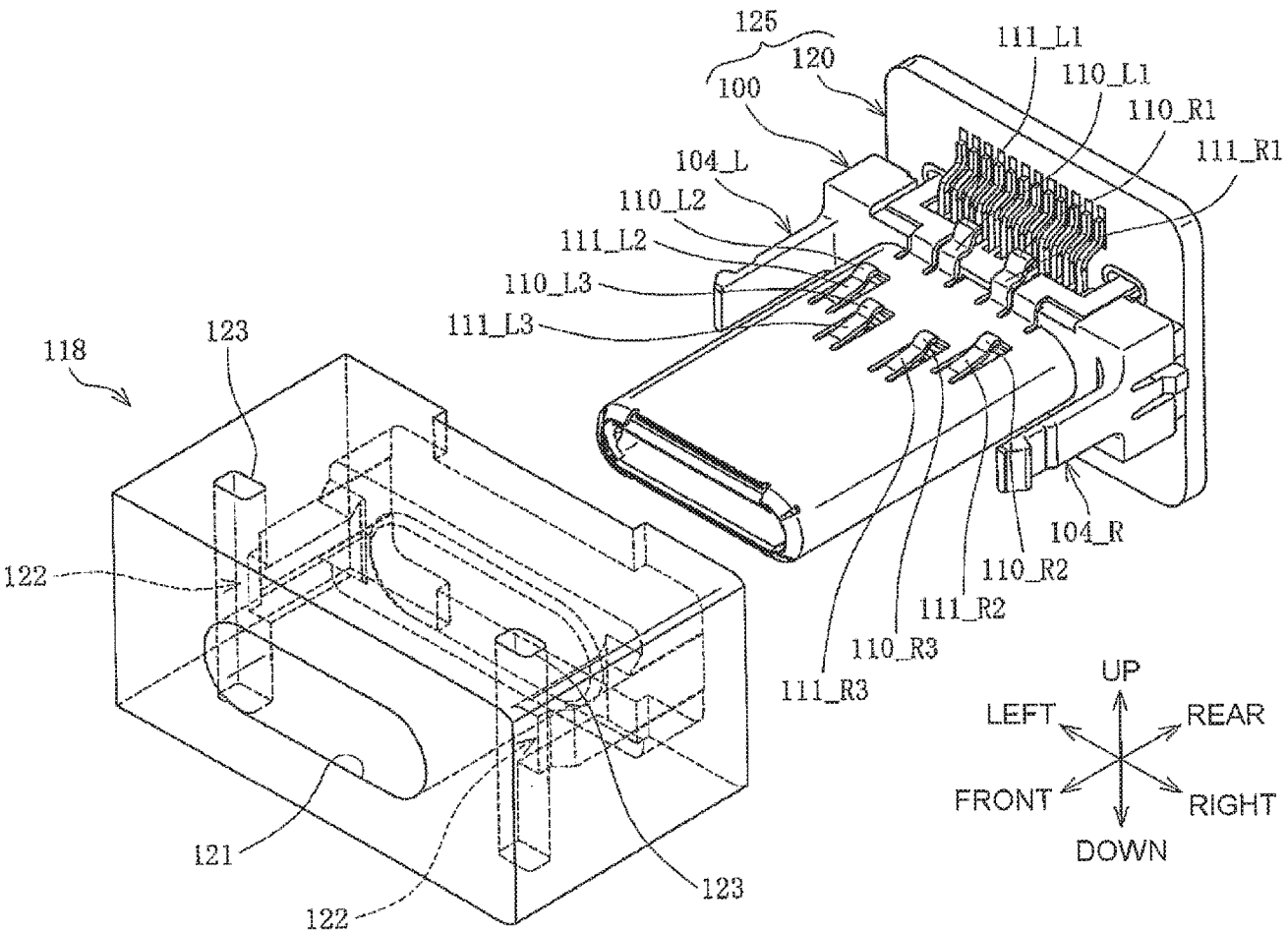
FIG. 11 is a view for illustrating a state immediately before assembling the mounted connector to the retaining member of the first embodiment.

As illustrated in FIG. 11, the board connector 125 is positioned behind the hole portion 121 of the retaining member 118. After that, the board connector 125 is moved forward. As a result, the locking lances 114 are locked to the locked portions 122, and the shell 103 is arranged in the hole portion 121. In this manner, as illustrated in FIG. 8, the board connector 125 is assembled to the retaining member 118, with the result that the floating connector 119 including the board 120 mounted thereto is manufactured.

Each of the biasing portions 111 of the first embodiment has the one end fixed to the main outer surface portion 106 and extends along the front-and-rear direction. Each of the abutment portions 110 is formed between the one end and the another end of the biasing portion 111. With this configuration, each of the sets including the biasing portion 111 and the abutment portion 110 extends in a moving direction of the connector 100 at the time of fitting to the retaining member 118 and at the time of being removed from the retaining member 118. Therefore, when the connector 100 is assembled to the retaining member 118 or removed from the retaining member 118, each of the sets including the biasing portion 111 and the abutment portion 110 becomes less liable to be caught in the hole portion 121. Therefore, the operation of assembling the connector 100 to the retaining member 118 or removing the connector 100 from the retaining member 118 can be facilitated.

In particular, each of the biasing portions 111 has a fixed front end and extends toward the rear end from the front end. With this configuration, the possibility of causing the front end of each of the biasing portions 111 to be caught in the hole portion 121 at the time of inserting the connector 100 to the hole portion 121 can be reduced. Therefore, the operation of assembling the connector 100 to the retaining member 118 can further be facilitated.

Further, the hole portion 121 of the first embodiment includes the releasing hole portions 123 which communicate with the locked portions 122 from an outside. Jigs are inserted to the releasing hole portions 123 to move the locking lances 114 against the biasing force of the main biasing portions 113, thereby being capable of releasing the locking of the locking lances 114. The connector 100 is moved rearward under the state in which the locking of the locking lances 114 is released, thereby being capable of removing the connector 100 from the retaining member 118.

With the releasing hole portions 123 included as described above, the connector 100 according to the first embodiment can be removably assembled to the retaining member 118. The configuration for removably assembling the connector 100 to the retaining member 118 is not limited to the configuration described above. For example, a magnet, a screw, or the like may be employed.

The first embodiment of this invention is described above. However, the first embodiment may be modified as described below.

Modification Example 1

In the first embodiment, description is made of the example in which six sets each including the abutment portion 110 and the biasing portion 111 are formed so as to be symmetrical about the main center line ML or the main plane on each of the main outer surface portions 106. However, the positions at which the abutment portions 110 and the biasing portions 111 are formed are not limited to the positions described above.

Figure 12:
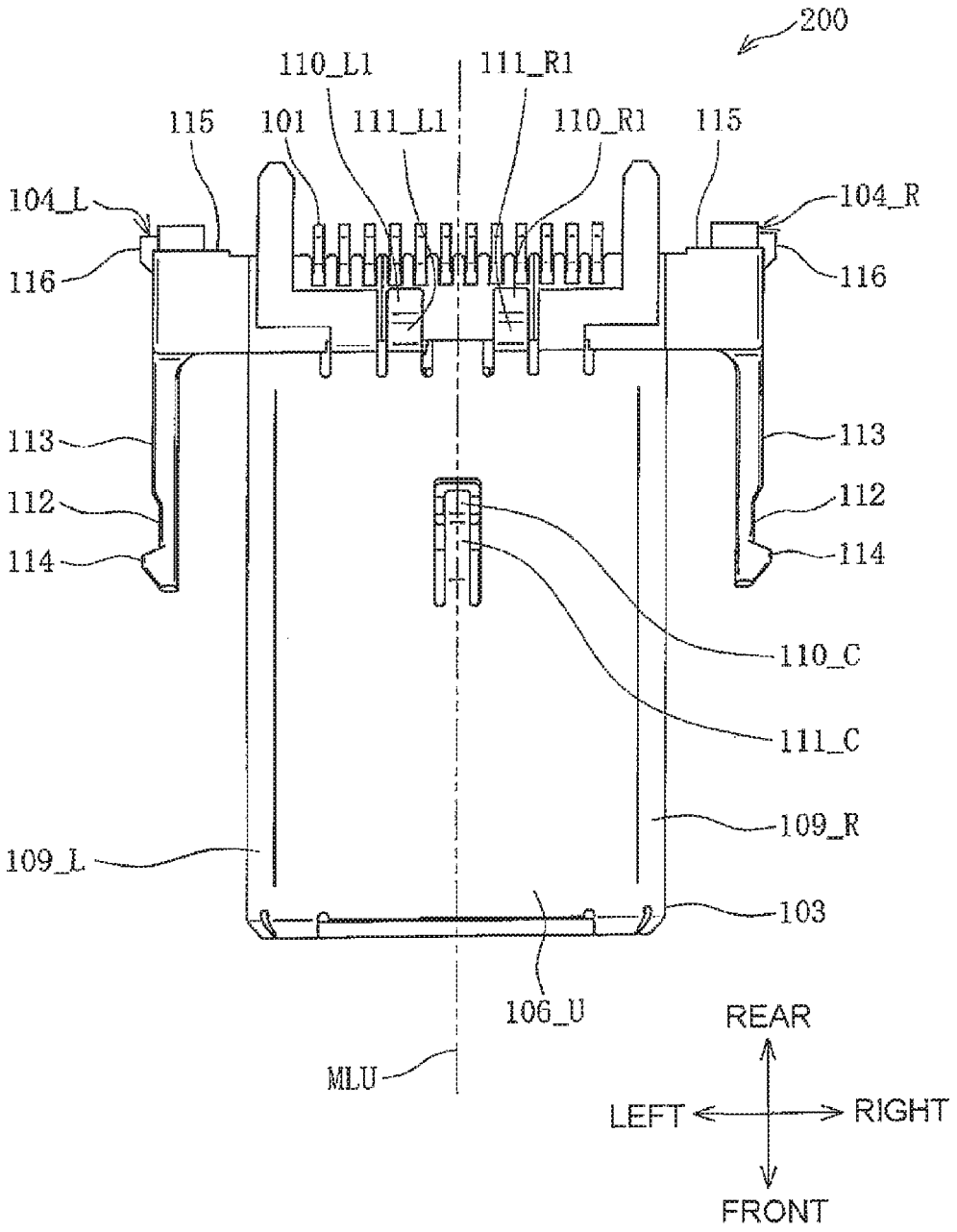
FIG. 12 is a plan view of a connector according to one modification example.

For example, as illustrated in FIG. 12, a connector 200 according to Modification Example 1 includes three sets each including the abutment portion 110 and the biasing portion 111 on the main outer surface portion 106_U. Specifically, in addition to the abutment portions 110_L1 and 110_R1 and the biasing portions 111_L1 and 111_R1 configured to bias the abutment portions 110_L1 and 110_R1 upward, which are similar to those of the first embodiment, the connector 200 includes an abutment portion 110_C and a biasing portion 111_C configured to bias the abutment portion 110_C upward. The abutment portion 110_C and the biasing portion 111_C are formed on the main center line ML. The configuration of the abutment portion 110_C and the biasing portion 111_C excluding the positions on the main outer surface portion 106_U are similar to those of other abutment portions 110 and biasing portions 111 described in the first embodiment.

The abutment portions 110 and the biasing portions 111 may be suitably formed on or omitted from the main outer surface portion 106_D. With regard to other configurations, the connector 200 has the configuration in common with the connector 100 according to the first embodiment.

In Modification Example 1, the plurality of abutment portions 110 include the abutment portion 110_L1 and the abutment portion 110_R1 as the abutment portions corresponding to the first abutment portion and the second abutment portion, and include the abutment portion 110_C as the abutment portion corresponding to the third abutment portion. Therefore, also with Modification Example 1, as described in the first embodiment, there can be constructed the floating connector in which the inclination at the time of fitting is less liable to remain after removal of the mating connector which is fitted while being inclined.

Modification Example 2

In Modification Example 1, description is made of the example in which the plurality of abutment portions 110 include the abutment portions 110_L1 and 110_R1, which are similar to those of the first embodiment, as the abutment portions corresponding to the first abutment portion and the second abutment portion. However, the abutment portions 110 corresponding to the first abutment portion and the second abutment portion may be formed at different positions in the front-and-rear direction unlike the abutment portions 110_L1 and 110_R1 as long as the abutment portions 110 are formed in an opposite side over the main center line ML or the main plane.

Further, the abutment portion 110 corresponding to the third abutment portion may be formed at a position deviated from the main center line ML unlike the abutment portion 110_C. Further, the plurality of abutment portions 110 may include the abutment portion 110 corresponding to the fourth abutment portion, and may also include any other additional abutment portion 110.

It is only necessary that the plurality of biasing portions 111 be configured to bias the abutment portions 110 outward.

Also with Modification Example 2, as described in the first embodiment and Modification Example 1, there can be constructed the floating connector in which the inclination at the time of fitting is less liable to remain after removal of the mating connector which is fitted while being inclined.

Second Embodiment

Figure 13:
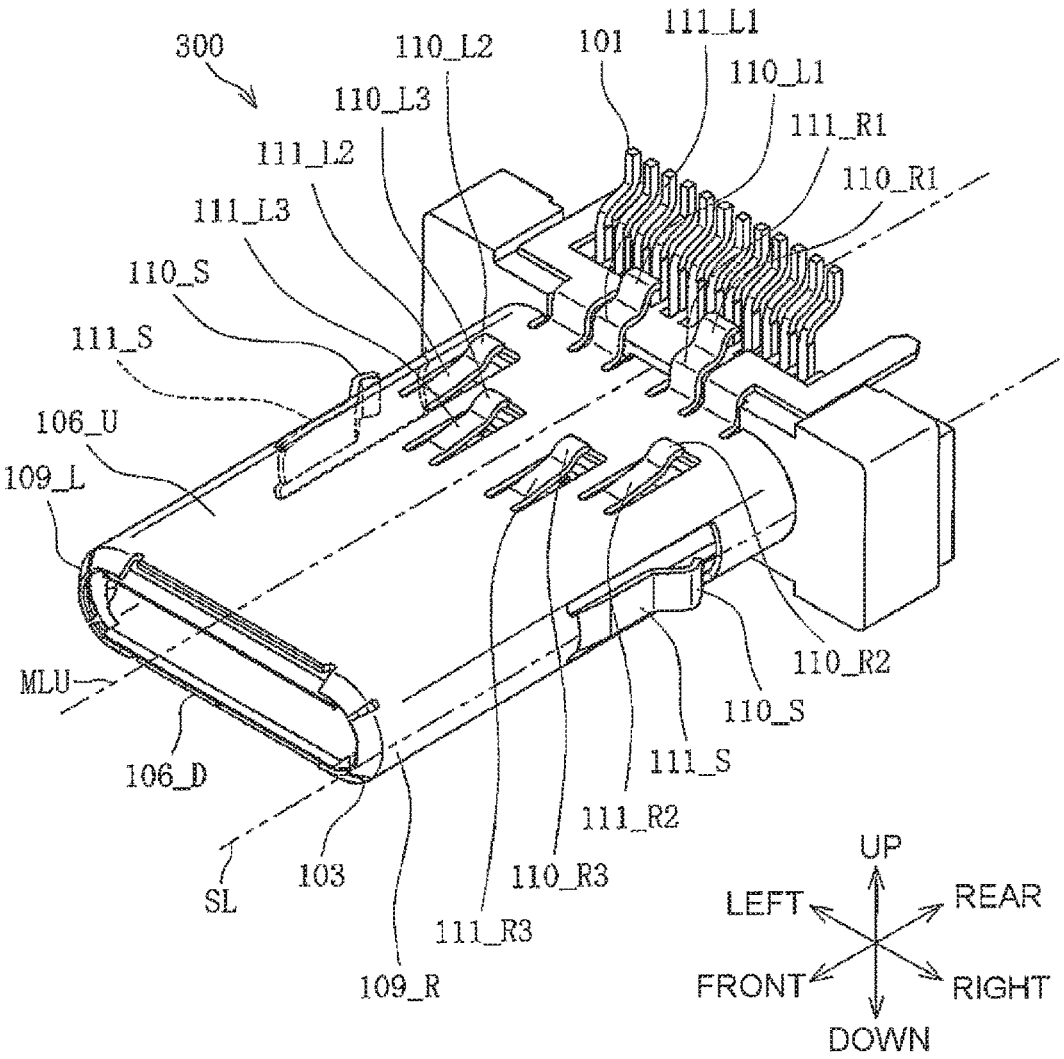
FIG. 13 is a perspective view of a connector according to a second embodiment of this invention.

As illustrated in FIG. 13, a connector 300 according to a second embodiment of this invention does not include the locking portions 104, but includes an abutment portion 110_S and a biasing portion 111_S on each of the left side surface portion 109_L and the right side surface portion 109_R. Other than this point, the connector 300 has the same configuration as that of the connector 100 according to the first embodiment.

When the connector 300 is assembled to a retaining member (318) described later, the abutment portion 110_S of the right side surface portion 109_R is brought into abutment against the retaining member (318).

The biasing portion 111_S of the right side surface portion 109_R is associated with the abutment portion 110_S of the right side surface portion 109_R and biases the associated abutment portion 110_S of the right side surface portion 109_R outward, that is, rightward. The biasing portion 111_S is a small piece which extends in the front-and-rear direction in a cantilevered state with one end being a fixed end fixed to the right side surface portion 109_R and another end being a free end. The associated abutment portion 110_S is formed between the one end and the another end of the biasing portion 111_S. In the second embodiment, the abutment portion 110_S is formed in the vicinity of the another end, that is, at a position closer to the another end than the one end.

Specifically, the biasing portion 111_S of the right side surface portion 109_R of the second embodiment is formed by forming a U-shaped cutout portion in the right side surface portion 109_R of the shell 103 so that the front end becomes the fixed end, and is inclined so as to protrude rightward as extending rearward from the fixed end. The abutment portion 110_S of the right side surface portion 109_R is formed so as to protrude rightward while being curved along the front-and-rear direction in the vicinity of the rear end of the biasing portion 111_S, which is a portion located between the rear end and a position separated forward from the rear end by a predetermined distance. As described above, the abutment portion 110_S and the biasing portion 111_S of the right side surface portion 109_R are formed integrally with the shell 103.

The abutment portion 110_S and the biasing portion 111_S of the left side surface portion 109_L are arranged in right-left symmetry with the abutment portion 110_S and the biasing portion 111_S of the right side surface portion 109_R. Other than this point, the abutment portion 110_S and the biasing portion 111_S of the left side surface portion 109_L have the same configuration as those of the abutment portion 110_S and the biasing portion 111_S of the right side surface portion 109_R. For simple and clear description, description of the detailed configuration of the abutment portion 110_S and the biasing portion 111_S of the left side surface portion 109_L is omitted.

In the following, in the second embodiment, simple description of "abutment portion 110" includes the abutment portion 110_S. Further, simple description of "biasing portion 111" includes the biasing portion 111_S.

Figure 14:
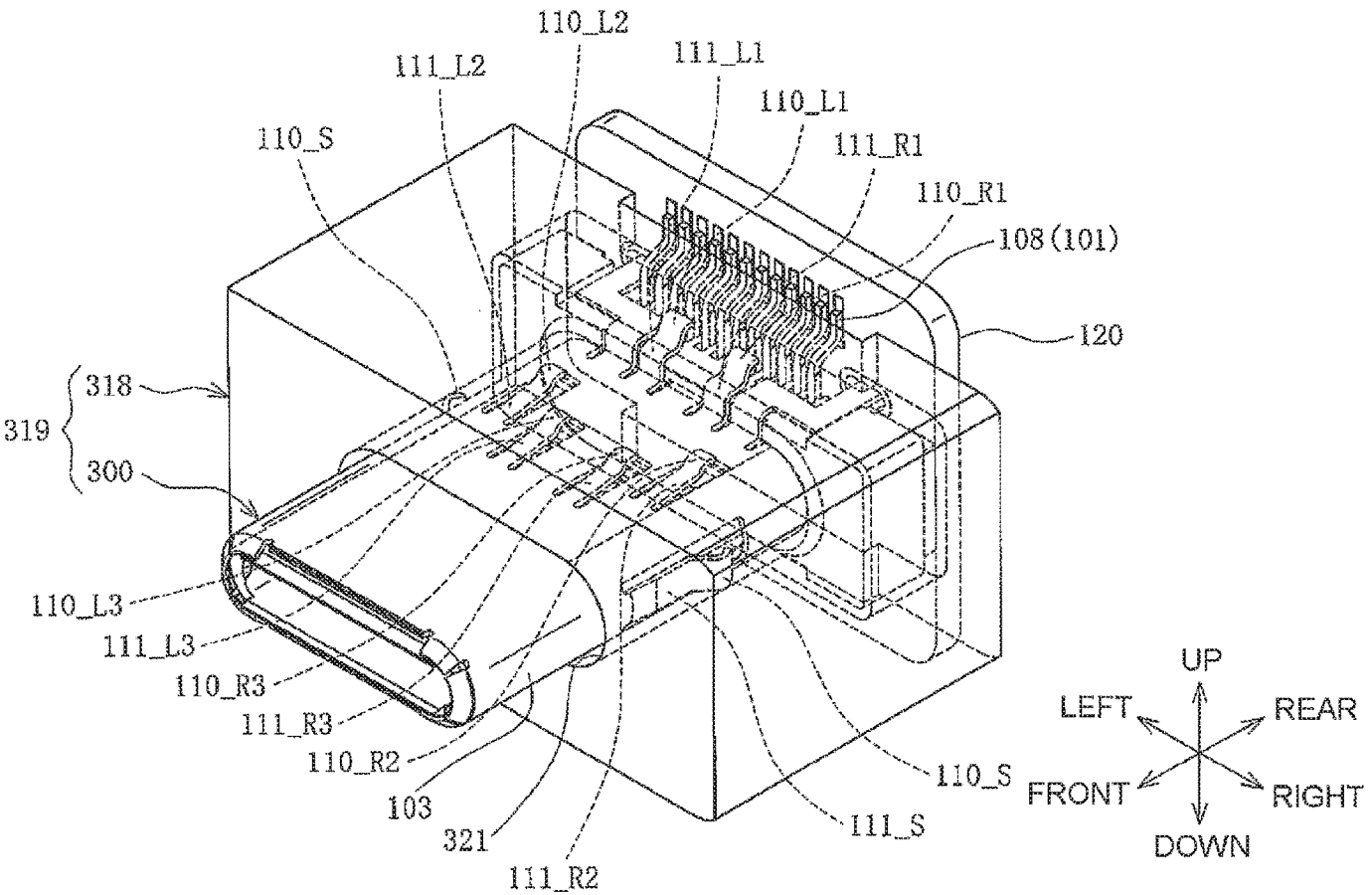
FIG. 14 is a view for illustrating an example of a state of use of the connector according to the second embodiment.

As exemplified in FIG. 14, during use of the connector 300, the connector 300 is arranged in the retaining member 318 to construct a floating connector 319. FIG. 14 is an illustration of an example in which the board 120 being the mounted object is mounted to the floating connector 319.

The floating connector 319 includes the retaining member 318 and the connector 300. The retaining member 318 has a hole portion 321. The connector 300 is arranged in the hole portion 321. The hole portion 321 forms a hole which penetrates through the retaining member 318 in the front-and-rear direction.

Under the state in which the connector 300 is assembled to the retaining member 318, that is, under the state in which the connector 300 is arranged in the hole portion 321, each of the abutment portions 110 is brought into abutment against the hole portion 121. Meanwhile, the connector 300 is not brought into abutment against the hole portion 321 at portions excluding the abutment portions 110.

The biasing portions 111 bias the associated abutment portions 110 in the respective abutment directions.

As described above, when the shell 103 is arranged in the hole portion 321, the abutment portions 110 and the biasing portions 111 are interposed between the shell 103 and the hole portion 321. With this action, the abutment portions 110 are biased by the biasing portions 111 in the abutment directions to be brought into abutment against the hole portion 321. As a result, the shell 103 is positioned at a reference position with respect to the retaining member 318.

At the reference position, the shell 103 is not held in abutment against the hole portion 321 at portions excluding the abutment portions 110, and a gap is formed between the shell 103 and the hole portion 321. Therefore, when an external force is applied to the connector 300, the shell 103 can move in the hole portion 321 against the biasing forces of the biasing portions 111.

With this action, the connector 300 assembled to the retaining member 318 constructs the floating connector. Accordingly, for example, when the connector 300 is fitted to a mating connector (not shown), the connector 300 can follow a position or inclination of the mating connector to move within a predetermined range determined by the hole portion 321.

When the mating connector is removed, the shell 103 is restored to the reference position by the biasing forces of the biasing portions 111.

The procedure of mounting the connector 300 to the board 120 and arranging the connector 300 in the retaining member 318 may be the same as the procedure of the method of assembly described in the first embodiment. For simple and clear description, detailed description of the method of assembly in the second embodiment is omitted.

Also with the second embodiment, the effect similar to that of the first embodiment can be achieved.

In the second embodiment, description is made of the example in which one abutment portion 110_S and one biasing portion 111_S are formed on each of the side surface portions 109. However, a plurality of abutment portions 110_S and a plurality of biasing portions 111_S may be formed on one side surface portion 109 or each of both side surface portions 109. Various arrangement may be applied to the arrangement of the plurality of abutment portions 110_S and the plurality of biasing portions 111_S as described above with regard to the main outer surface portion 106.

In this case, the plurality of abutment portions 110_S and the plurality of biasing portions 111_S achieve the actions and effects which are similar to those of the abutment portions 110 and the biasing portions 111 of the main outer surface portion 106 described above. Therefore, there can be constructed the floating connector in which the rolling and pitching being inclination at the time of fitting are even less liable to remain after removal of the mating connector which is fitted while being inclined.

Third Embodiment

Figure 15:
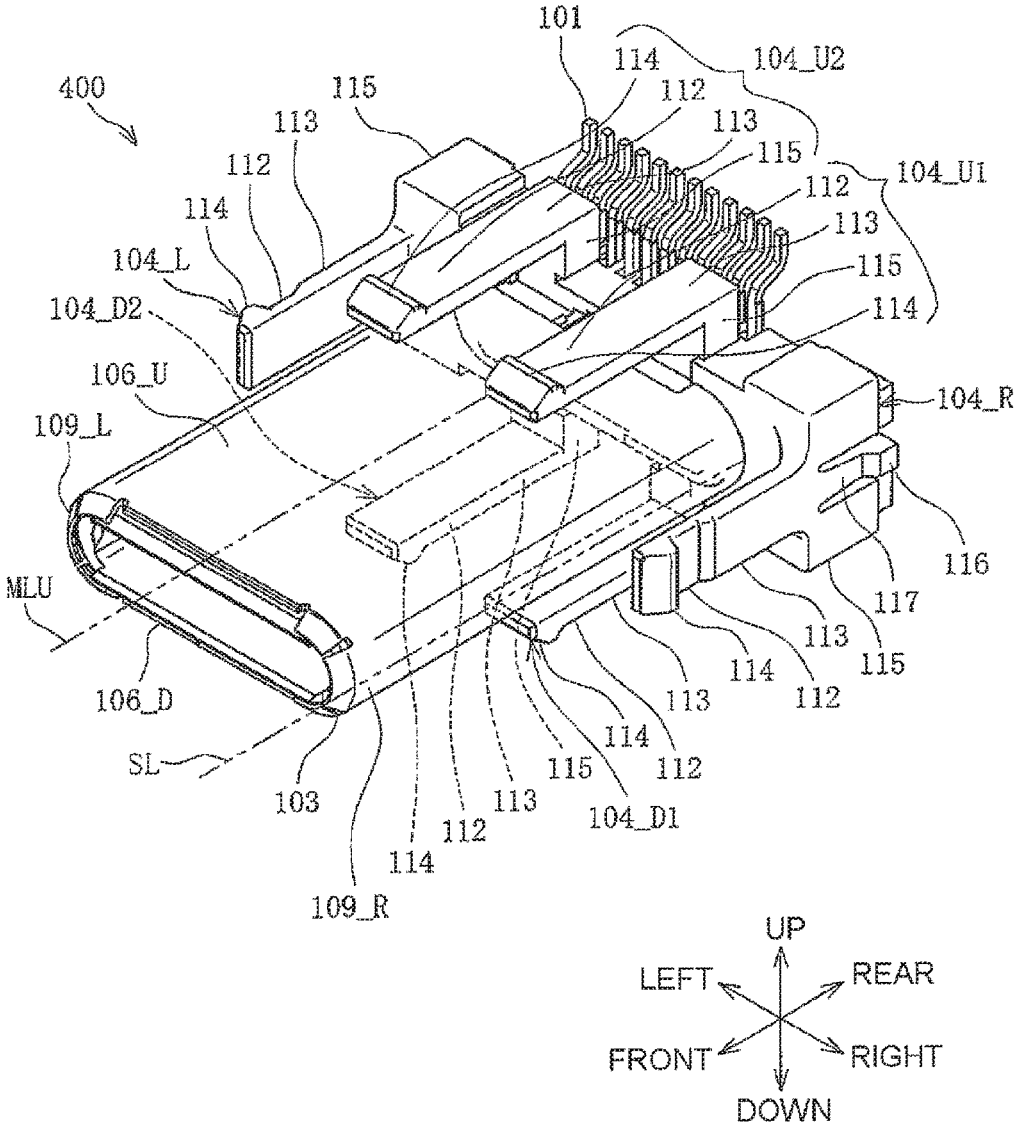
FIG. 15 is a perspective view of a connector according to a third embodiment of this invention.

As illustrated in FIG. 15, a connector 400 according to a third embodiment of this invention does not include the plurality of abutment portions 110 and the plurality of biasing portions 111, but includes a plurality of locking portions 104_U1, 104_U2, 104_D1, and 104_D2 on each of the upper side and the lower side. Other than this point, the connector 400 has the same configuration as that of the connector 100 according to the first embodiment.

Each of the locking portions 104_U1 and 104_U2 includes the main abutment portion 112, the main biasing portion 113, the locking lance 114, and the connection portion 115. In the third embodiment, each of the locking portions 104_U1 and 104_U2 is, for example, integrally made of resin, and is formed integrally with the housing 102.

That is, the locking portions 104_U1 and 104_U2 are different from the locking portions 104 of the first embodiment in that each of the locking portions 104_U1 and 104_U2 does not have the sub-abutment portion 116 and the sub-biasing portion 117 and is oriented in a different direction. Specifically, the locking portions 104_U1 and 104_U2 have the same configuration as that of the locking portion 104_R of the first embodiment rotated in a counterclockwise direction by 90 degrees as viewed from a front side excluding the sub-abutment portion 116 and the sub-biasing portion 117.

Each of the locking portions 104_D1 and 104_D2 includes the main abutment portion 112, the main biasing portion 113, the locking lance 114, and the connection portion 115. In the third embodiment, similarly to the locking portions 104_U1 and 104_U2, the locking portions 104_D1 and 104_D2 are, for example, integrally made of resin, and are formed integrally with the housing 102.

That is, the locking portions 104_D1 and 104_D2 are different from the locking portions 104 of the first embodiment in that each of the locking portions 104_D1 and 104_D2 does not include the sub-abutment portion 116 and the sub-biasing portion 117 and is oriented in a different direction. Specifically, each of the locking portions 104_D1 and 104_D2 has the same configuration as that of the locking portion 104_R of the first embodiment rotated in a clockwise direction by 90 degrees as viewed from a front side excluding the sub-abutment portion 116 and the sub-biasing portion 117.

Figure 16:
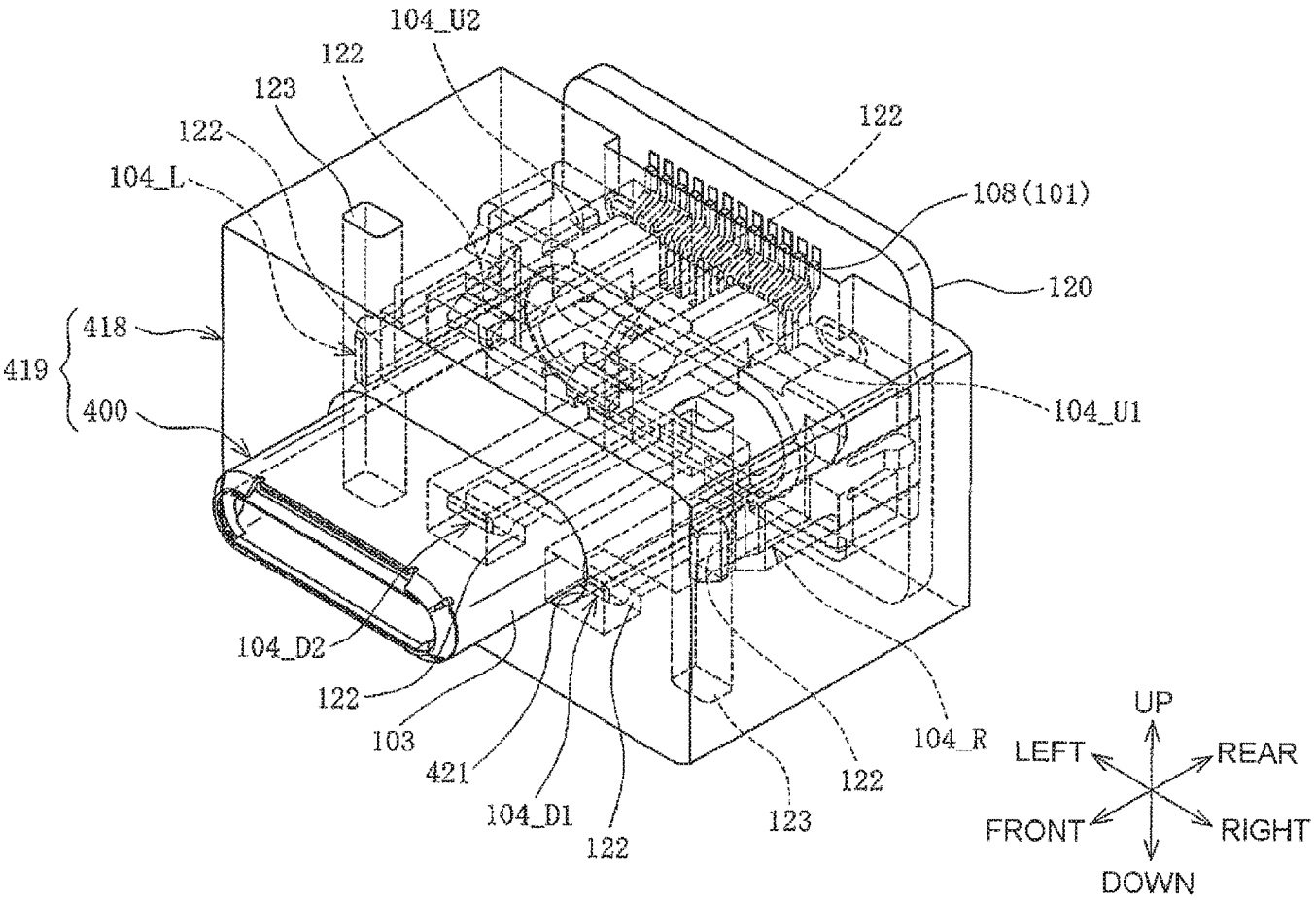
FIG. 16 is a view for illustrating an example of a state of use of the connector according to the third embodiment.

As exemplified in FIG. 16, during use of the connector 400, the connector 400 is arranged in a retaining member 418 to construct a floating connector 419. FIG. 16 is an illustration of an example in which the board 120 being the mounted object is mounted to the floating connector 419.

The floating connector 419 includes the retaining member 418 and the connector 400. The retaining member 418 has a hole portion 421. The connector 400 is arranged in the hole portion 421.

The hole portion 421 forms a hole which penetrates through the retaining member 418 in the front-and-rear direction, and includes the locked portions 122 and the releasing hole portions 123. The locking lances 144 of the locking portions 104_R, 104_L, 104_U1, 104_U2, 104_D1, and 104_D2 are locked to the locked portions 122 of the third embodiment. The releasing hole portions 123 communicate, from an outside, with the locked portions 122 to which the locking portions 104_R and 104_L are locked.

When the connector 400 is arranged in the retaining member 418, as described in the first embodiment, the locking lances 114 are biased by the biasing forces of the main biasing portions 113 to be locked to the locked portions 122. With this action, the connector 400 becomes less liable to be removed from the retaining member 418.

Further, under the state in which the connector 400 is assembled to the retaining member 418, that is, under the state in which the shell 103 is arranged in the hole portion 421, each of the main abutment portions 112 and the sub-abutment portions 116 is brought into abutment against the hole portion 421. Meanwhile, the shell 103 is not brought into abutment against the hole portion 421 at portions excluding the main abutment portions 112 and the sub-abutment portions 116.

The main biasing portions 113 bias the main abutment portions 112, which are formed on the same locking portions 104, in the abutment directions. Further, the sub-biasing portions 117 bias the sub-abutment portions 116, which are formed on the same locking portions 104, in the abutment directions.

As described above, when the shell 103 is arranged in the hole portion 421, the main abutment portions 112, the main biasing portions 113, the sub-abutment portions 116, and the sub-biasing portions 117 are interposed between the shell 103 and the hole portion 421. With this action, the main abutment portions 112 and the sub-abutment portions 116 are biased by the main biasing portions 113 and the sub-biasing portions 117 in the abutment directions to be brought into abutment against the hole portion 421. As a result, the shell 103 is positioned at a predetermined reference position with respect to the retaining member 418.

At the reference position, the shell 103 is not held in abutment against the hole portion 421 at portions excluding the main abutment portions 112 and the sub-abutment portions 116, and a gap is formed between the shell 103 and the hole portion 421. Therefore, when an external force is applied, the shell 103 can move in the hole portion 421 against the biasing forces of the main biasing portions 113 and the sub-biasing portions 117.

With this action, the connector 400 assembled to the retaining member 418 constructs the floating connector. Accordingly, for example, when the connector 400 is fitted to a mating connector (not shown), the connector 400 can follow a position or inclination of the mating connector to move within a predetermined range determined by the hole portion 421.

When the mating connector is removed, the shell 103 is restored to the reference position by the biasing forces of the main biasing portions 113 and the sub-biasing portions 117.

The procedure of mounting the connector 400 to the board 120 and arranging the connector 400 in the retaining member 418 may be the same as the procedure of the method of assembly described in the first embodiment. For simple and clear description, detailed description of the method of assembly in the third embodiment is omitted.

The connector 400 according to the third embodiment includes the locking portions 104_L and 104_R. Therefore, as described in the first embodiment, there can be constructed the floating connector in which the shifting in the right-and-left direction is less liable to remain after removal of the mating connector which is fitted while being shifted in the right-and-left direction. Further, there can be constructed the floating connector in which the yawing being inclination at the time of fitting is less liable to remain after removal of the mating connector which is fitted while being inclined.

Each of the plurality of locking portions 104_U1, 104_U2, 104_D1, and 104_D2 of the third embodiment may have substantially the same configuration as that of each of the locking portions 104_L and 104_R of the first embodiment. That is, in this case, the locking portions 104_U1 and 104_U2 may have the configuration of the locking portion 104_R rotated in the counterclockwise direction by 90 degrees as viewed from the front side. Further, the locking portions 104_D1 and 104_D2 may have the configuration of the locking portion 104_R rotated in the clockwise direction by 90 degrees as viewed from the front side.

With this configuration, the main abutment portion 112 and the main biasing portion 113 of each of the locking portions 104_U1 and 104_U2 function as the abutment portions 110_R3 and 110_L3 and the biasing portions 111_R3 and 111_L3 of the main outer surface portion 106_U of the first embodiment. The sub-abutment portion and the sub-biasing portion of each of the locking portions 104_U1 and 104_U2 function as the abutment portions 110_R1 and 110_L1 and the biasing portions 111_R1 and 111_L1 of the main outer surface portion 106_U of the first embodiment. Further, the main abutment portion 112 and the main biasing portion 113 of each of the locking portions 104_D1 and 104_D2 function as the abutment portions 110_R3 and 110_L3 and the biasing portions 111_R3 and 111_L3 of the main outer surface portion 106_D of the first embodiment. The sub-abutment portion and the sub-biasing portion of each of the locking portions 104_D1 and 104_D2 function as the abutment portions 110_R1 and L1 and the biasing portions 111_R1 and 111_L1 of the main outer surface portion 106_D of the first embodiment. Thus, the effect which is similar to that of the first embodiment is achieved.

Fourth Embodiment

In a fourth embodiment of this invention, description is made of an example in which, during use of the connector 100 which is the same as that of the first embodiment, the connector 100 is assembled to the retaining member and fitted as a composite connector to the mating connector.

Figure 17:
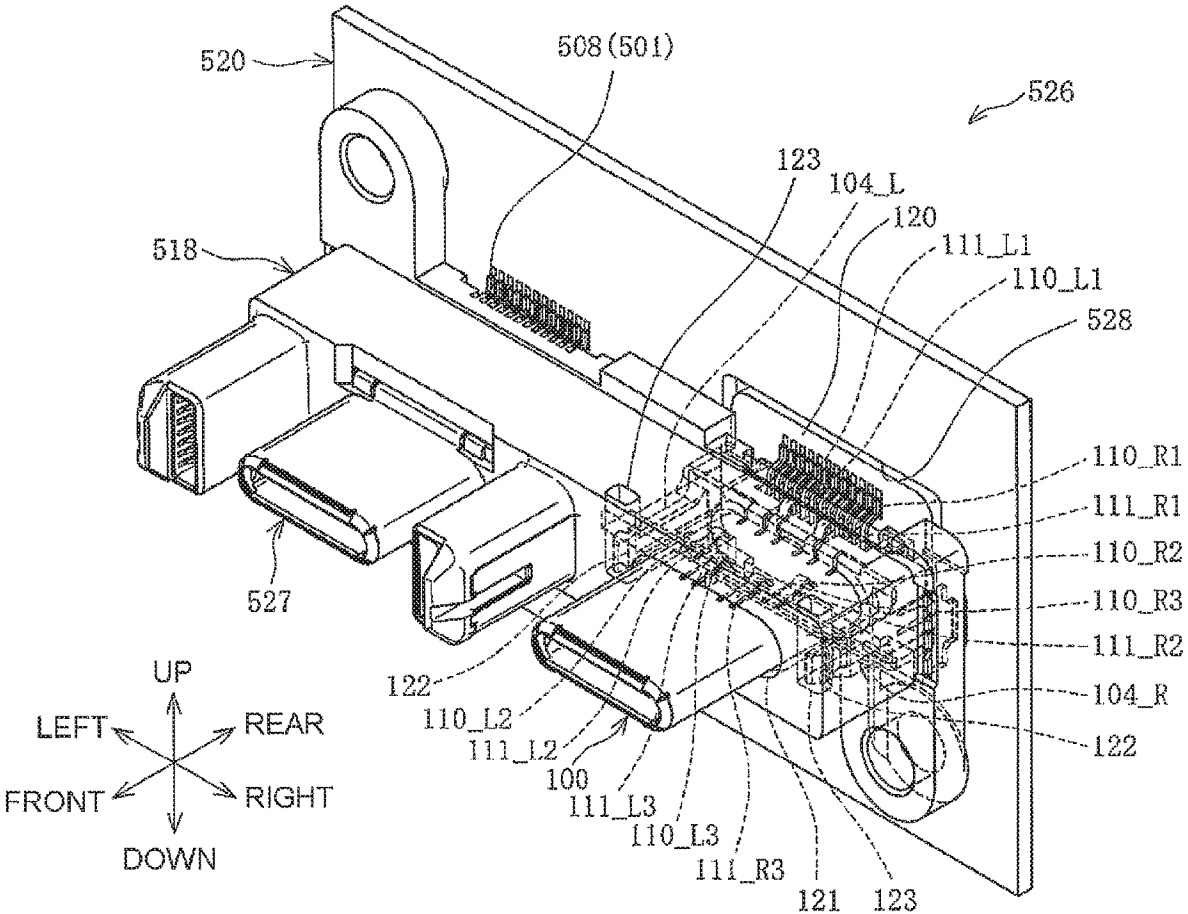
FIG. 17 is a view for illustrating an example of a state of use of a composite connector according to a fourth embodiment of this invention.

As illustrated in FIG. 17 which is a perspective view, a composite connector 526 according to the fourth embodiment includes a fixed connector 527, a retaining member 518 having the hole portion 121 which is the same as that of the first embodiment, and the connector 100 which is the same as that of the first embodiment.

The fixed connector 527 includes a plurality of contacts 501. Each of the plurality of contacts 501 includes a mounting portion 508 exposed to an outside.

The fixed connector 527 is fixed to the retaining member 518, and the connector 100 is arranged in the hole portion 121. The connector 100 arranged in the hole portion 121 constructs the floating connector similarly to the first embodiment.

FIG. 17 is an illustration of an example in which boards 120 and 520 being mounted objects are mounted to the composite connector 526. The connector 100 is mounted to the board 120, and the fixed connector 527 is mounted to the board 520. The board 520 has a board hole portion 528 in which the board 120 is arranged.

With the example in which the boards 120 and 520 are employed as the mounted objects, description is made of a method of assembly of the composite connector 526 (see FIG. 17) mounted to the boards 120 and 520.

Figure 18:
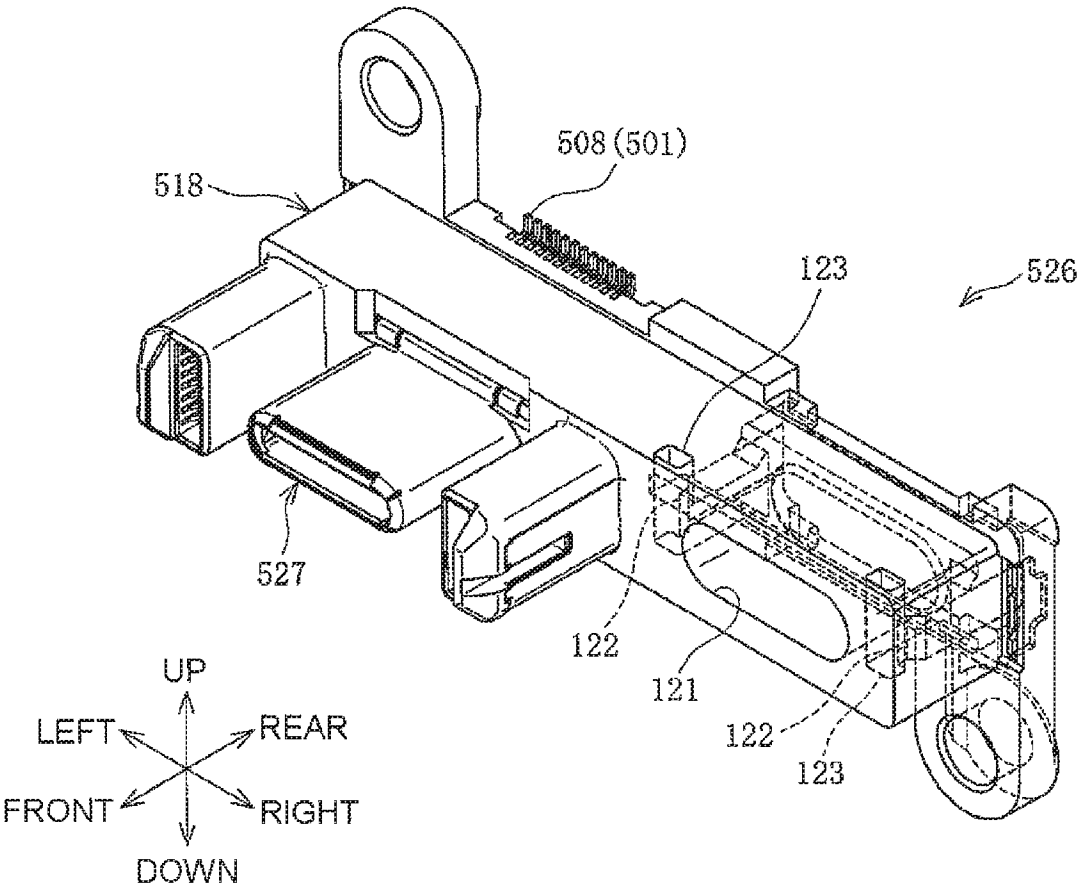
FIG. 18 is a perspective view of a retaining member of the fourth embodiment.
Figure 19:
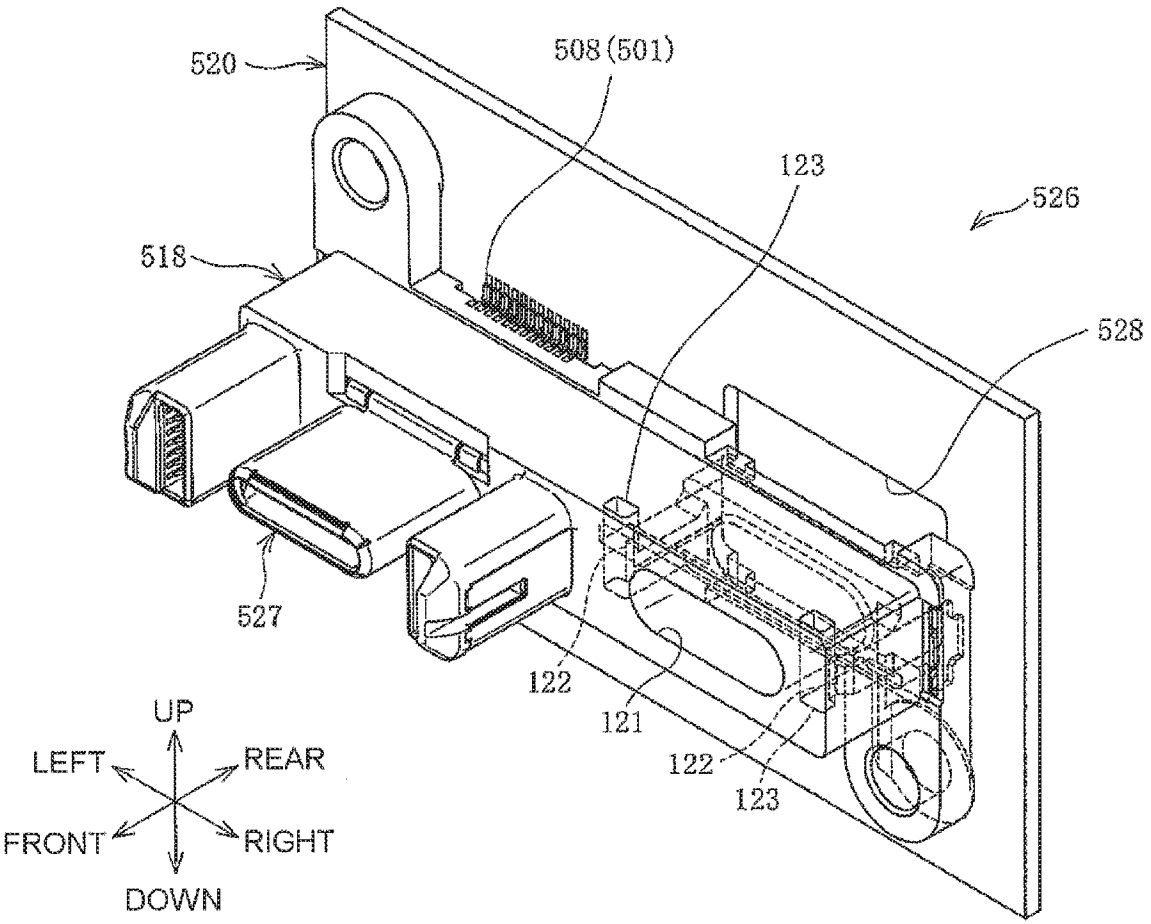
FIG. 19 is a perspective view of a mounted retaining member in which a fixed connector fixed to the retaining member of the fourth embodiment is mounted to the board.

As illustrated in FIG. 18, the retaining member 518 to which the fixed connector 527 is fixed is prepared.

The fixed connector 527 of the prepared retaining member 518 is mounted to the board 520. Specifically, the mounting portions 508 of the fixed connector 527 are fixed by welding or the like to a circuit or the like (not shown) provided to the board 520. In this manner, the retaining member 518 to which the board 520 and the fixed connector 527 are fixed is manufactured.

The connector 100 is manufactured by the same procedure as that of the first embodiment. The connector 100 is mounted to the board 120 (see FIG. 10). In this manner, the board connector 125 including the connector 100 mounted to the board 120 is manufactured.

Figure 20:
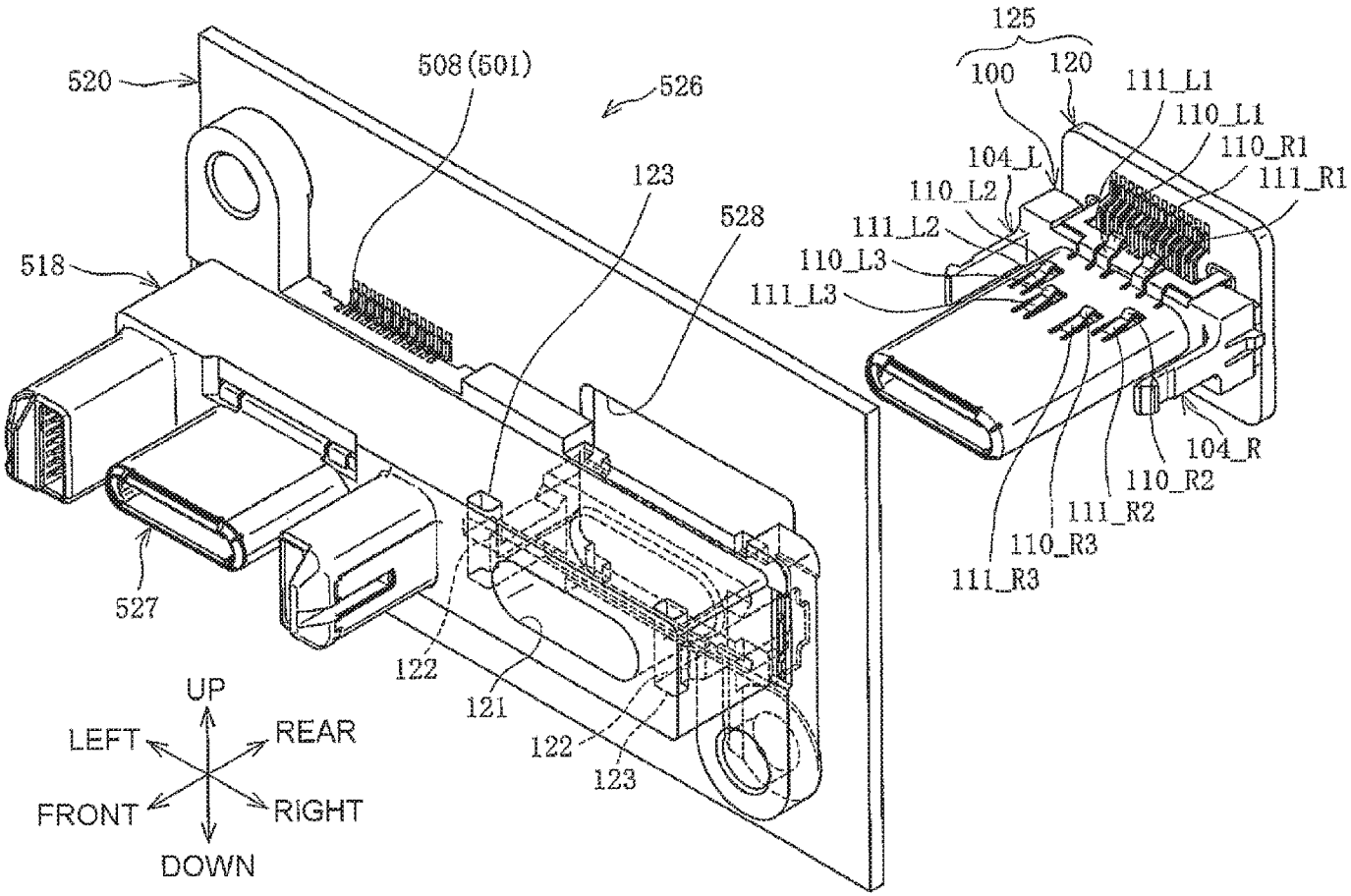
FIG. 20 is a view for illustrating a state immediately before the mounted connector is assembled to the mounted retaining member of the fourth embodiment.

As illustrated in FIG. 20, the board connector 125 is positioned behind the hole portion 121 of the retaining member 518. After that, the board connector 125 is moved forward so that the board connector 125 is arranged in the hole portion 121 through the board hole portion 528. At this time, the locking lances 114 are locked to the locked portions 122. In this manner, as illustrated in FIG. 17, the board connector 125 is assembled to the retaining member 518 to which the board 520 and the fixed connector 527 are fixed. In this manner, the composite connector 526 to which the boards 120 and 520 are mounted is manufactured.

The composite connector 526 according to the fourth embodiment includes the floating connector, which is constructed by the connector 100 arranged in the hole portion 121, and the fixed connector 527. With this configuration, when the mating connector is the composite connector, the mating connector can be positioned with reference to the position of the fixed connector 527. Therefore, the composite connector 526 and the mating connector can easily be fitted to each other.

The retaining member 518 of the fourth embodiment includes the hole portion 121 which is the same as that of the first embodiment, and the connector 100 which is the same as that of the first embodiment is arranged in the hole portion 121. Therefore, as described in the first embodiment, the connector 100 can be removed from the retaining member 518 through use of the releasing hole portions 123 included in the hole portion 121. That is, the connector 100 has the configuration of being removably mounted also in the fourth embodiment.

In general, different mounted objects such as the boards 120 and 520 are mounted to the different connectors 100 and 527 in some cases, and only the mounted object (120) of the connector 100 is changed in some cases. In such cases, the mounted object (120) can easily be changed together with the connector 100 because the connector 100 is removably mounted to the retaining member 518 in the fourth embodiment.

Further, when the composite connector 526 and the mating connector are fitted to each other, both of the connectors may be brought into abutment against each other, with the result that the connector 100 may be damaged. In such cases, the connector 100 can easily be replaced because the connector 100 is removably mounted to the retaining member 518 in the fourth embodiment.

Therefore, according to the fourth embodiment, maintenance for the composite connector 526 and the mounted object can be facilitated because the connector 100 is removably mounted to the retaining member 518.

Fifth Embodiment

In the first embodiment, description is made of the example in which the abutment portions 110 and the biasing portions 111 are formed integrally with the shell 103 of the connector 100. However, the abutment portions 110 and the biasing portions 111 are not required to be formed integrally with the shell 103. In a fifth embodiment of this invention, description is made of an example in which the abutment portions and the biasing portions are provided separately from the shell.

Similarly to the connector 100 according to the first embodiment, a connector 600 according to the fifth embodiment is assembled to a retaining member (618) so as to be fitted as a floating connector (619) to the mating connector. The retaining member 618 and the floating connector 619 are illustrated, for example, in FIG. 28 to FIG. 31, and details thereof are described later.

<<Configuration>>

Figure 21:
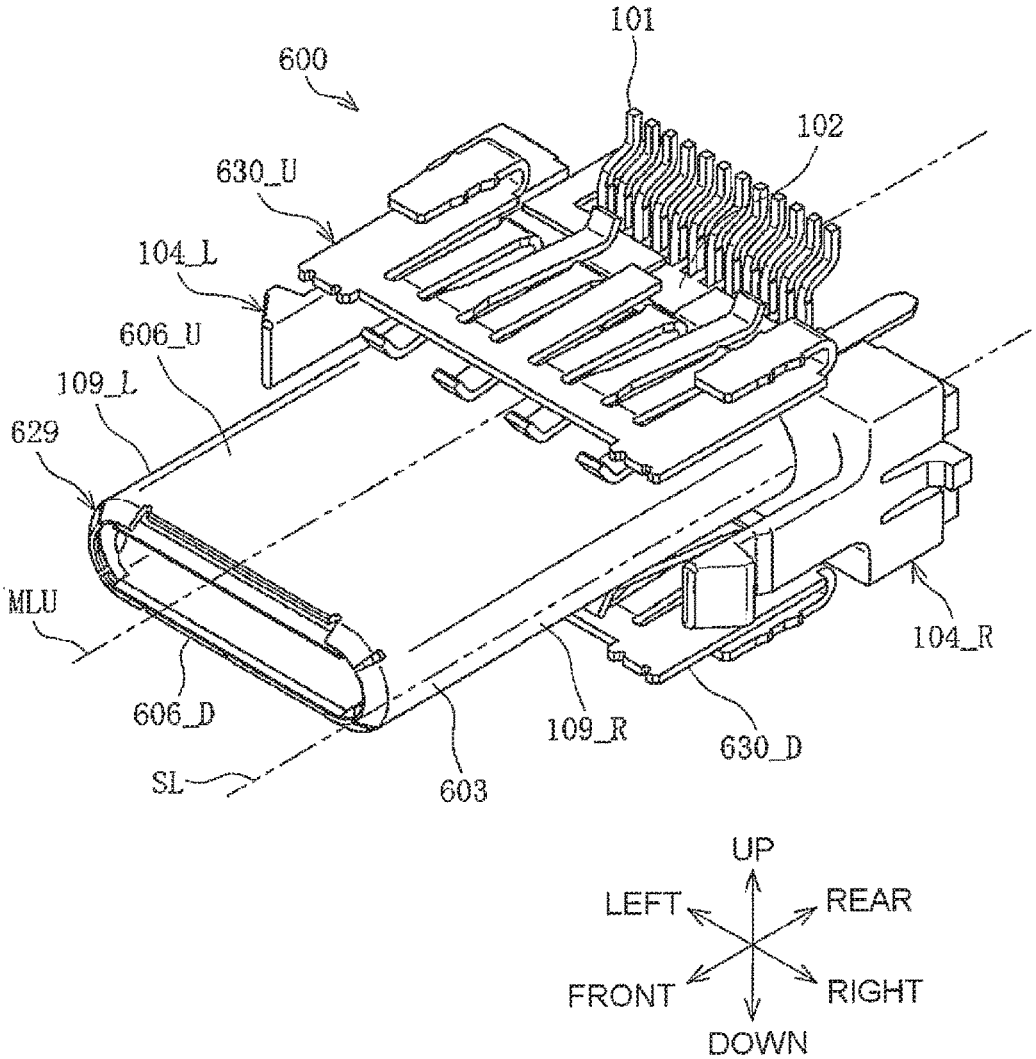
FIG. 21 is a perspective view of a connector according to a fifth embodiment of this invention.
Figure 22:
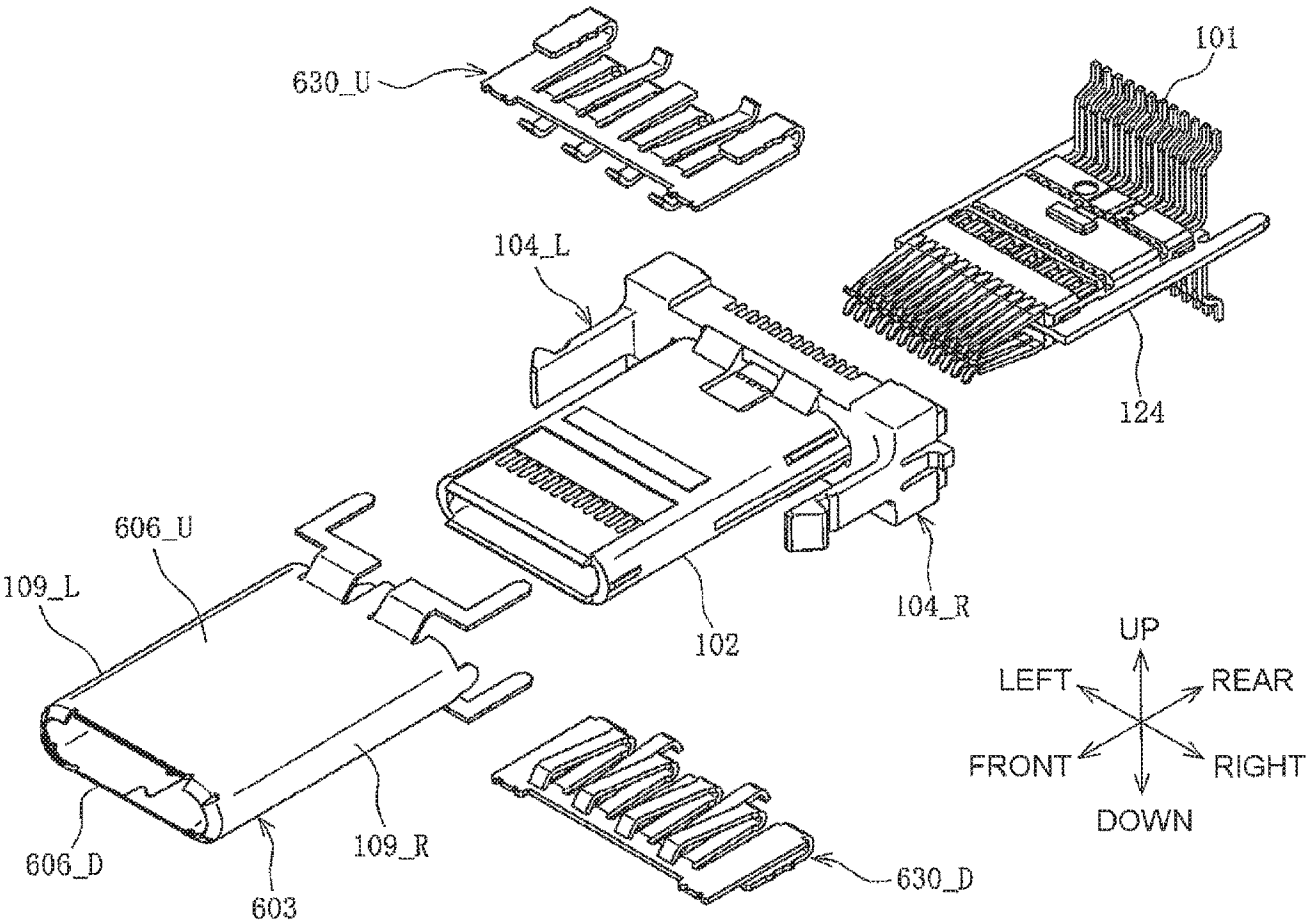
FIG. 22 is an exploded perspective view of the connector according to the fifth embodiment.

As illustrated in FIG. 21 being a perspective view and in FIG. 22 being an exploded perspective view, the connector 600 includes a main body portion 629 and a pair of spring members 630_U and 630_D. The pair of spring members 630_U and 630_D are arranged on an upper side and a lower side of the main body portion 629, respectively.

Figure 23:
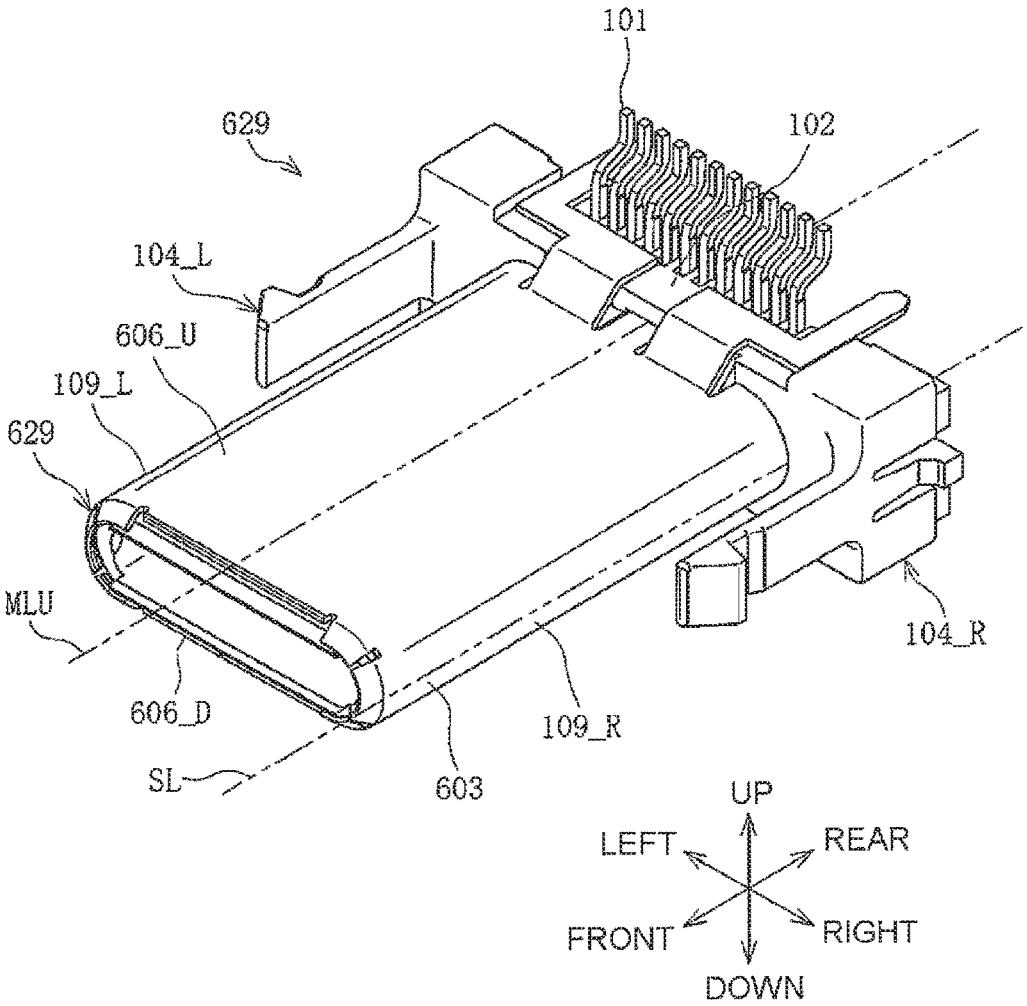
FIG. 23 is an exploded perspective view of a main body portion of the fifth embodiment.
Figure 24:
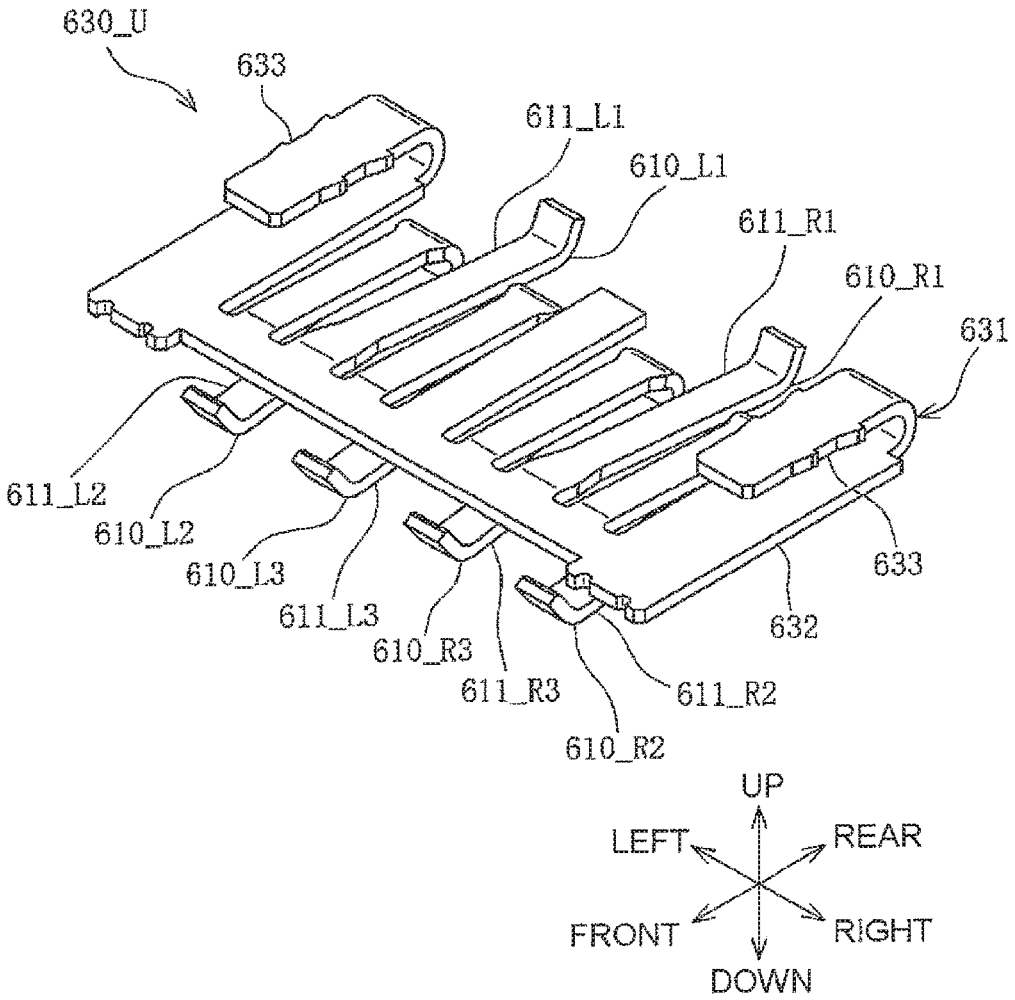
FIG. 24 is an exploded perspective view of a spring member of the fifth embodiment.
Figure 25:
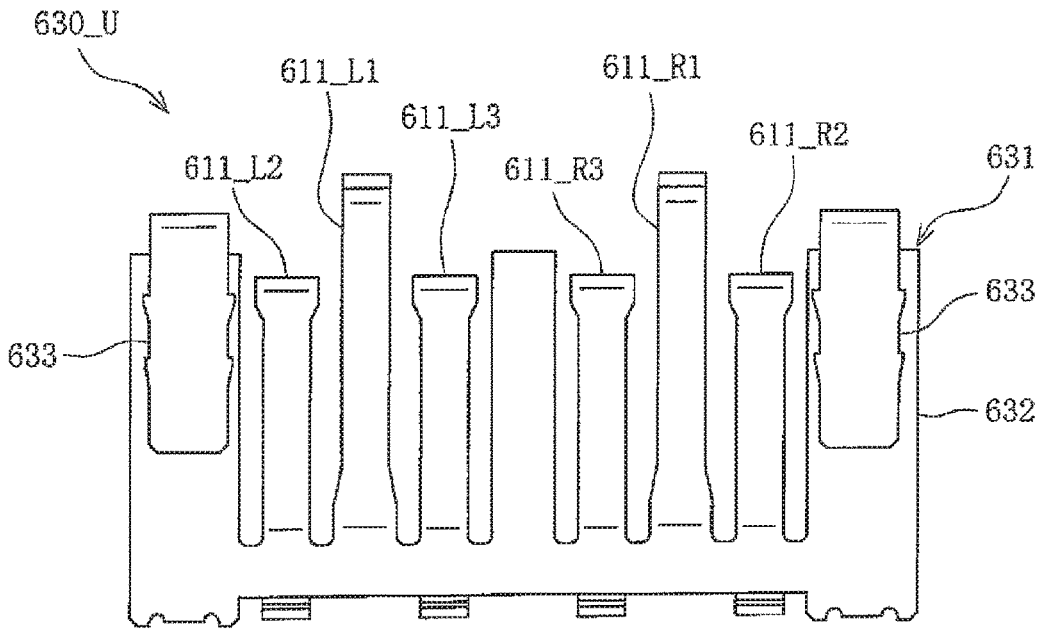
FIG. 25 is a plan view of the spring member of the fifth embodiment.
Figure 25:
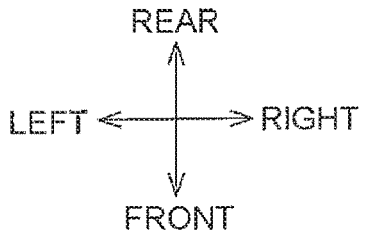
Figure 26:
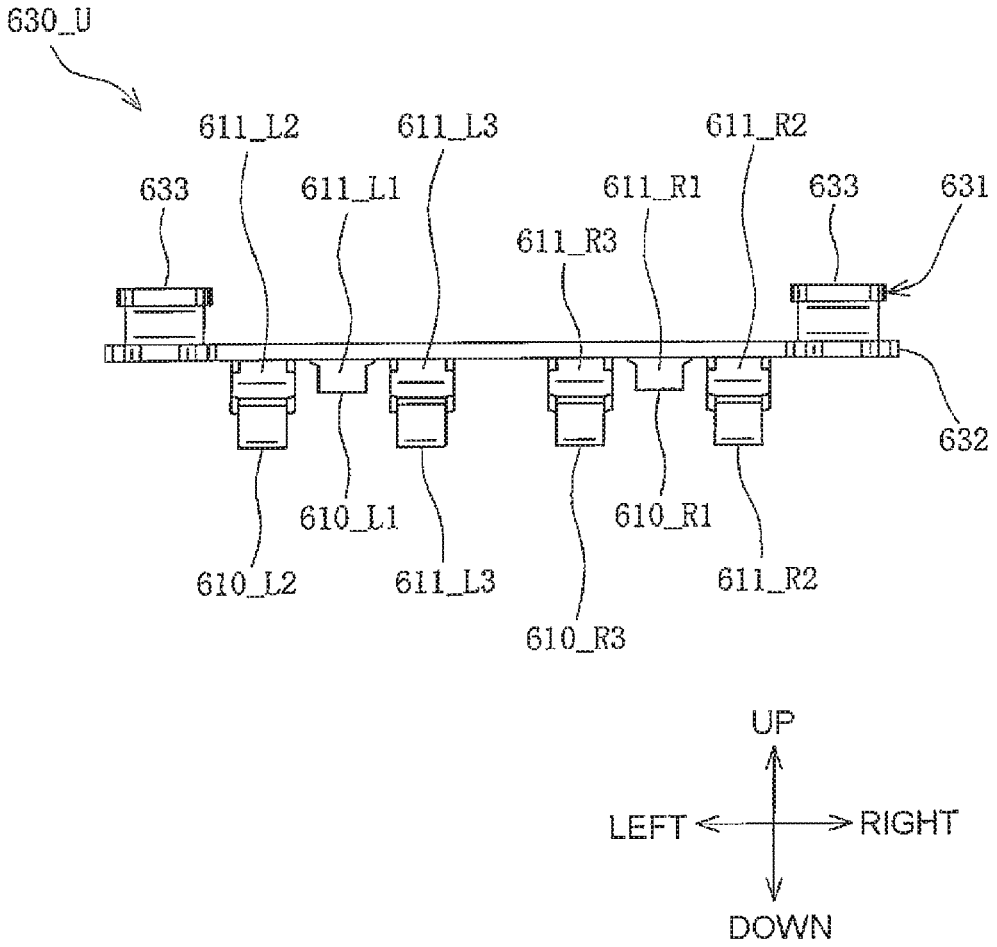
FIG. 26 is a front view of the spring member of the fifth embodiment.
Figure 27:
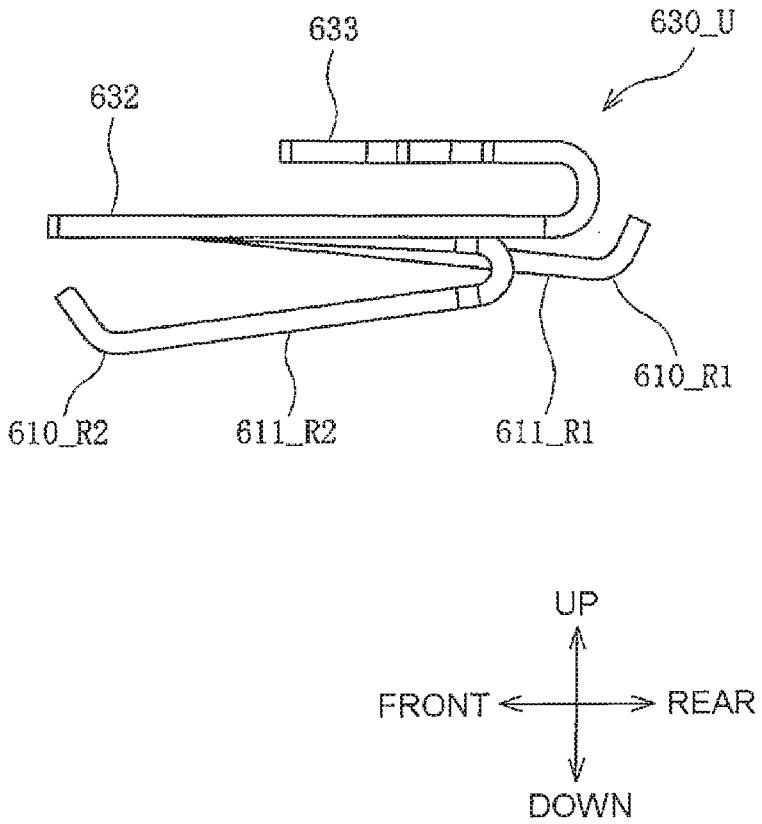
FIG. 27 is a right side view of the spring member of the fifth embodiment.

As illustrated in FIG. 22 and in FIG. 23 being a perspective view, the main body portion 629 includes the plurality of contacts 101, the housing 102, and the plurality of locking portions 104_L and 104_R, which are the same as those of the first embodiment, and a shell 603 which is different from that of the first embodiment.

Similarly to the first embodiment, the plurality of contacts 101 are fixed to the contact fixing member 124 and mounted to the housing 102.

The shell 603 has substantially the same configuration as that of the shell 103 of the first embodiment except for that the plurality of abutment portions 110_L1, 110_L2, 110_L3, 110_R1, 110_R2, and 110_R3 and the plurality of biasing portions 111_L1, 111_L2, 111_L3, 111_R1, 111_R2, and 111_R3 are not provided. When the main body portion 629 is assembled to the retaining member 618, the shell 603 is arranged in a hole portion 621 of the retaining member 618.

Specifically, similarly to the shell 103 of the first embodiment, the shell 603 is a cylindrical member which extends in the front-and-rear direction and is provided around the housing 102. The shell 603 includes main outer surface portions 606_U and 606_D, which are different from those of the first embodiment, and the side surface portions 109_L and 109_R, which are the same as those of the first embodiment. With this configuration, a substantially entire outer surface of the shell 103 is formed.

The main outer surface portions 606_U and 606_D do not include the plurality of abutment portions 110 and the plurality of biasing portions 111. Other than this point, the main outer surface portions 606_U and 606_D have substantially the same configurations as those of the main outer surface portions 106_U and 106_D of the first embodiment.

As illustrated in FIG. 24 to FIG. 27, each of the spring members 630_U and 630_D is a member which is integrally constructed and made of metal, and is fixed in the hole portion (621) of the retaining member (618) as described later. FIG. 24 to FIG. 27 are a perspective view, a plan view, a front view, and a right side view of the spring member 630_U, respectively. The material of each of the spring members 630_U and 630_D is not limited to the above-mentioned metal, and may be resin or other materials.

The spring members 630_U and 630_D are formed separately from the main body portion 629 and are reversed up and down. In the following, description is made of the configuration of the spring member 630_U with reference to FIG. 24 to FIG. 27. The configuration of the spring member 630_D is obtained by reversing the configuration of the spring member 630_U up and down, and hence detailed description thereof is omitted for simple description. Further, the spring members 630_U and 630_D are also described as "spring member 630" unless otherwise distinguished.

As illustrated in FIG. 24 to FIG. 27, the spring member 630_U is in the right-left symmetry and includes a fixing portion 631, which is to be fixed to the retaining member (618), a plurality of abutment portions 610_L1, 610_L2, 610_L3, 610_R1, 610_R2, and 610_R3, and a plurality of biasing portions 611_L1, 611_L2, 611_L3, 611_R1, 611_R2, and 611_R3. In the following, the abutment portions 610_L1, 610_L2, 610_L3, 610_R1, 610_R2, and 610_R3 are also described as "abutment portion 610" unless otherwise distinguished. Further, the biasing portions 611_L1, 611_L2, 611_L3, 611_R1, 611_R2, and 611_R3 are also described as "biasing portion 611" unless otherwise distinguished.

Specifically, the fixing portion 631 includes a first fixing portion 632 and right and left second fixing portions 633.

The first fixing portion 632 is a portion which includes a flat belt-like connection portion extending rightward and leftward and flat rectangular extending portions extending rearward from both ends and a center of the belt-like connection portion. Respective front ends of the three rectangular extending portions are connected by the belt-like connection portion.

The right and left second fixing portions 633 are portions which are connected to rear ends of the right and left extending portions of the first fixing portion 632, are curved upward, and extend forward. Each of the second fixing portions 633 has two pairs of small protrusions protruding rightward and leftward.

Under a state in which the spring members 630_U and 630_D are fixed to the retaining member (618) described later, when the shell 603 is assembled to the retaining member (618), that is, when the shell 603 is arranged in the hole portion 621, the plurality of abutment portions 610 are brought into abutment against the shell 603. In the fifth embodiment, six abutment portions 610 are formed on the spring member 630_U.

Specifically, the abutment portions 610_L1 to 610_L3 and the abutment portions 610_R1 to 610_R3 are arranged in the right-left symmetry, that is, arranged in an opposite side over a main plane which is a plane including the main center line ML on the main outer surface portion 606_U and being perpendicular to the main outer surface portion 606_U. As described above, the main plane is an imaginary plane.

Therefore, it may be considered that, for example, the abutment portion 610_L1 and the abutment portion 610_R1 correspond to the first abutment portion and the second abutment portion, respectively.

In this case, the abutment portions 610_L2, 610_L3, 610_R2, and 610_R3 other than the abutment portion 610_L1 and the abutment portion 610_R1 are not linearly aligned with the abutment portion 610_L1 and the abutment portion 610_R1. That is, the abutment portions 610_L2, 610_L3, 610_R2, and 610_R3 other than the abutment portion 610_L1 and the abutment portion 610_R1 are provided at positions forming a triangle with the abutment portion 610_L1 and the abutment portion 610_R1. Therefore, it may be considered that one abutment portion suitably selected from the abutment portions 610_L2, 610_L3, 610_R2, and 610_R3 which are other than the abutment portion 610_L1 and the abutment portion 610_R1 corresponds to the third abutment portion.

For example, it is assumed that the abutment portion 610_L2 or 610_L3 corresponds to the third abutment portion. In this case, it may be considered that one abutment portion suitably selected from the abutment portions 610_R2 and 610_R3, which are other than the abutment portion 610_L1 and the abutment portion 610_R1 and are in an opposite side over the main plane with respect to one of the abutment portions 610_L2 and 610_L3 corresponding to the third abutment portion, corresponds to the fourth abutment portion.

Further, it is assumed that, as is different from the above-mentioned example with regard to the third abutment portion, one of the abutment portions 610_R2 and 610_R3 corresponds to the third abutment portion. In this case, it may be considered that one abutment portion suitably selected from the abutment portions 610_L2 and 610_L3, which are other than the abutment portion 610_L1 and the abutment portion 610_R1 and are in an opposite side over the main plane with respect to one of the abutment portions 610_R2 and 610_R3 corresponding to the third abutment portion, corresponds to the fourth abutment portion.

As described above, it is only necessary that the first abutment portion and the second abutment portion be arranged in an opposite side over the main plane. Thus, for example, a combination of one abutment portion suitably selected from the abutment portions 610_L1 to 610_L3 and one abutment portion suitably selected from the abutment portions 610_R1 to 610_R3 may correspond to the combination of the first abutment portion and the second abutment portion.

Further, some abutment portions 610 other than abutment portions corresponding to the first abutment portion and the second abutment portion are not linearly aligned with the abutment portions corresponding to the first abutment portion and the second abutment portion. That is, some abutment portions 610 other than the abutment portions corresponding to the first abutment portion and the second abutment portion are arranged at positions forming a triangle with the abutment portions corresponding to the first abutment portion and the second abutment portion. Therefore, one abutment portion suitably selected from the abutment portions 610 other than abutment portions corresponding to the first abutment portion and the second abutment portion may correspond to the third abutment portion. Further, one abutment portion suitably selected from the abutment portions, which are other than the abutment portions corresponding to the first abutment portion and the second abutment portions and are in a positional relationship of being located in an opposite side over the main plane with respect to the abutment portion 610 corresponding to the third abutment portion, may correspond to the fourth abutment portion.

The plurality of biasing portions 611_L1 to 611_L3 and 611_R1 to 611_R3 are associated with the plurality of abutment portions 610_L1 to 610_L3 and 610_R1 to 610_R3, respectively, and bias the associated abutment portions 610_L1 to 610_L3 and 610_R1 to 610_R3 in respective abutment directions.

The plurality of biasing portions 611_L1 to 611_L3 and 611_R1 to 611_R3 are associated with the plurality of abutment portions 610_L1 to 610_L3 and 610_R1 to 610_R3, respectively. When the spring member 630_U is arranged in the hole portion (621) of the retaining member (618) along with shell 603, the plurality of biasing portions 611_L1 to 611_L3 and 611_R1 to 611_R3 bias the associated abutment portions 610_L1 to 610_L3 and 610_R1 to 610_R3 in respective abutment directions.

In the fifth embodiment, When the spring member 630_U is arranged in the hole portion (621) of the retaining member (618) along with shell 603, the abutment directions of the abutment portions 610 of the spring member 630_U are oriented downward. Thus, When the spring member 630_U is arranged in the hole portion (621) of the retaining member (618) along with shell 603, the plurality of biasing portions 611 formed on the spring member 630_U bias the plurality of abutment portions 610 downward.

Each of the plurality of biasing portions 611 of the fifth embodiment has one end being the fixed end connected to the belt-like connection portion of the first fixing portion 632 and has another end being the free end.

Specifically, each of the biasing portions 611_L1 and 611_R1 generally has the front end being the fixed end connected to the belt-like connection portion of the first fixing portion 632 and the rear end being the free end, to form a cantilevered state, and extends in the front-and-rear direction. Each of the biasing portions 611_L1 and 611_R1 is inclined so as to protrude downward as extending rearward from the front end being the fixed end. Between the front end and the rear end of each of the biasing portions 611_L1 and 611_R1, each of the associated abutment portions 610_L1 and 610_R1 is formed. In the fifth embodiment, the abutment portions 610 are formed so that a vicinity of the rear end of each of the biasing portions 611, which is a portion located between the rear end and a position separated forward from the rear end by a predetermined distance, protrudes downward while being curved along the front-and-rear direction.

Each of the biasing portions 611_L2, 611_L3, 611_R2, and 611_R3 generally includes a first inclined portion, a turning portion, and a second inclined portion.

The first inclined portion has a front end being a fixed end connected to the belt-like connection portion of the first fixing portion 632, and is a portion which is inclined and extends so as to protrude downward as extending rearward from the fixed end.

The turning portion is a portion which is curved between the first inclined portion and the second inclined portion, and is formed so as to turn the extending directions of the first inclined portion and the second inclined portion. Specifically, the turning portion generally forms a semi-cylindrical shape about a right-and-left axis between the end portion positioned on an upper side and connected to the first inclined portion and the end portion positioned on a lower side and connected to the second inclined portion.

The second inclined portion has a rear end being a fixed end connected to the turning portion and is a portion which is inclined and extends so as to protrude downward as extending forward from the fixed end. The front end of the second inclined portion is a free end, and a portion which is bent or curved in the vicinity of the front end, which is a position separated rearward from the front end by a predetermined distance, is the associated abutment portion 610.

Each of the biasing portions 611_L1 to 611_L3 and 611_R1 to 611_R3 has flexibility. Therefore, when the abutment portions 610 are displaced, the biasing portions 611 associated with the abutment portions 610 can bias the abutment portions 610 in the abutment directions by the restoring forces.

<<Method of Use>>

Figure 28:
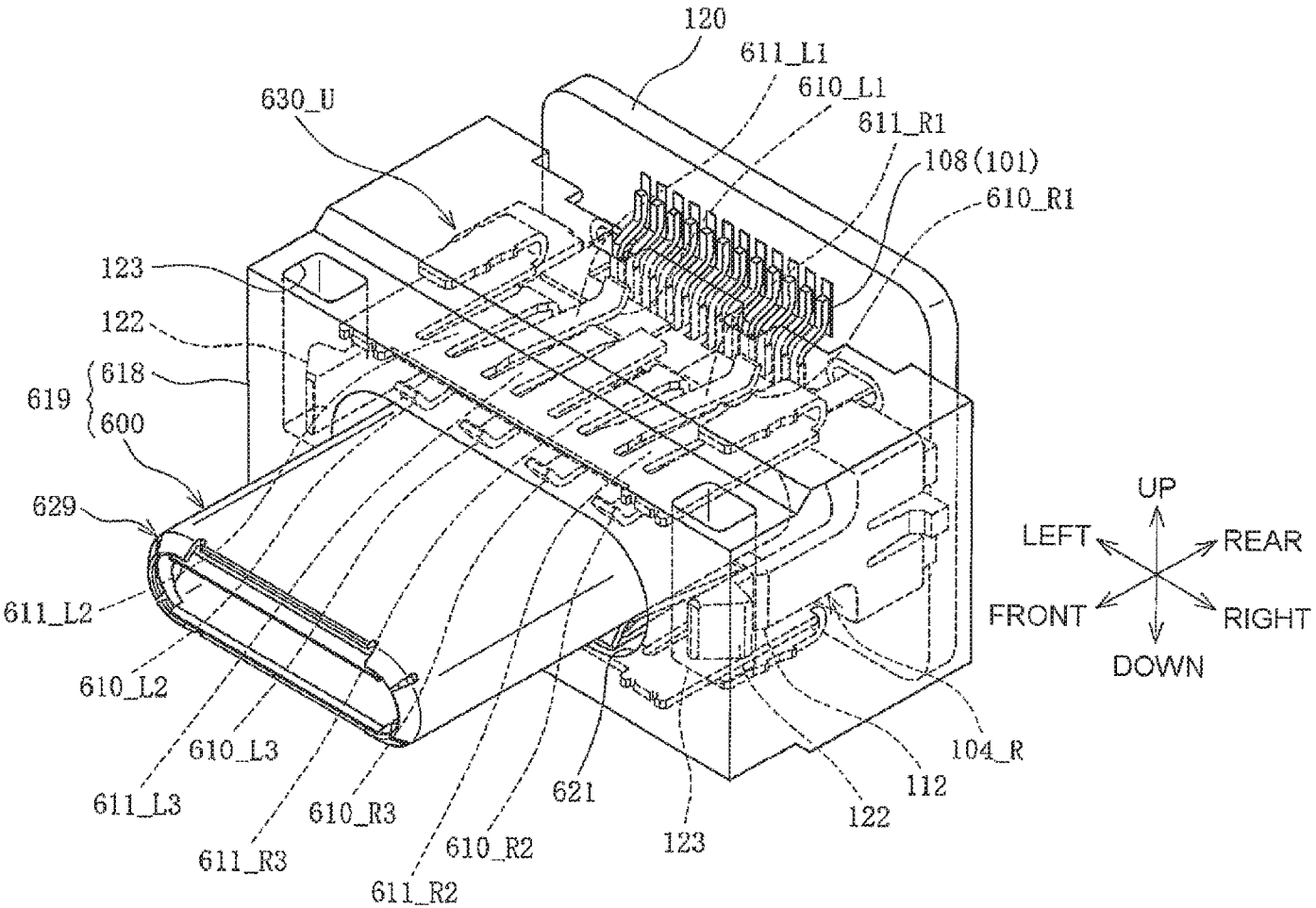
FIG. 28 is a perspective view for illustrating an example of a state of use of the connector according to the fifth embodiment.
Figure 29:
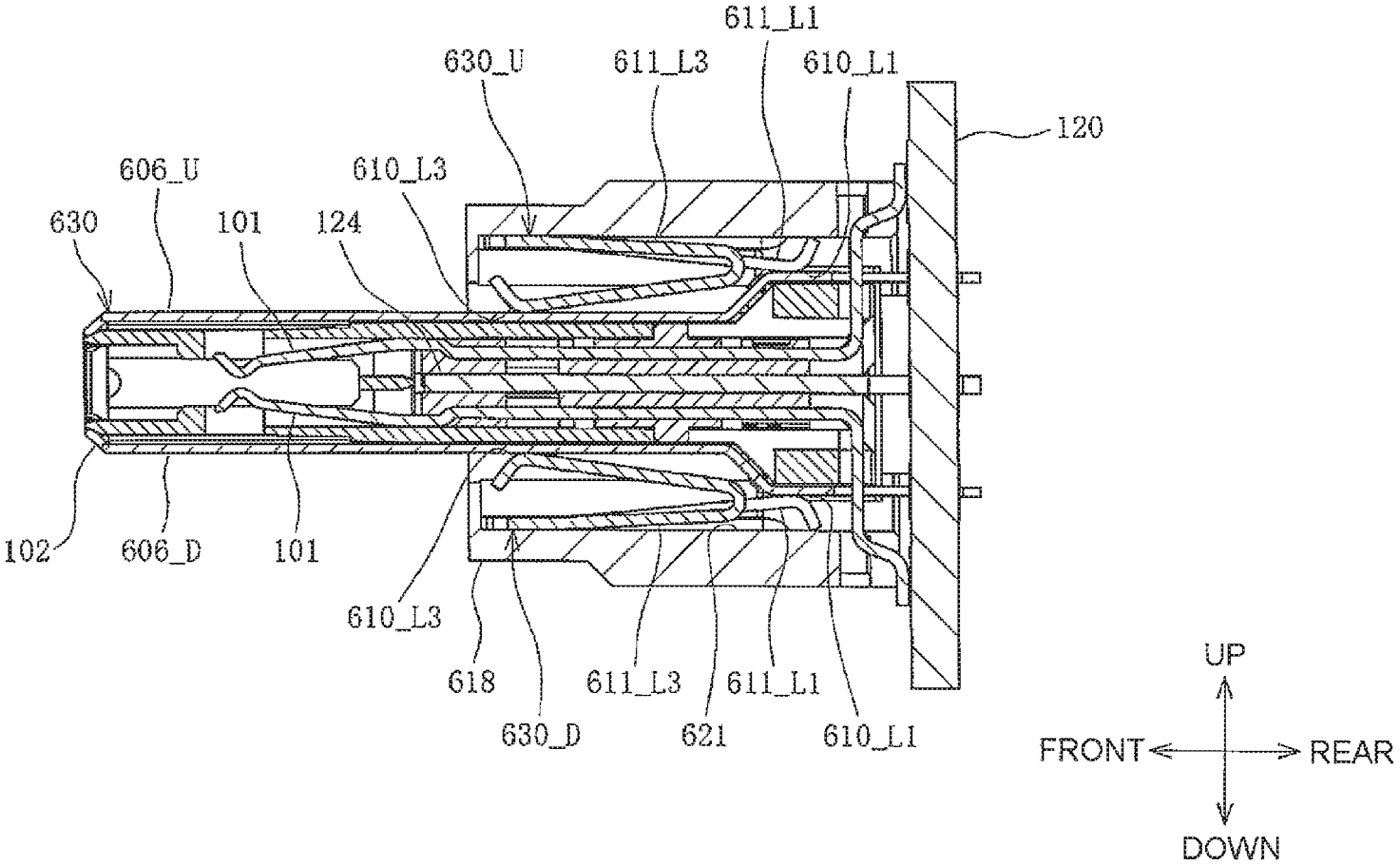
FIG. 29 is a side sectional view for illustrating an example of the state of use of the connector according to the fifth embodiment.
Figure 30:
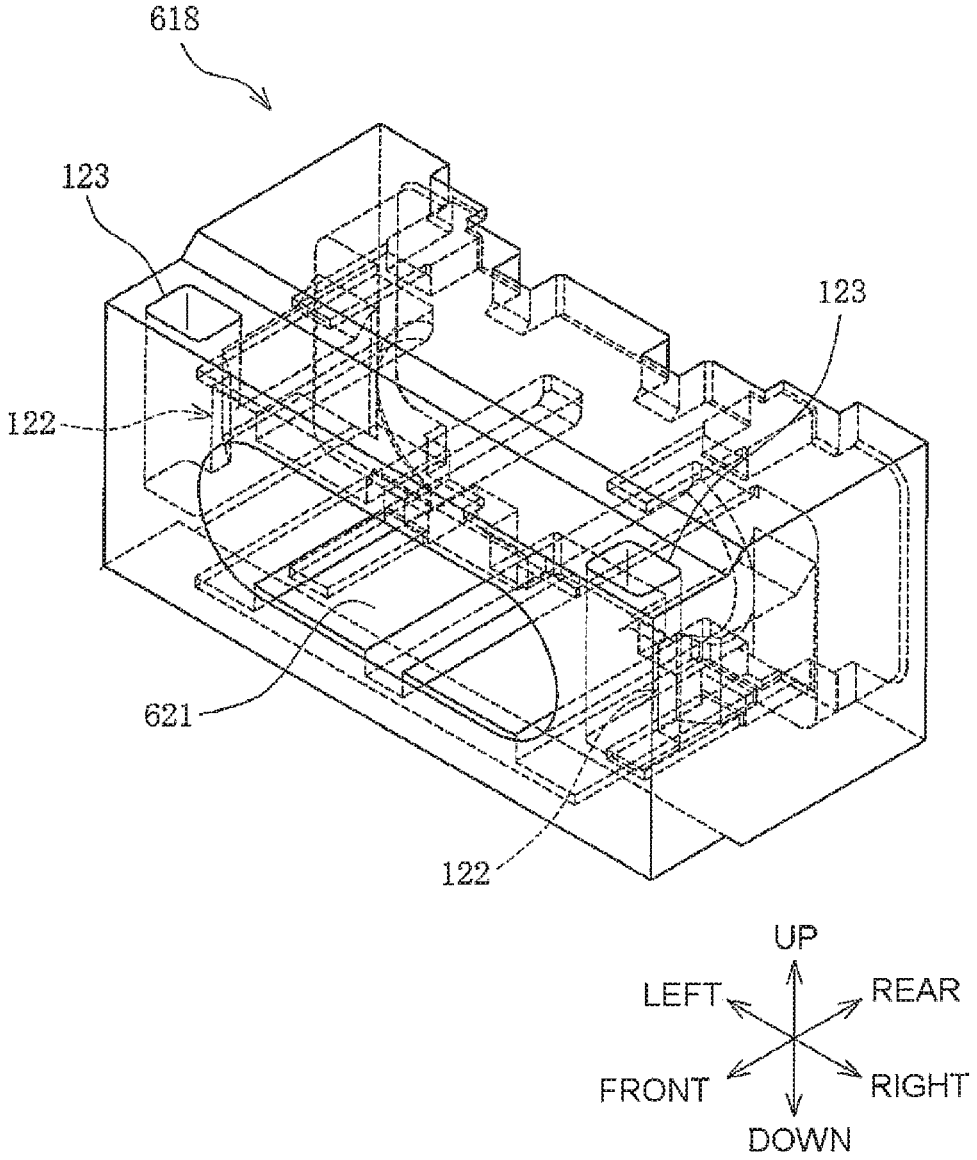
FIG. 30 is a first perspective view of a retaining member of the fifth embodiment.
Figure 31:
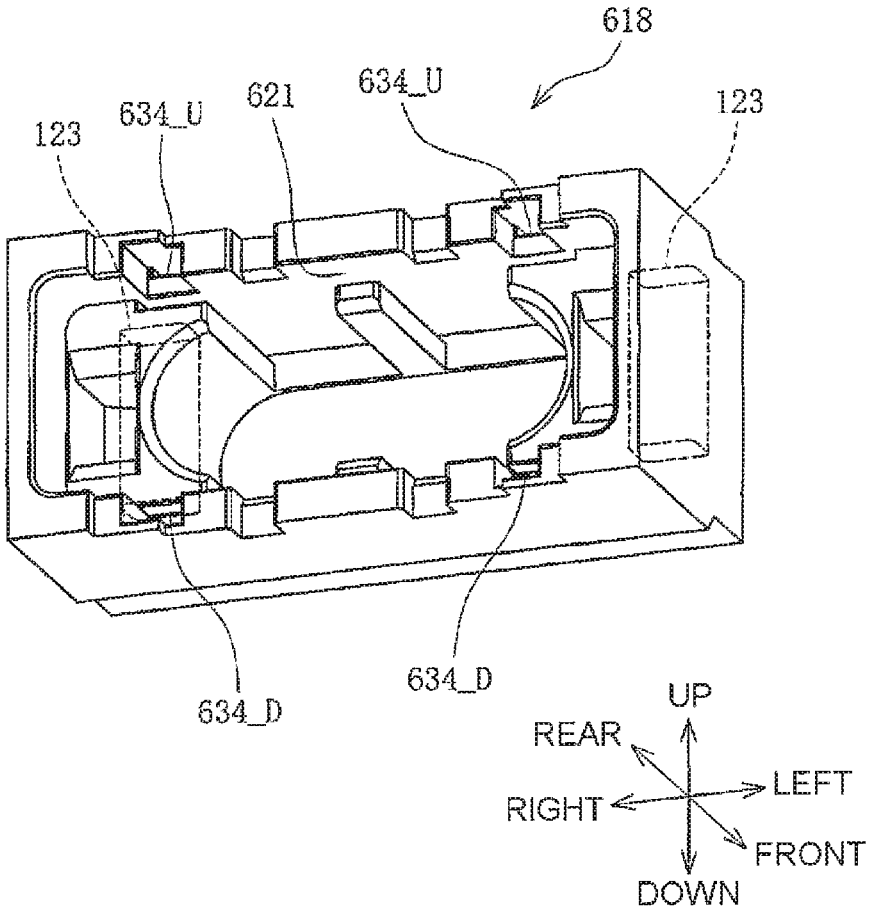
FIG. 31 is a second perspective view of the retaining member of the fifth embodiment.

During use of the connector 600, as exemplified in FIG. 28 and FIG. 29, the connector 600 is arranged in the hole portion 621 of the retaining member 618 to construct the floating connector 619. FIG. 28 and FIG. 29 are illustrations of an example in which the board 120 being the mounted object is mounted to the floating connector 619. FIG. 28 is a perspective view for illustrating an example of a state of use of the connector 600 according to the fifth embodiment. FIG. 29 is a sectional view for illustrating the state of use illustrated in FIG. 28 as viewed from the right side.

The floating connector 619 includes the retaining member 618 and the connector 600. The retaining member 618 has the hole portion 621, and the connector 600 is arranged in the hole portion 621.

For example, as illustrated in FIG. 28 to FIG. 31, the hole portion 621 forms a hole which penetrates through the retaining member 618 in the front-and-rear direction, and includes fitting portions 634_U and 634_D in addition to the locked portions 122 and the releasing hole portions 123 which are the same as to those of the first embodiment.

The fitting portions 634_U and 634_D form holes for fixing the spring members 630_U and 630_D, respectively. In the following, the fitting portions 634_U and 634_D are also described as "fitting portion 634" unless otherwise distinguished. Specifically, the first fixing portion 632 is fitted to the fitting portion 634. In this manner, the spring member 630 is fixed to the hole portion 621, and the abutment portions 610 and the biasing portions 611 are exposed in the hole portion 621.

Similarly to the first embodiment, the locking lances 114 are locked to the locked portions 122. With this action, the main body portion 629 becomes less liable to be removed from the retaining member 618.

Further, under the state in which the connector 600 is assembled to the retaining member 618, that is, under a state in which the shell 603 is arranged in the hole portion 621, each of the abutment portions 610 is brought into abutment against the shell 603, and each of the main abutment portion 112 and the sub-abutment portions 116 is brought into abutment against the hole portion 621. In contrast, the main body portion 629 is not brought into abutment against the hole portion 621 at portions other than the abutment portions 610, the main abutment portions 112, and the sub-abutment portions 116.

The biasing portions 611 then bias the associated abutment portions 610 in the abutment directions. Further, similarly to the first embodiment, the main biasing portion 113 and the sub-biasing portion 117 bias the main abutment portion 112 or the sub-abutment portion 116 formed on the same locking portion 104 in the abutment direction.

Herein, the abutment direction of the abutment portion 610 corresponds to the normal direction of the tangential plane of the abutment portion 610, and is the same as the abutment direction of the abutment portion 110 of the first embodiment.

As described above, when the shell 603 is arranged in the hole portion 621, there are interposed the abutment portions 610 with the biasing portions 611, the main abutment portions 112 with the main biasing portions 113, and the sub-abutment portions 116 with the sub-biasing portions 117 between the shell 603 and the hole portion 621. With this action, the abutment portions 610, the main abutment portions 112, and the sub-abutment portions 116 are biased in the abutment directions by the biasing portions 611, the main biasing portions 113, and the sub-biasing portions 117, respectively, to be brought into contact with the shell 603 and the hole portion 621. As a result, the shell 603 is positioned with respect to the retaining member 118 at a predetermined reference position.

At the reference position, the shell 603 is not held in abutment against the hole portion 621 at portions excluding the abutment portions, and a gap is formed between the shell 603 and the hole portion 621. Therefore, when an external force is applied to the connector 600, the shell 603 can move in the hole portion 621 against the biasing forces of the biasing portions 611, the main biasing portions 113, and the sub-biasing portions 117.

With this action, the connector 600 assembled to the retaining member 618 constructs the floating connector. Accordingly, for example, when the connector 600 is fitted to a mating connector (not shown), the connector 600 can follow a position or inclination of the mating connector to move within a predetermined range determined by the hole portion 621.

When the mating connector is removed, the shell 603 is restored to the reference position by the biasing forces of the biasing portions 611, the main biasing portions 113, and the sub-biasing portions 117.

<<Method of Assembly>>

As described above, the connector 600 according to the fifth embodiment is typically used as the floating connector 619 in which the connector 600 is assembled to the retaining member 618. A board, a cable, or the like being the mounted object is mounted to the floating connector 619 in many cases.

Now, an example of the case where the board 120 is employed as the mounted object is given to describe a method of assembly of the floating connector 619 mounted to the board 120 (see FIG. 28).

The shell 603, the housing 102, and the contacts 101 fixed to the contact fixing member 124 are prepared (see FIG. 22).

The shell 603, the housing 102, and the contacts 101 fixed to the contact fixing member 124 are assembled in the manner similar to the first embodiment, thereby manufacturing the main body portion 629.

Figure 32:
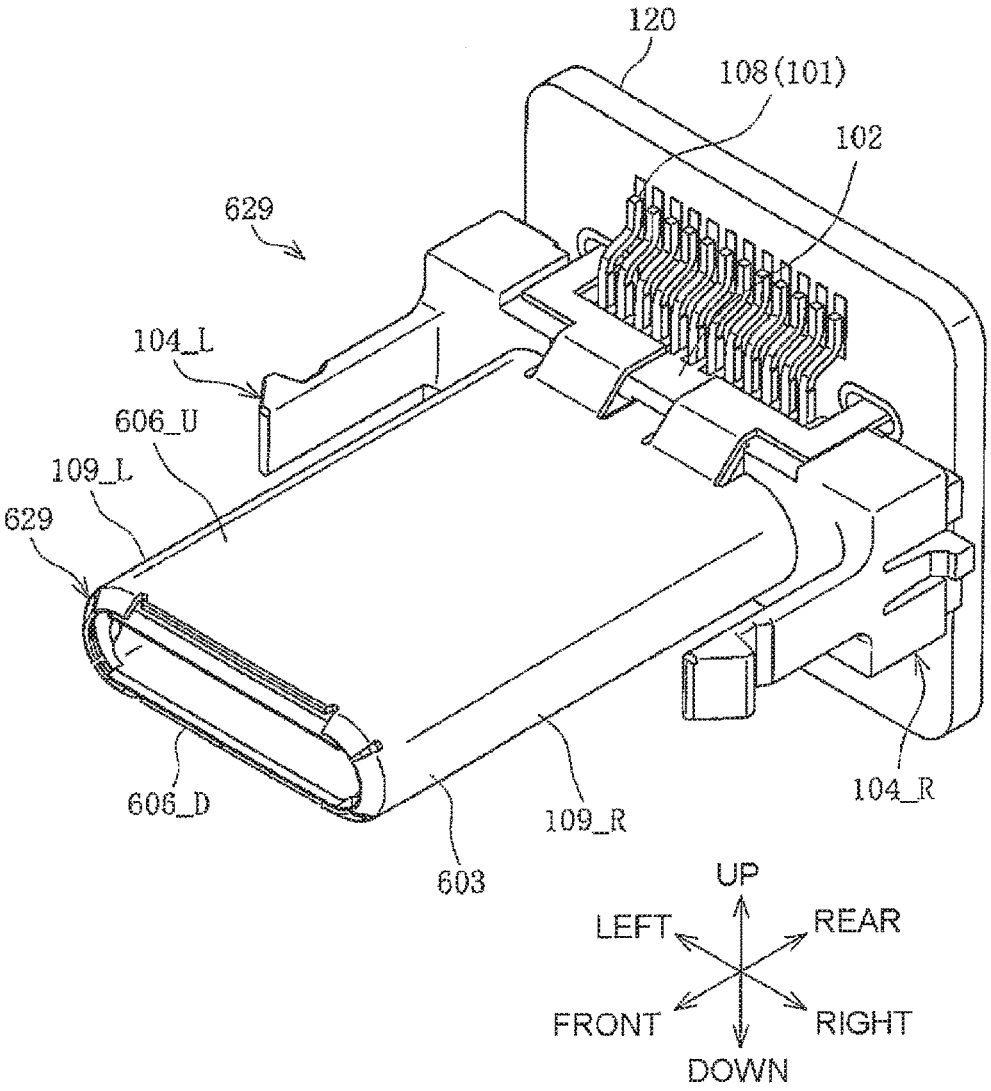
FIG. 32 is a perspective view of the main body portion with a board of the fifth embodiment.

As illustrated in FIG. 32, the main body portion 629 is mounted to the board 120. Specifically, as described in the first embodiment, the mounting portions 108 are fixed by welding or the like to a circuit or the like (not shown) provided on the board 120. In this manner, the main body portion mounted to the board 120, that is, the main body portion with the board is manufactured.

Figure 33:
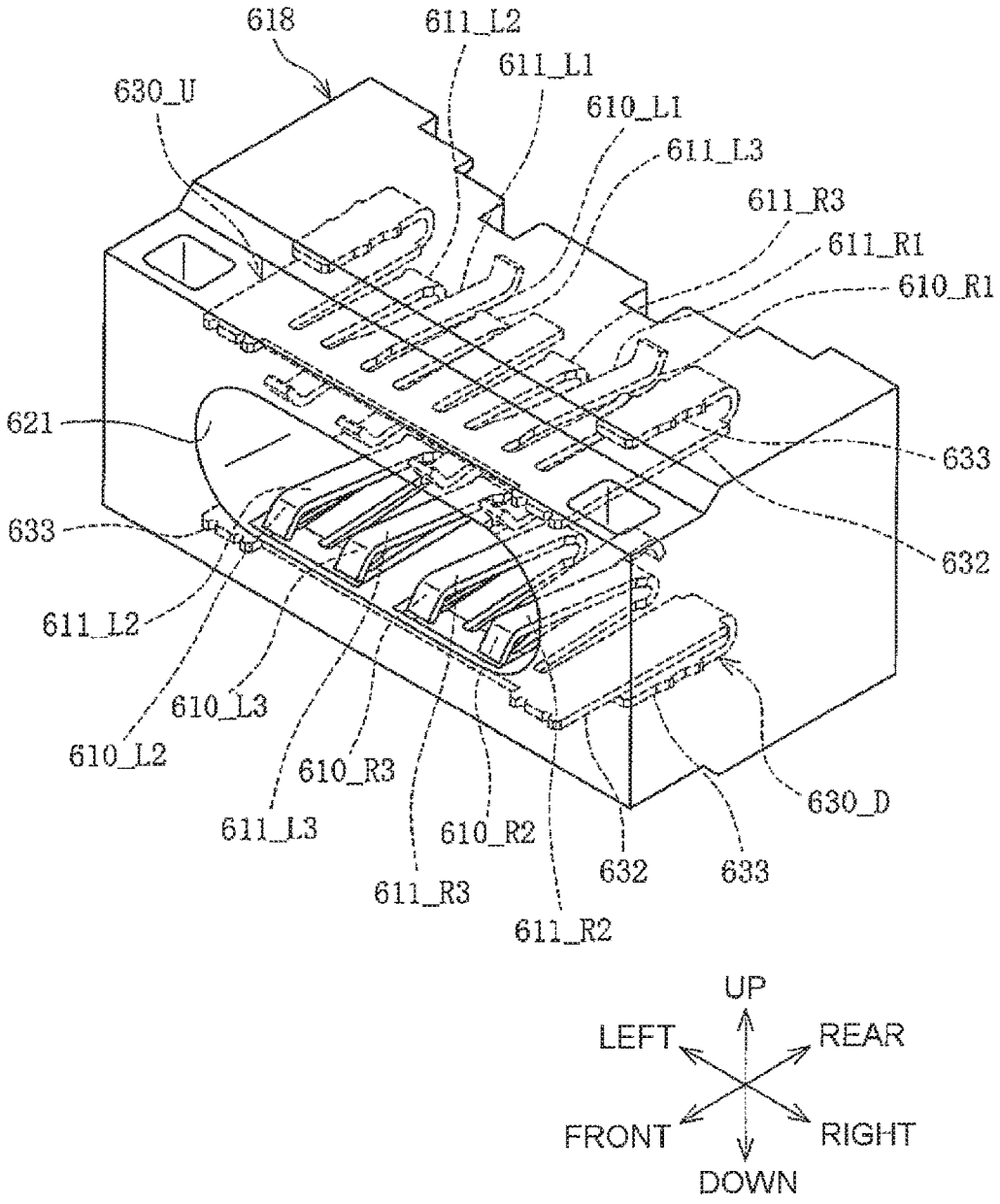
FIG. 33 is a first perspective view of the retaining member to which the spring member of the fifth embodiment is fitted.
Figure 34:
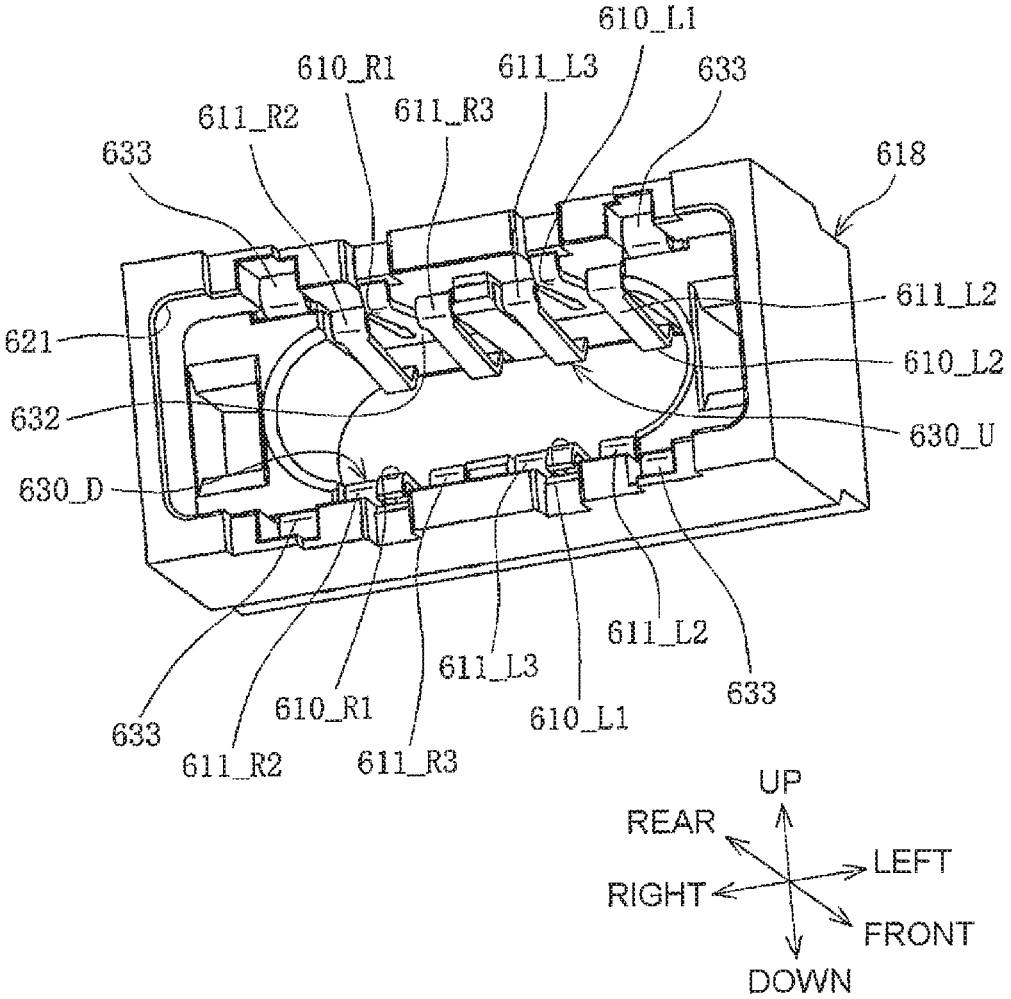
FIG. 34 is a second perspective view of the retaining member to which the spring member of the fifth embodiment is fitted.

The retaining member 618 and the spring members 630_U and 630_D are prepared. As illustrated in FIG. 33 being a perspective view as viewed from an upper front right side obliquely and in FIG. 34 being a perspective view as viewed from a lower rear left side obliquely, the spring members 630_U and 630_D are fitted to the fitting portions 634_U and 634_D of the retaining member 618, respectively. At this time, as described above, the spring members 630_U and 630_D have small protrusions formed at the second fixing portions 633, and hence are press-fitted and fixed to the holes of the fitting portions 634_U and 634_D, respectively.

Figure 35:
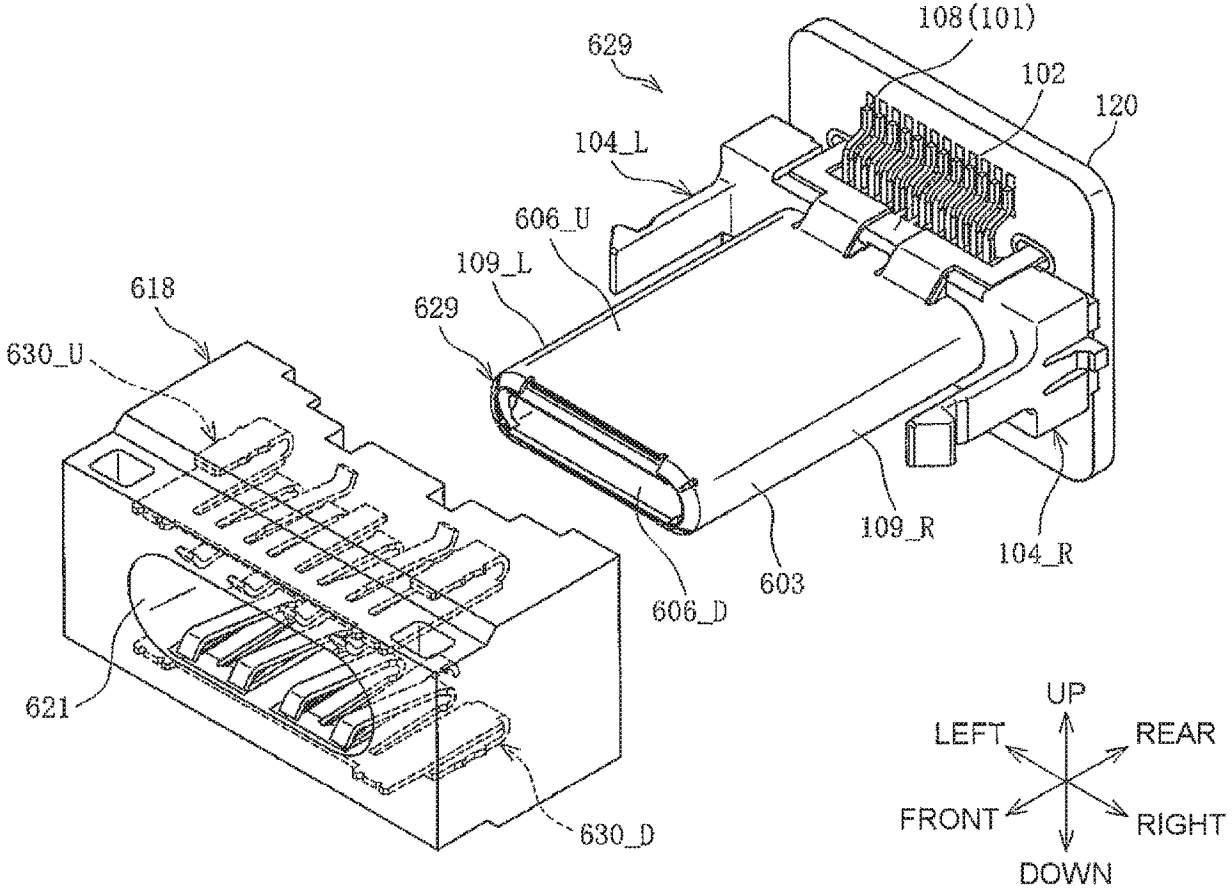
FIG. 35 is a view for illustrating a state immediately before the main body portion with the board is assembled to the retaining member to which the spring member of the fifth embodiment is fitted.

As illustrated in FIG. 35, the main body portion with the board is positioned behind the hole portion 621 of the retaining member 618 to which the two spring members 630 are fitted. After that, the main body portion with the board is moved forward. As a result, the locking lances 114 are locked to the locked portions 122 so that the shell 603 is arranged in the hole portion 621. In this manner, as illustrated in FIG. 28, the main body portion with the board is assembled to the retaining member 618 so that the floating connector 619 to which the board 120 is mounted is manufactured.

In the above, description is made of the fifth embodiment of this invention. Also with the fifth embodiment, the effect which is similar to that of the first embodiment is achieved. Further, according to the fifth embodiment, the spring members 630_U and 630_D are formed separately from the shell 603. Therefore, the biasing portions 611 which are larger than the biasing portions 111 being formed integrally with the shell 103 as in the first embodiment can easily be manufactured. Therefore, the gap between the shell 603 and the hole portion 621 is increased, thereby being capable of achieving the floating connector 619 having a larger floating amount.

In the above, the embodiments and the modification examples of this invention are described. However, this invention is not limited to those embodiments and modification examples. For example, this invention may include a mode in which the embodiments and the modification examples described above are partially or entirely combined in a suitable manner or a mode suitably changed from the mode of combination.

What is claimed is:

1. A connector which is to be arranged in a hole portion formed in a retaining member, comprising:

an outer surface portion which extends in a fitting direction of the connector;

a plurality of abutment portions which are to be brought into abutment against any one of the outer surface portion and the hole portion when the connector is arranged in the hole portion; and a plurality of biasing portions, which are interposed between the outer surface portion and the hole portion and are configured to bias the plurality of abutment portions in respective abutment directions, the plurality of abutment portions comprising:

a first abutment portion and a second abutment portion which are formed in an opposite side over a main plane, the main plane including a main center line of center lines of the outer surface portion, which is parallel to the fitting direction, and being perpendicular to the outer surface portion; and a third abutment portion which is formed at a position forming a triangle with the first abutment portion and the second abutment portion.

2. A connector according to claim 1, wherein the plurality of abutment portions and the plurality of biasing portions are integrally formed and fixed in the hole portion, wherein the plurality of abutment portions are brought into abutment against the outer surface portion when the connector is arranged in the hole portion, and wherein the plurality of biasing portions are interposed between the outer surface portion and the hole portion to bias the plurality of abutment portions in the respective abutment directions.

3. A connector according to claim 1, wherein the plurality of abutment portions are brought into abutment against the hole portion when the connector is arranged in the hole portion, and wherein each of the plurality of biasing portions has one end fixed to the outer surface portion and extends from the one end along the fitting direction so as to be interposed between the outer surface portion and the hole portion, to thereby bias the plurality of abutment portions in the respective abutment directions.

4. A connector according to claim 1, wherein the third abutment portion is formed so as to be deviated from the main center line parallel to the fitting direction, wherein the plurality of abutment portions further comprise a fourth abutment portion formed in an opposite side over the main plane with respect to the third abutment portion, and wherein the fourth abutment portion is formed at a position forming a triangle with the first abutment portion and the second abutment portion.

5. A connector according to claim 1, wherein both the first abutment portion and the second abutment portion are formed at positions at which the first abutment portion and the second abutment portion are brought into abutment against a vicinity of an end portion of the hole potion, which is close to a base portion of the connector when the connector is arranged in the hole portion.

6. A connector according to claim 1, further comprising:
a housing to which a plurality of contacts are fixed; and
a shell, which is a cylindrical member extending in the fitting direction and is provided around the housing,
wherein the shell includes the outer surface portion, and
wherein the plurality of abutment portions and the plurality of biasing portions are formed integrally with the shell.

7. A connector according to claim 1, further comprising a plurality of locking portions which extend in the fitting direction to be locked to the hole portion,
wherein each of the plurality of locking portions comprising:
another abutment portion which is to be brought into abutment against the hole portion when the connector is arranged in the hole portion;
another biasing portion which extends in the fitting direction so as to bias the another abutment portion; and
a locking lance, which protrudes in a biasing direction of the another biasing portion and is to be locked to the hole portion when the connector is arranged in the hole portion.

8. A connector according to claim 7, further comprising:
another outer surface portion which is parallel to the outer surface portion; and
side surface portions which connect side ends of the outer surface portion and the another outer surface portion along the fitting direction,
wherein the plurality of locking portions include a first locking portion and a second locking portion which are provided in opposite sides about a center plane, the center plane passing through a sub-center line of the side surface portions, which is parallel to the fitting direction and being parallel to the outer surface portion.

9. A connector according to claim 8, wherein the plurality of locking portions are formed integrally with the housing.

10. A connector according to claim 9,
wherein at least one of the plurality of locking portions comprises:
a connection portion having one end connected to a vicinity of a base portion of the housing and another end connected to a base portion of the another biasing portion;
a sub-abutment portion, which is formed in a vicinity of a base portion of the connection portion and is brought into abutment against the hole portion when the connector is inserted to the hole portion; and
a sub-biasing portion, which extends in the fitting direction in the connection portion and is configured to bias the sub-abutment portion.

11. A composite connector, comprising:
a fixed connector;
a retaining member having a hole portion; and
the connector of claim 1,
the retaining member having the fixed connector fixed to the retaining member and the connector being arranged in the hole portion.

12. A composite connector according to claim 11, wherein the connector is removably arranged in the hole portion.

13. A composite connector, comprising:
a fixed connector;
a retaining member having a hole portion; and
the connector of claim 1,
the retaining member having the fixed connector fixed to the retaining member and the connector being arranged in the hole portion,
the connector extending in a fitting direction of the connector and further comprising a plurality of locking portions to be locked to the hole portion,
each of the plurality of locking portions comprising:
another abutment portion which is to be brought into abutment against the hole portion when the connector is arranged in the hole portion;
another biasing portion which extends in the fitting direction and configured to bias the another abutment portion; and
a locking lance, which protrudes in a biasing direction of the another biasing portion and is to be locked to the hole portion when the connector is arranged in the hole portion,
the hole portion of the retaining member comprising:
a locked portion to which the locking lance is locked; and
a releasing hole portion which communicates with the locked portion from an outside.

* * * * *